United States Patent [19]

Takayanagi et al.

[11] Patent Number: 4,758,860

[45] Date of Patent: Jul. 19, 1988

[54] IMAGE FORMING APPARATUS

[75] Inventors: Yoshiaki Takayanagi; Masato Ishida, both of Kawasaki, Japan

[73] Assignee: Canon Kabushiki Kaisha, Tokyo, Japan

[21] Appl. No.: 800,611

[22] Filed: Feb. 4, 1985

Related U.S. Application Data

[63] Continuation of Ser. No. 333,916, Dec. 23, 1981, abandoned.

[30] Foreign Application Priority Data

Dec. 27, 1980 [JP] Japan ..... 55-186523
Jan. 28, 1981 [JP] Japan ..... 56-10967

[51] Int. Cl.[4] ..... G03G 21/00
[52] U.S. Cl. ..... 355/14 C; 355/14 R
[58] Field of Search ..... 355/3 R, 14 R, 14 SH, 355/14 C

[56] References Cited

U.S. PATENT DOCUMENTS 3,960,446 6/1976 Ogawa et al. ..... 355/3 R X
4,054,380 10/1977 Donohue et al. ..... 355/14 R
4,089,602 5/1978 Noguchi et al. ..... 355/14 R X
4,090,787 5/1978 Hubbard et al. ..... 355/14 R
4,099,860 7/1978 Connin ..... 355/14 C
4,186,299 1/1980 Batchelor ..... 355/14 C X
4,302,098 11/1981 Kan et al. ..... 355/8 X

*Primary Examiner*—Fred L. Braun
*Attorney, Agent, or Firm*—Fitzpatrick, Cella, Harper & Scinto

[57] ABSTRACT

An image forming apparatus which uses process sequence control for forming images using several computers includes circuits for detecting abnormal conditions in either the computer hardware or program sequence. Instruction signals for image formation are entered through an input circuit. When abnormal conditions are detected, the input circuit is prevented from entering instruction signals to one computer and another computer interrupts the image formation process. This other computer transmits data comprising a signal for indicating a process cycle and a signal for indicating disabled image formation.

6 Claims, 85 Drawing Sheets

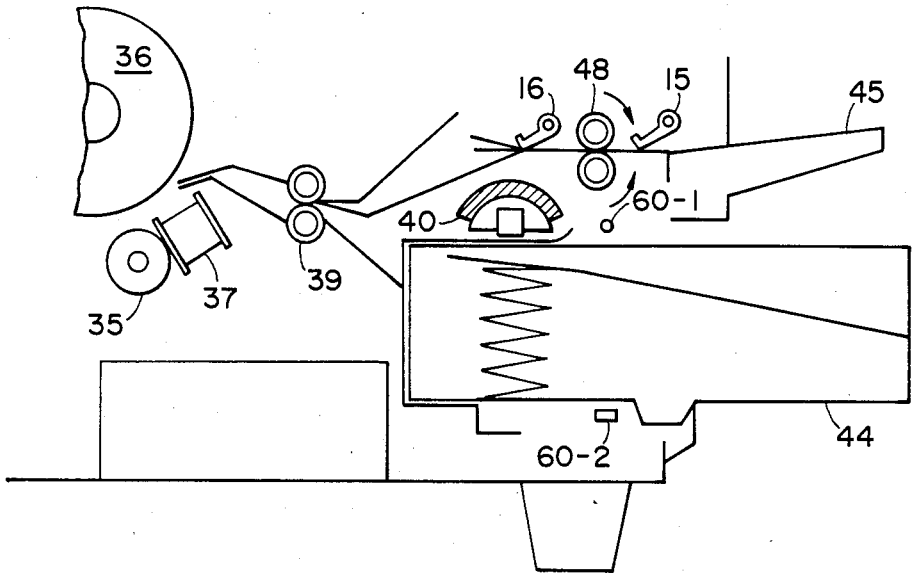
FIG. 5
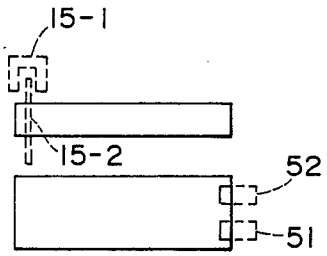
FIG. 6-1
| SIZE | 51 | 52 |
|---|---|---|
| NO | OFF (0) | OFF (0) |
| FULL | ON (1) | ON (1) |
| MIDDLE | ON (1) | OFF (0) |
| HALF | OFF (0) | ON (1) |
FIG. 6-2

| X | Y | SCAN |
|---|---|---|
| 0 | 0 | NO COPY COMMAND |
| 0 | 1 | A3 |
| 1 | 0 | B4 |
| 1 | 1 | A4 |

| | |
|---|---|
| FIG. 20-1A | FIG. 20-1C |
| FIG. 20-1B | FIG. 20-1D |

FIG. 20-1

| | | |
|---|---|---|
| FIG. 20-2A | FIG. 20-2C | FIG. 20-2E |
| FIG. 20-2B | FIG. 20-2D | FIG. 20-2F |

FIG. 20-2

| | | |
|---|---|---|
| FIG. 20-3A | FIG. 20-3D | FIG. 20-3G |
| FIG. 20-3B | FIG. 20-3E | FIG. 20-3H |
| FIG. 20-3C | FIG. 20-3F | |

FIG. 20-3

| | |
|---|---|
| FIG. 20-4A | FIG. 20-4C |
| FIG. 20-4B | FIG. 20-4D |

FIG. 20-4

IMAGE FORMING APPARATUS

This is a continuation of application Ser. No. 333,916, filed Dec. 23, 1981, now abandoned.

BACKGROUND OF THE INVENTION

1. Field of the Invention

The present invention relates to an improvement in the control device for use in an image forming apparatus such as a copier or a printer, and more particularly to an improved information transmission system between plural computers for use in such image forming apparatus to be controlled by said plural computers.

2. Description of the Prior Art

In the control of a copier with two computers, there is already known a system for avoiding the inconvenience in the one-computer control by using one of the computer mainly for sequence control such as the control of the copying process while using the other for real-time control such as receiving of copying key signal or control of segment display.

In such control system, the copying process is initiated by the transmission of a copy execution instruction from the computer for real-time control to the computer for sequence control. At the same time, however, there may be required additional data, particularly mode data such as the size selection signals for the copying sheets set in the copier. Such signals, if supplied to both computers, will require a larger number of input ports as the number of sizes increases. On the other hand, even if such signals are supplied only to one computer, the deficiency in the input ports may still arise since the information has to be transmitted to the other computer. Particularly it is impossible to reduce the number of input/output ports in the commercially available microcomputers as they have a determined number of ports.

Also in the conventional control system with plural computers, the sequence control computer Q2 releases a signal in each copying cycle, in response to which the other control computer Q1, for example, for key entry, drives a copy counter in said control computer. Also upon detection of a copy disabled state such as sheet jamming, the sequence control computer Q2 supplies a signal to the control computer Q1 which thus prohibits the entry of the copy start signal. Furthermore a signal transmission is required when the jammed state is resolved. The transmission of such signals requires a large number of input/output ports.

Furthermore, there are required many input/output ports in order to correct the above-mentioned copy counter in the control computer Q1, when the sheets are lost, for example, in the sheet jamming, according to the number and location of such jammed sheets.

Furthermore additional ports are needed in order to handle complicated signal transmission in case plural copy start modes are present for both computers, such as the manual insertion copy mode in which the copy cycle is started by the manual insertion of a copy sheet in addition to the ordinary copy mode in which automatic sheet feeding from a cassette is initiated by the copy start key.

Furthermore, in the conventional control system with plural computers, a malfunction in a computer resulting, for example, from a fluctuation in the power supply voltage or an erroneous operation, may cause the copier to stop in an undesirable state or to run uncontrollably, or to ignore the instructions entered by the operator. Although there is already proposed a system in which the computer resets itself upon detection of an abnormality therein, it is difficult to synchronize the timing of resetting in case plural computers are involved.

In the conventional image forming apparatus, the scanning of an original document is achieved by illuminating said original with a suitable light source such as a fluorescent lamp and guiding the reflected light into a photosensitive member composed, for example, of cadmium sulfide, or a solid-state imager such as a charge-coupled device. In such scanning there is generally employed a slit exposure method achieving either by displacing a carriage supporting the original or by displacing an optical system comprising mirrors or the like for guiding said reflected light to the photosensitive member or to the solid-state imager.

In order to obtain a high-speed image forming apparatus, the original carriage or the optical system has to be displaced at a correspondingly high speed. For example in an apparatus performing 30 cycles of scanning per minute, the original carriage or the optical system has to perform a reciprocating motion in every two seconds.

The original carriage or the optical system of such speed is stopped at a desired position by deactivating a drive source for a moving member in response to the position thereof detected by detecting means. However, although the detection signal for stopping the moving member is generated in this manner, the moving member can only be stopped with a certain delay due to the inertia thereof or a delay in response of the driving means. Consequently such stopping method gives rise to an uncontrollable error in the stopping position of the moving member, so that the succeeding scanning cycle has to be started from a fluctuating position. For this reason, in the conventional apparatus, the moving member is forced to stop mechanically in order to attain a constant stop position. However such stopping method may generate undesirable vibration or eventually cause damage to the apparatus, particularly in case of a higher moving speed as mentioned above.

SUMMARY OF THE INVENTION

The prime object of the present invention is to provide an image forming apparatus not associated with the above-mentioned drawbacks.

Another object of the present invention is to provide an image forming apparatus in which the above-mentioned drawbacks are eliminated and the number of input/output ports used for signal transfer between the computers is reduced.

Still another object of the present invention is to provide an image forming apparatus which is provided with circuits for detecting the abnormality or the program execution in the plural computers, particularly in the essential computers for operation control and sequence control and for resetting said plural computers upon detection of a trouble in one of said computers. Such overall resetting is also applicable in case of a trouble in computers employed in the supplementary devices such as a document automatic feeder or a document sorter. Furthermore said resetting can be conducted in such a manner that the program either starts from the initial state or from a determined intermediate step.

Still another object of the present invention is to provide an image forming apparatus capable of achieving a suitable control with plural computers in a control system which is designed to return the apparatus to a standard mode or to cut off the power supply when the apparatus is left untouched for a determined period after the completion of a copying cycle in any mode.

Still another object of the present invention is to provide an improvement in a copier capable of interrupting a repetitive copying operation and allowing another copying operation.

Still another object of the present invention is to provide an improvement in the control circuit for the fixing heater and in the sequence control therefor.

Still another object of the present invention is to provide an improvement in the on-off control of the power switch and in the computer control therefor.

Still another object of the present invention is to provide an improvement in the key entry and display, and in the control process therefor.

Still another object of the present invention is to provide an improvement in the control system for satisfactory positioning of moving members.

BRIEF DESCRIPTION OF THE DRAWINGS

FIGS. 2 and 5 show partial cross-sectional view of the apparatus shown in FIG. 1;

FIG. 6-1 shows a cross-sectional view showing the vicinity of the sheet cassettes;

FIG. 6-2 shows a chart showing the switch signal mode;

FIG. 20-1 shows a combination relationship between FIGS. 20-1A to 20-1D;

FIG. 20-1A to 20-1D show a flow chart for process control;

FIG. 20-2 shows a combination relationship between FIGS. 20-2A to 20-2F;

FIGS. 20-2A to 20-2F show a flow chart for process control;

FIG. 20-3 shows a combination relationship between FIGS. 20-3A to 20-3H;

FIGS. 20-3A to 20-3H show a flow chart for process control;

FIG. 20-4 shows a combination relationship between FIGS. 20-4A to 20-4D;

FIGS. 20-4A to 20-4D show a flow chart for process control;

FIG. 21-1 shows a combination relationship between FIGS. 21-1A to 21-1F;

FIGS. 21-1A to 21-1F show a flow chart for sequence control;

FIG. 21-2 shows a combination relationship between FIGS. 21-2A to 21-2D;

FIGS. 21-2A to 21-2D show a flow chart for sequence control;

FIG. 21-3 shows a combination relationship between FIGS. 21-3A to 21-3F

FIGS. 21-3A to 21-3F show a flow chart for sequence control;

FIG. 21-4 shows a combination relationship between FIGS. 21-4A to 21-4C;

FIGS. 21-4A to 21-4C show a flow chart for sequence control;

FIG. 21-5 shows a combination relationship between FIGS. 21-5A to 21-5D;

FIGS. 21-5A to 21-5D show a flow chart for sequence control;

DETAILED DESCRIPTION OF THE PREFERRED EMBODIMENTS

Figure 1:
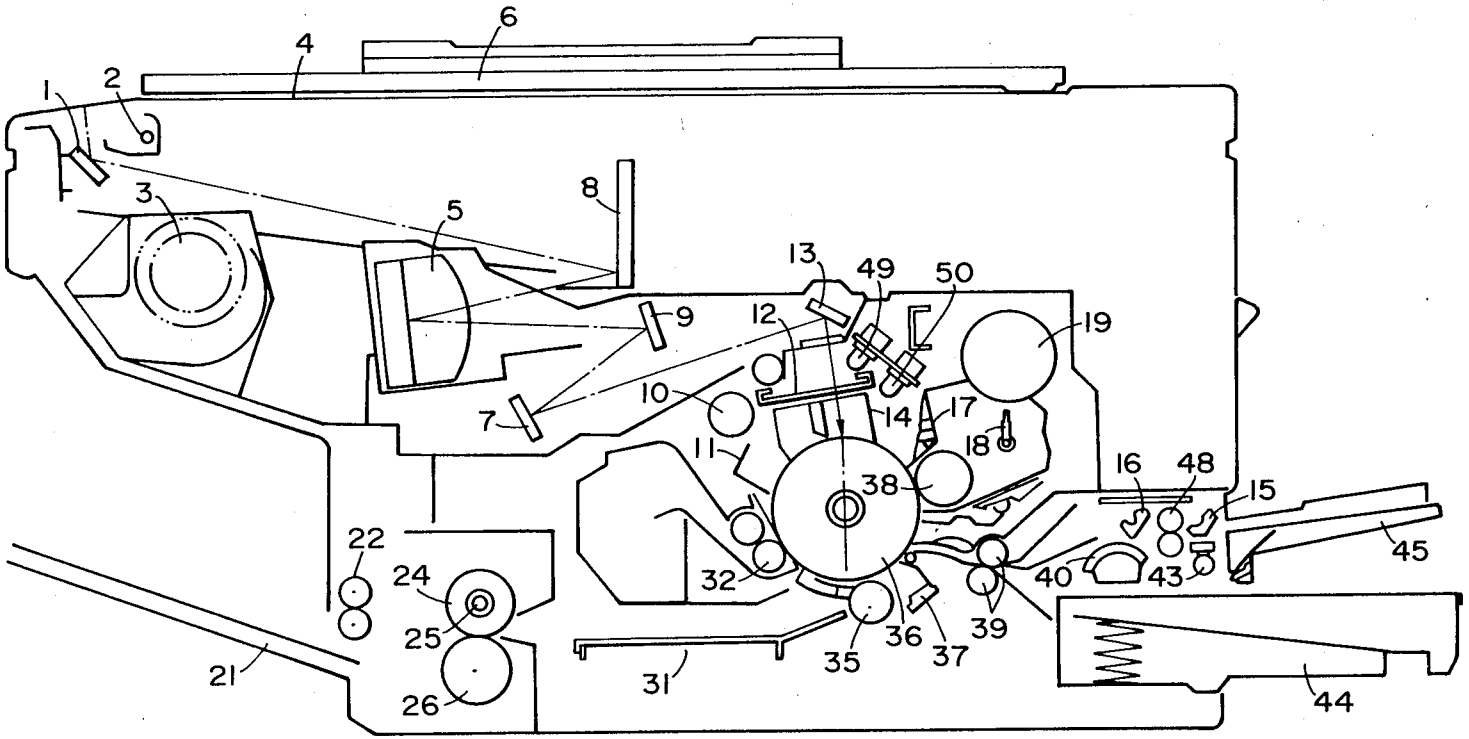
FIG. 1 shows a cross-sectional view of a copier embodying the present invention.

Now the present invention will be clarified in detail by the following description of the preferred embodiments to be taken in conjunction with the attached drawings. Referring to FIG. 1 showing a copier embodying the present invention in a cross-sectional view, there are shown a carriage 4 for supporting an original document; a rotary drum 36 having a seamless photosensitive member on the periphery thereof; a lamp 2 for exposing said drum 36 to the image of the original on said carriage 4; a corona charger 12 for positively charging said photosensitive member; an AC or negative corona charger 14 for charge elimination of the photosensitive member simultaneously with said image exposure; a developing station 38 for developing the electrostatic latent image formed on said photosensitive member; a charger 37 for transferring thus developed image onto a copy sheet; a detachable cassette 44 containing a plurality of copy sheets; a guide 45 for manually inserting a copy sheet; a feed roller 40 for feeding the copy sheet from the cassette; a feed roller 48 for feeding the copy sheet from the manual-insert guide 12; microswitches 15, 16 for detecting the manually inserted copy sheet; a registering roller 39 for registering the front end of the copy sheet with the front end of the image on the drum; a roller 35 for separating the copy sheet from the drum; a guide plate 31 for transporting the copy sheet; a pressure or heating roller 24 for image fixing; rollers 22 for ejecting the copy sheet to a tray 21; a cleaning blade 32 for eliminating the toner remaining on the drum; a magnet roller 33 for collecting the toner eliminated by the blade 32; a container 30 for maintaining the toner recovered by the roller 33; a negative corona charger 11 for eliminating the charge remaining on the drum; a lamp 10 for reducing the resistance of the photosensitive member of the drum to facilitate the function of the positive charger 12 and to eliminate the unevenness in the density; mirrors 1, 7, 8, 9 and 13 for guiding the light from the lamp 2 to the drum; a lens unit 5 for focusing the light from the mirror 8 toward the mirror 9; a lamp 50 for neutralizing the positive charge on the aluminum substrate to form the electrostatic latent image; and a lamp 49 to be lighted when the lamp 2 is not lighted to eliminate the surface charge on the drum and to prevent unnecessary toner deposition on the drum. It is also possible to light said lamp 49 continuously and to use a suitable shutter in combination with lamp 49.

The function of the above-explained copier is as follows. A copy enable signal is generated when the fixing roller 24 reaches the fixing temperature by an internal heat after the turning on of the main switch. Upon actuation of a copy switch, the drum 36 is put into rotation, and, after a pre-rotation of approximately one turn, the optical system consisting of the lamp 2 and mirrors 1 and 8 is put into forward displacement to scan an original document placed on the carriage 4. Said scanning displacement can be initiated at a determined position of the drum to be detected by a position detector. The light reflected from the original is focused on the drum through the mirrors 1 and 8, lens unit 5 and mirrors 7, 9 and 13. During said scanning displacement the mirrors 1 and 8 are displaced with a distance ratio of 2:1. The photosensitive member on the drum 36 is composed, from the surface thereof, of an insulating layer, a photoconductive layer and a conductive layer. After charging with the charger 12, the positive charge on the surface is eliminated in the exposure station by the negative charger 14 and the light image, and the drum surface is thereafter exposed uniformly to the light from the lamp 50 to form an electrostatic latent image of an elevated contrast on said drum. The latent image thus obtained is subjected to toner deposition in the developing station to provide a visible image, which is transferred in the transfer station onto the copy sheet by the positive potential provided by the transfer charger 37. Said copy sheet is supplied by the timed function of the feed roller 40 from the cassette 44, and passes through said transfer station at a speed same as the peripheral speed of the drum by the registering roller 39. After image transfer, the copy sheet is separated from the drum by means of the roller 35, then advanced by a belt 31 to the fixing roller 24 for image fixation and is finally ejected to the tray 21 by the rollers 22. The drum surface after image transfer is subsequently cleaned by the blade 32, then subjected to charge elimination by the charger 11 and hysteresis elimination by the light from the lamp 10.

In case of a continuous copying operation from the same original, the oprical system repeats reciprocating cycles the number of times selected by numeral keys provided in the control panel of the copier.

Figure 2:
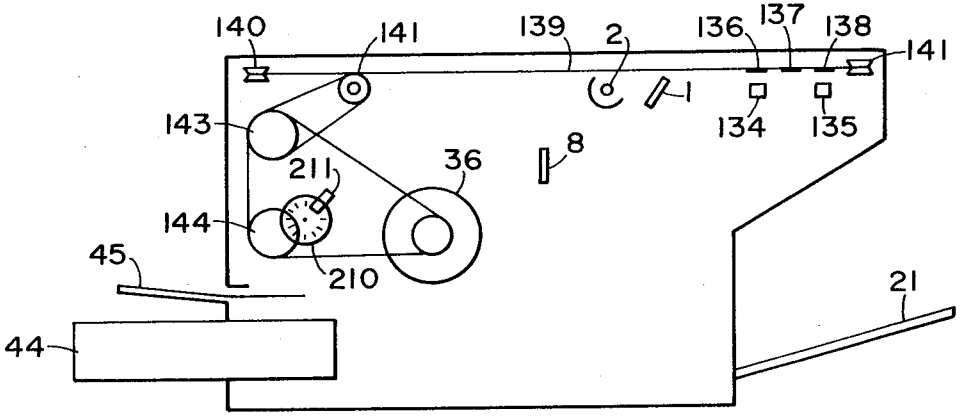

FIG. 2 shows the vicinity of the optical system wherein shown are a wire 139 for controlling the displacement of the optical system; pulleys 140–142; a clutch 143 for selecting forward or backward displacement of the optical system; a main motor 144; and photointerrupters or photosensors 134, 135 (PS1, PS2) for detecting the positions of the lamp and mirror of the optical system and adapted to generate signals when shielded by shielding plates 136 to 138 (1-A to 1-C). The photosensor 135 functions in combination with the shielding plate 138 to detect if the optical system is in a home position for starting the exposure of the original at the first copying operation after the start of power supply. If the signal from said photosensor is not obtained at the first copying operation, the shielding plate 138 is returned to the position of said photosensor 135. The photosensor 134 functions in combination with the shielding plates 136, 137 and 138 to start the feed roller 40 for paper feeding upon detection of the shielding plate 137 and the registering roller 39 upon detection of the shielding plate 138 during the forward displacement of the optical system, or to identify, upon detection of the shielding plate 136 during the backward displacement of the optical system, the home position of the optical system, thereby switching the same from the backward motion to the forward motion, thus initiating the second scanning as will be explained later.

Also in order to attain synchronization in the copying operation, there are provided a clock plate 210 rotated in synchronization with the main motor 144 and a photointerrupter 211 (Q31) adapted for detecting the rotation of said clock plate and releasing corresponding drum clock pulses CLK. Said clock pulses CLK, as well as the signals from the photosensors PS1, PS2 are supplied to a microcomputer for process control of the copying operation. The copying cycles of a preselected number are completed in this manner. Upon detection of the shielding plate 136 by the photosensor 134 in the final copying cycle, the reversing clutch is switched off to stop the optical system at the home position. A shockfree stopping at the home position can be achieved by constituting the photosensor in such a manner that the optical system stops by inertia at a position where the shielding plate 138 corresponds to the photosensor 135. The lamp 2 is lighted during the forward displacement of the optical system but is turned off otherwise. The primary charger 12, pre-charger 11 and transfer charger 37 are turned off at a determined time after the optical system is put into the backward motion in the final copying cycle, and the secondary charger 14 and flush exposure lamp 50 are turned on and off in synchronization with the rotation of the drum.

In the manual insertion copy mode, the copy sheet inserted from the slide 45 is detected by the detector 15, whereupon the feed roller 48 is started to feed the copy sheet into the copier. However the roller 48 is only started after approximately 2 seconds after the detection by the detector 15, in order to allow correction of sheet position or sheet exchange. After the lapse of said time the roller 48 is started, and the drum is also put into rotation for effecting the same process control as in the case where the operation is initiated by the copy start key. Upon sheet detection by the detector 15, the sheet feeding from the cassette is prohibited. In this manner sheet insertion initiates the copying operation without touching the copy start key in the control panel, with exact sheet feeding into the copier and toner deposition on the determined position of the sheet.

The switch 16, upon detection of the rear end of the copy sheet, turns off the roller 14 to prepare for the next sheet insertion.

Also there may be provided plural detectors 15 arranged perpendicularly to the advancing direction of the sheet, in order to detect diagonally positioned sheet. In such case the roller 48 is started only after the sheet is detected by both detectors.

Figure 3:
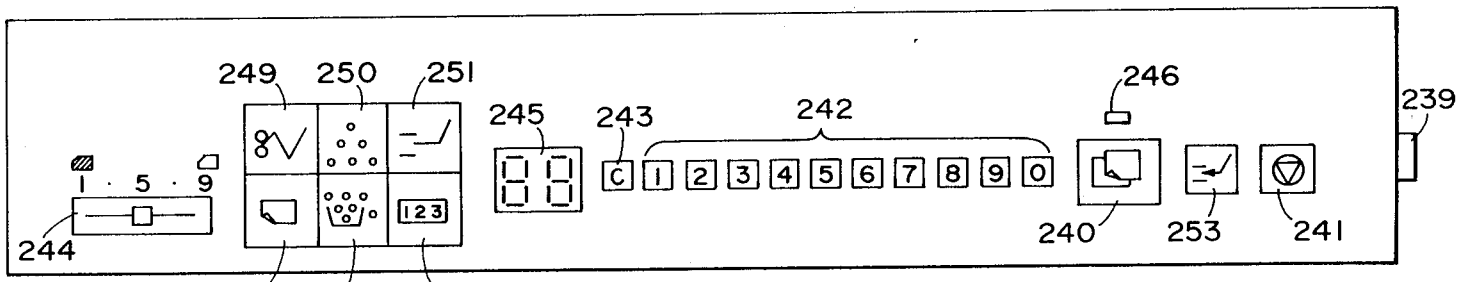
FIG. 3 shows a plan view of a control panel of the apparatus shown in FIG. 1.

FIG. 3 shows the control panel of the copier shown in FIG. 1, provided with a main power switch 239; a copy start key 240; a stop key 241 for interrupting a repeated copying operation; numeral keys 242 for setting the number of copies in a memory; a clear key 243 for clearing said memory; a copy density adjust lever 244; a 7-segment display unit 245 for displaying the number stored in the memory; a waiting lamp 246 to be lighted until the fixing roller reaches the fixing temperature; a lamp 247 for indicating the selected cassette and the absence of copy sheet in said cassette; a lamp 248 to be lighted when the container 30 is full of the recovered toner; and a lamp 249 for indicating sheet jamming. The clear key and numeral keys are disabled during the sheet jamming but are enabled during the waiting period. There are also provided a lamp 250 lighted when the toner is to be replenished; a lamp 251 lighted in response to the actuation of the interruption key 253; and a lamp 252 to be lighted when an optional key counter is not inserted.

The segment display unit 245 display a number "1" when the power switch 239 is turned on and throughout the waiting period. During the copying operation it displays a number which is progressively reduced at the completion of each copying cycle, and again displays the set copy number when a copying operation is completed. The display returns to "1" if the copying operation is not restarted thereafter for 30 seconds. In this manner a single copy can be obtained without touching the numeral key, and a copying operation of a determined number of copies can be easily repeated.

The wait indicator lamp 246 is lighted by turning the power switch 239 on, either intermittently to indicate the waiting period in which the fixing roller is below the fixing temperature, or continuously after the lapse of said waiting period or immediately if the power switch 239 is turned on soon after it was turned off so that the fixing roller is still above the fixing temperature. Said lamp is extinguished to indicate power cut-off when the power switch is turned off. When the copy start key is actuated after said waiting period, said lamp performs intermittent lighting with a longer cycle until the copier enters the post-rotation cycle of the drum. In this manner an indicator lamp can indicate a power-on state, a waiting state during which copying operation is disabled, a copy enabled state and a copying operation in progress, thus economizing the number of indicators.

The overflow indicator lamp 248 indicates the overflowing state of the container 7. Also the toner indicator 250 is continuously lighted when the toner in the container 33 is identified deficient.

In case the toner deficiency in the hopper 18 or the overflow of the recovering container 7 is detected during a continuous copying operation of a set copy number, the copier allows the continuation of said copying operation until the completion thereof but forbids the subsequent copying operation. In this manner a warning display is given immediately but a continuous copying operation is not interrupted immediately in order to avoid a substantial loss in the copying efficiency, since the toner deficiency or toner overflow does not result in an immediate deterioration of the image nor in smearing in the copier. On the other hand, in case of sheet jamming, the apparatus is immediately stopped to ensure safety. Also in case the stop key is actuated or a signal indicating the absence of copy sheet or cassette is given the apparatus continues the copying cycle in progress until the end thereof and forbids the start of a succeeding cycle.

Figure 4:
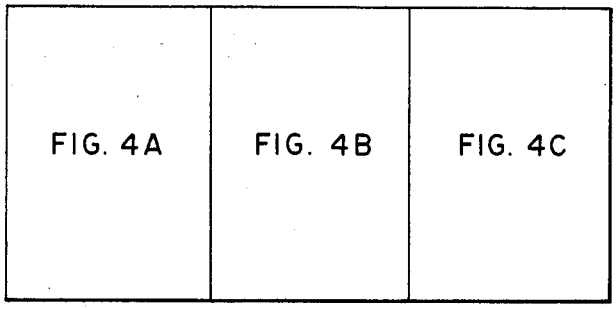
FIG. 4 shows a combination relationship between FIGS. 4A, 4B and 4C.

FIG. 4 is a timing chart indicating the functions of the copier shown in FIG. 1. In the following explained is the sequence and timing of various functions, principally in the scanning by said timing chart.

During the drum rotation, the synchronization in rotation is achieved by counting the pulses from a rotary encoder provided in the drum drive system for generating n pulses per turn.

Before the copy start key 240 is actuated, the optical system is in the aforementioned home position. Upon actuation of said key, power is supplied to the pre-charger 11, pre-exposure lamp 10, primary charger 12, secondary charger 14, flush exposure lamp 50, blank exposure lamp 49 and transfer charger 37 to apply the preliminary corona discharge, primary corona discharge, secondary corona discharge, transfer corona discharge, preliminary light exposure, blank exposure and flush exposure, thus preparing for the copying cycle.

After the counting of a determined number of the aforementioned pulses corresponding to approximately one turn of the drum, the illuminating lamp 2 is turned on and the optical system is put into the forward displacement for image exposure, which is then switched to the backward displacement according to the size of the copy sheet. Said switching is effected upon counting of a determined number of the aforementioned pulses, and the number stored in a copy count register is reduced by one at said switching. In case of a single copying operation, the register reaches "0" in this state to prohibit the succeeding copying cycle. During the above-mentioned forward displacement, the feed roller 40 and the registering roller 17 are activated for sheet feeding respectively when the shielding plates 137 and 138 shown in FIG. 2 arrive at the position of the photosensor 134. Also during the backward displacement, upon arrival of the shielding plate 136 at the photosensor 134, the reversing clutch is turned off to terminate said displacement of the optical system. The drum still continues rotation to clean the photosensitive member electrically and mechanically by means of the flush exposure lamp 50 and preexposure lamp 10, and is stopped after approximately one turn, simultaneously with the turning off of process loads as shown in FIG. 4. The power supply is still maintained after the drum is stopped.

The timing for switchover from the forward displacement to the backward displacement of the optical system is determined according to the sheet size in the cassette 44. FIG. 5 shows a longitudinal cross-sectional view of the cassette and the manual insertion mechanism, while FIG. 6 shows a transversal elevation view. 15-1 is a photointerrupter constituting the detector 15 for the manually inserted sheet, and 15-2 is a member to be moved by said sheet. There are provided micro-switches 52, 51 to be actuated by cams provided on the cassette when it is mounted on the copier to indicate the absence of cassette when said micro-switches 52, 51 are both off, a cassette containing half-sized (A4 or B5 size) sheets when said microswitches 52, 51 are respectively on and off, a cassette containing B4-sized sheets when said microswitches are respectively off and on, or a cassette containing full-sized (A3) sheets when the microswitches are both on. The three different size signals thus obtained are utilized for determining the scanning stroke of the optical system.

With respect to the manually inserted sheet, the aforementioned detector 16 identifies the half-sized sheet or the full-sized sheet, the B4 size being included in the full-sized sheet in this case.

In this manner, in case of continuous copying operation with successive sheet feeding from the cassette, the copying time is minimized by reducing the scanning stroke corresponding to the sheet size. On the other hand in the manually inserted copying operation, an identification of two sizes is sufficient since continuous sheet feeding is seldom in the manual insertion mode, and is thus employed to simplify the control circuit and to reduce the errors in the size identification.

As shown in FIG. 6, the actuator of the sheet detector 15 is positioned at the left-hand end, corresponding to a belt positioned outside the image area on the drum for separating the copy sheet from said drum. In this manner said actuator can identify if the sheet is inserted in a proper position allowing separation by said belt from the drum.

The sheet detector 16 is similarly positioned at the left-hand side and has the following three functions. The first function is to identify the size of the manually inserted sheet. The sheet is judged as full size or half size respectively if a sheet is detected at a determined time. The second function is to regulate the path length from the front end of the manually inserted sheet to the registering roller to a value equal to the path length for a sheet supplied from the cassette. At a determined time after the sheet detection by the detector 16, the feed roller 48 is turned off to interrupt the sheet feeding toward the registering roller. Thereafter, in response to a signal from the aforementioned photointerrupter 134, the roller 48 is again put into rotation to re-start the sheet feeding toward the registering roller. The third function is turn off the roller 48 upon detection of the rear end of the sheet.

The above-mentioned preliminary sheet advancement by the roller 48 which is energized upon sheet detection by the detector 15 and stopped upon sheet detection by the detector 16 is conducted in order to form an appropriate amount of sheet loop in front of a registering roller that has stopped, thus avoiding the sheet folding or jamming.

A similar procedure is followed also in the sheet feeding from the cassette. In response to the actuation of the copy start key, the feed roller 40 is activated for a short period to pull out a sheet from the cassette. The sheet thus pulled out is advanced to the registering roller upon interaction of the shielding plate 137 with the photosensor 134. The crescent-sectioned roller 40 is rotated by a half turn from the illustrated state in the preliminary advancement and is further rotated by another half turn in the sheet advancement to the registering roller.

Figure 7:
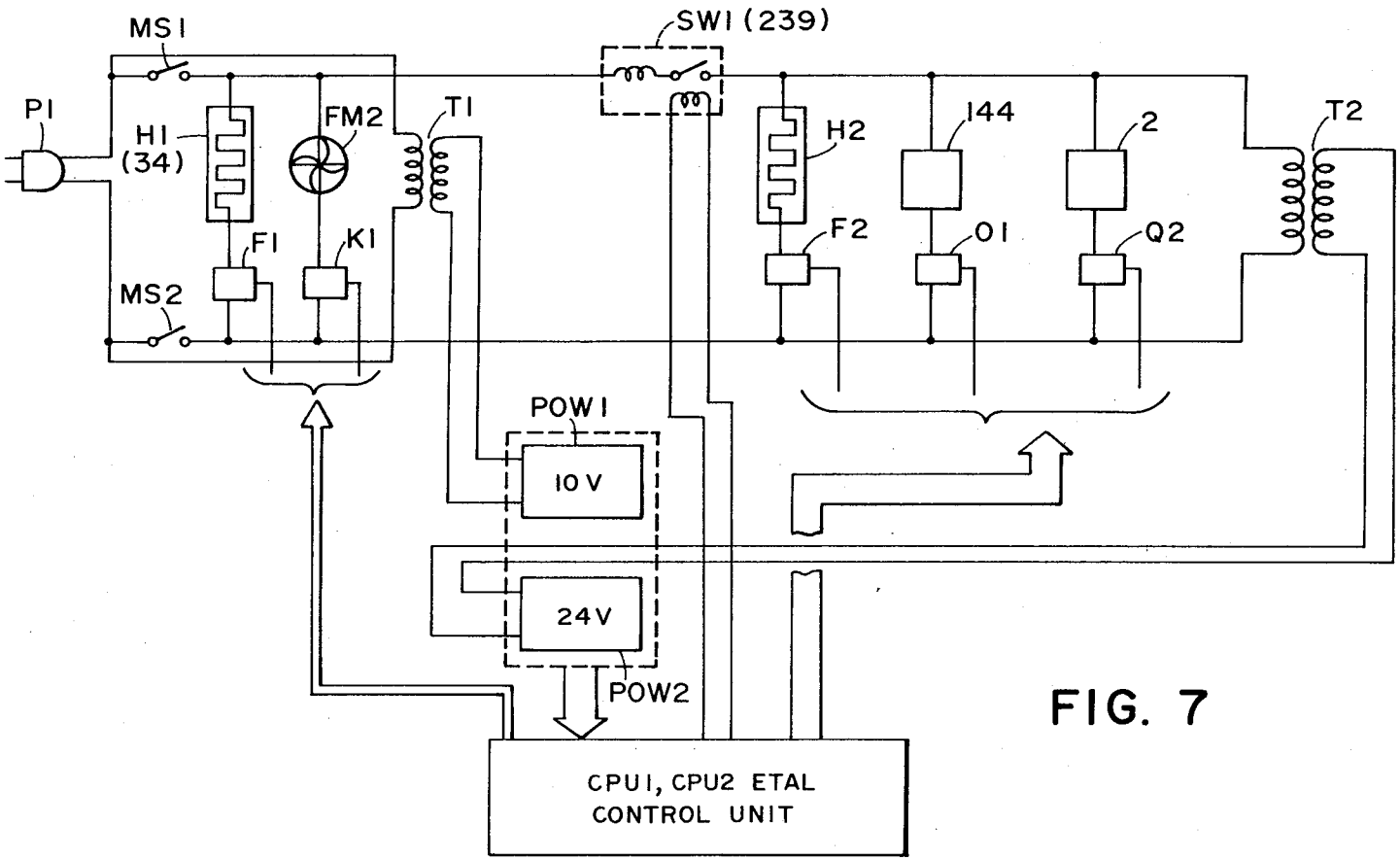
FIG. 7 shows a circuit diagram of a drive circuit for the apparatus shown in FIG. 1.
Figure 8A:
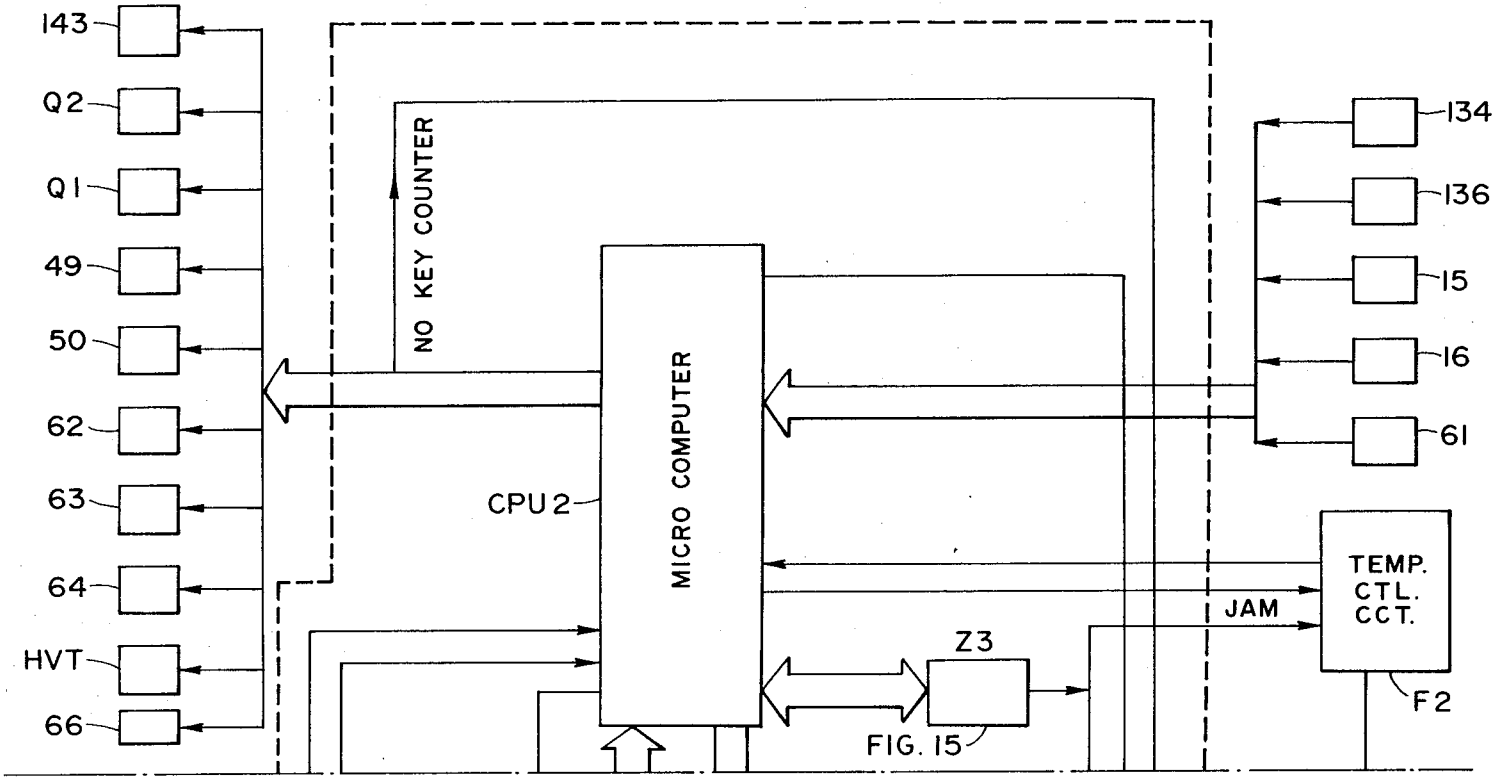
FIGS. 8A and 8B show a block diagram of a basic control circuit.
Figure 8B:
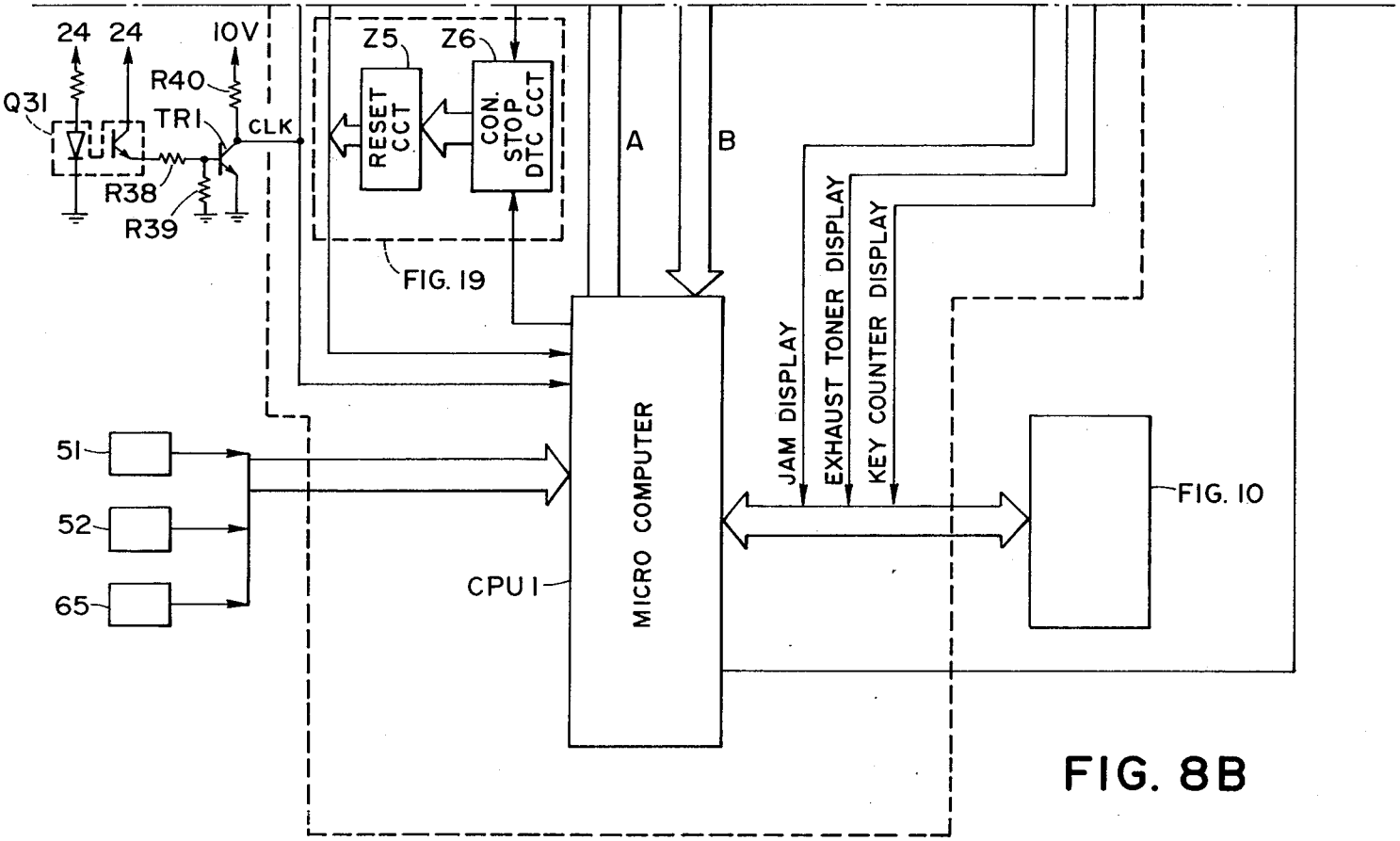
Figure 9A:
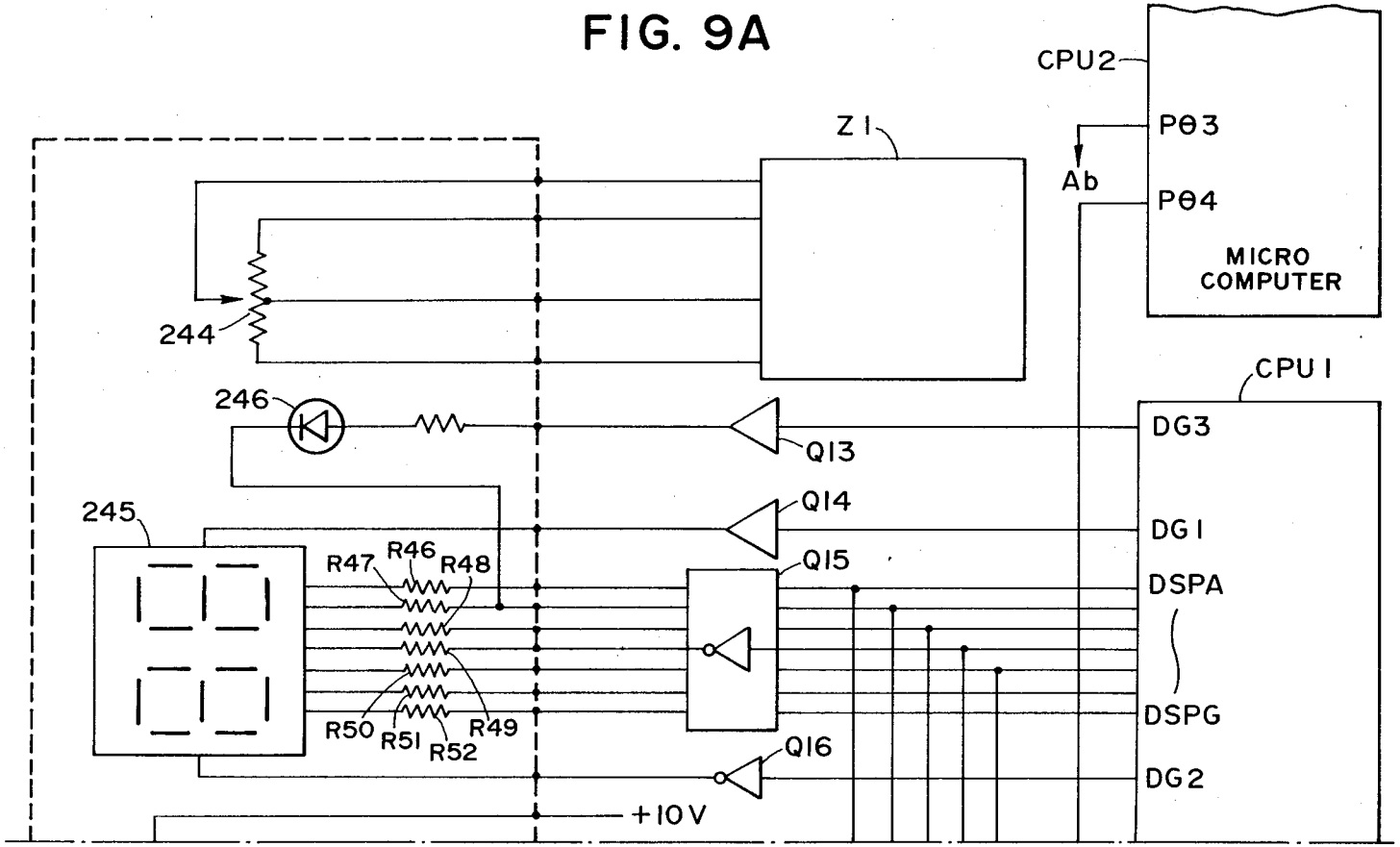
FIGS. 9A and 9B show a circuit diagram of a key and display circuit.
Figure 9B:
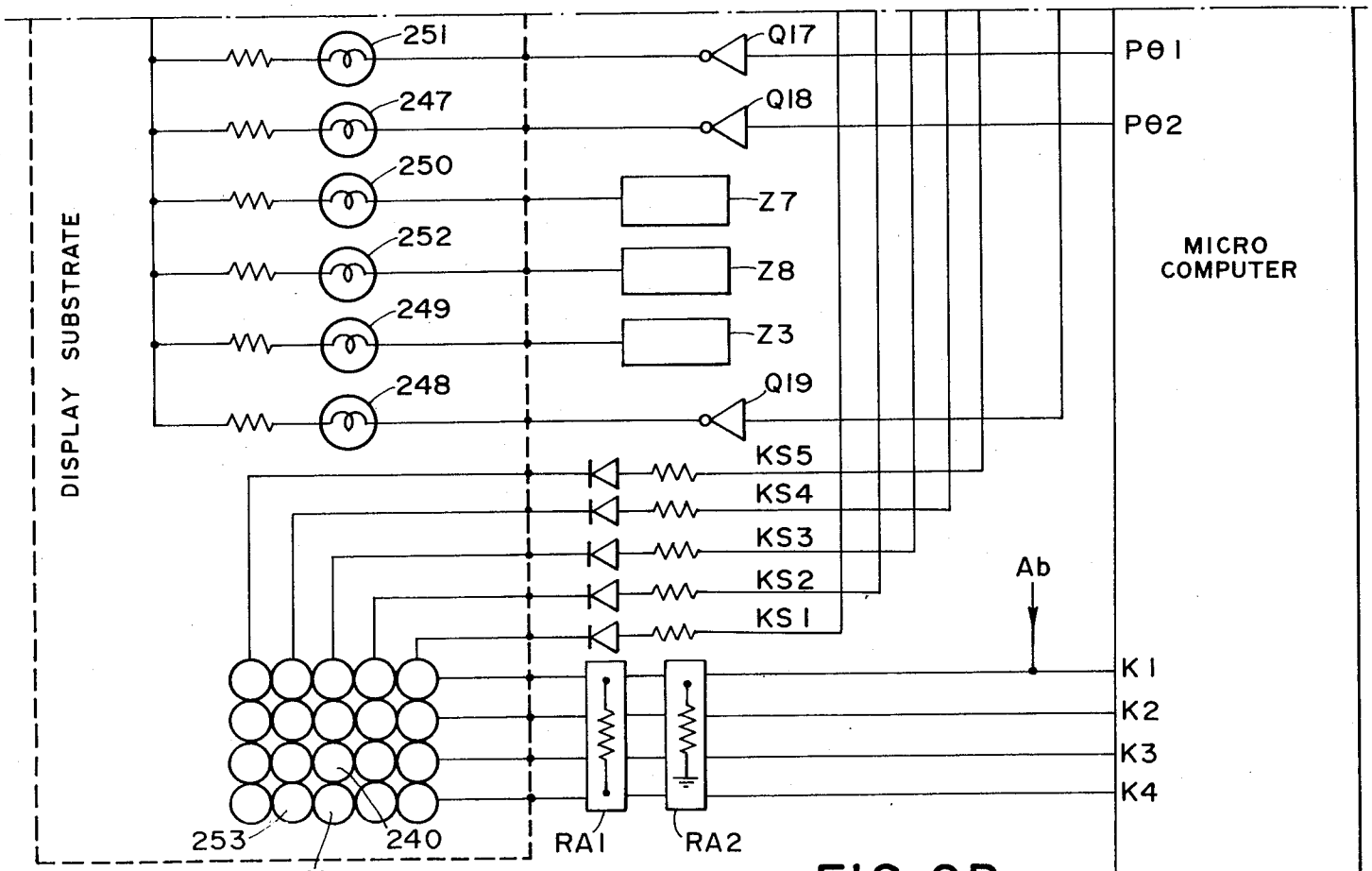

Now reference is made to FIG. 7 showing the electrical control system of the copier in a block diagram, wherein shown are a drum heater 34 for moisture prevention; a control circuit F1 therefor; a transformer T1 for power supply to microcomputers; a transformer T2 for power supply (24 V) to solenoids and clutches; power supply circuits POW1, POW2 respectively for microcomputers and for 24 V power supply; a main switch SW1; a fixing heater H2; a control circuit therefor F2; a main motor 144 and a switching element Q1 therefor; an exposure lamp 2 and a switching element Q2 therefor; and a cooling fan motor FM2 and a switching element K1 therefor, said switching elements being controlled by the instructions from a control unit.

The details of the control unit will be explained in the following.

(Control Unit)

Figure 8:
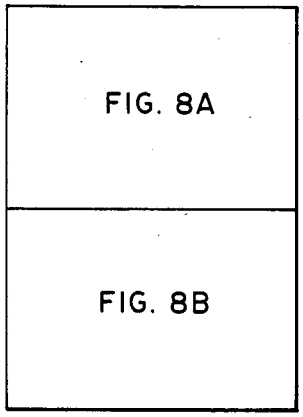
FIG. 8 shows a combination relationship between FIGS. 8A and 8B.

FIG. 8 shows the circuit structure of the control unit, in which a process control microcomputer CPU1 receives the signals from the keys of the control unit shown in FIG. 3 and from other detectors in the copier and performs the functions of identification and display, while a sequence control microcomputer CPU2 is primarily used for controlling the copying sequence. Said microcomputers CPU1, CPU2 respectively are provided with read-only memories (ROM) for storing the programs shown in the flow charts of FIG. 20-1 to 20-4 and 21-1 to 21-5, and executes said programs upon power supply.

Each of said microcomputers is composed of a one-chip semiconductor microprocessor comprising a random access memory (RAM), arithmetic logic unit (ALU), a microprocessing unit (MPU) etc. in addition to the above-mentioned read-only memory, such as the device μCOM-43, 44 or 45 supplied by NEC.

The process control microcomputer CPU1 receives, in addition to the signals from the various keys, the signals from the cassette detecting switches S1, S2 (FIG. 6-1) or from the developer detecting switch 65, the waiting signal and control signals B from the microcomputer CPU2, and supplies control signals for the display on the control panel, scan signals for key entry and control signals A to the microcomputer CPU2.

On the other hand the sequence control microcomputer CPU2 receives the signals from the aforementioned photosensors 134, 135, manual insertion sensors 15, 16, and a exit sheet sensor, a jam process signal from a jam process circuit Z3, a thermistor breakage signal from the temperature control circuit F2 and the control signals A from the CPU1 including the copy start signal also indicating the copy size mode and the manual insertion enable signal.

Said microcomputer CPU2 releases the signals to the main motor for driving the drum, clutches for causing reciprocating motion of the optical system, sheet feed solenoid and jam control circuit Z3, and the control signals B to the CPU1 for communicating the copy count, sequence control signals for key entry control and a signal for copy count correction in the sheet jamming.

Besides the microcomputers CPU1, CPU2 receive the aforementioned drum clock pulses CLK and release serial checking pulses to an external CPU checking circuit Z6, which resets said microcomputers in case of a failure in one of said microcomputers.

(Key entry and display circuit)

Figure 9:
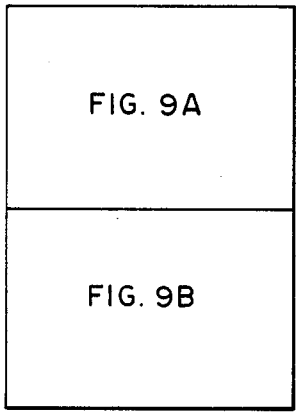
FIG. 9 shows a combination relationship between FIGS. 9A and 9B.

FIG. 9 shows the details of the relationship between the control unit and the microcomputers CPU1, CPU2, wherein the keys and display unit are represented by the common numbers or symbols with those shown in FIG. 3. Q13–Q19 are amplifiers, and RA1 and RA2 are buffer resistors. DG1–DG3 are display output ports, of which the former two are utilized for selecting the digits of the numeral display unit 245.

DSPA–DSPG are output ports for controlling said display unit 245 and keys; PO1 and PO2 are latching ports for controlling indicator lamps 247 and 250; PO3 and PO4 are latching ports for controlling the indicator lamp 248 indicating the abnormality in the apparatus or the toner overflow; Z7 and Z8 are a toner deficiency detecting circuit and a key counter or a detecting circuit; and Z3 is a jam process circuit shown in FIG. 15.

Figure 10:
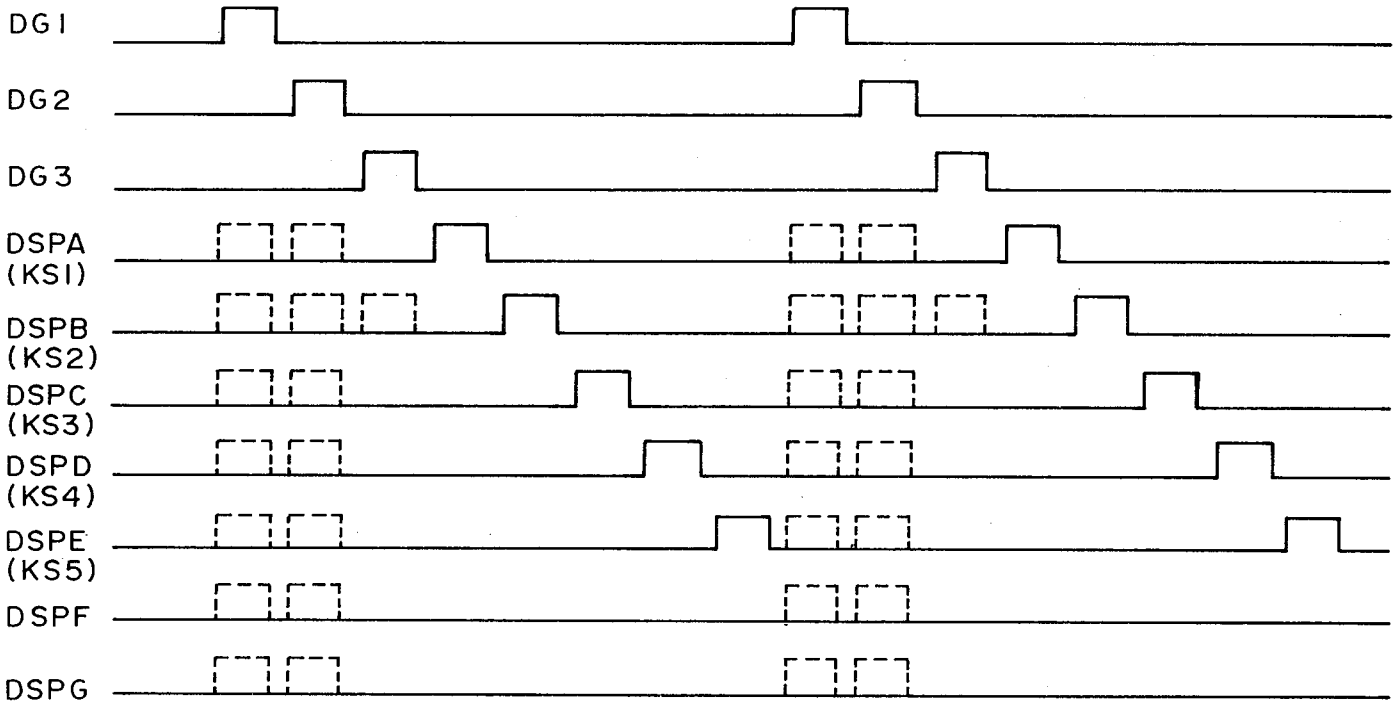
FIG. 10 shows a timing chart showing the signals in the circuit shown in FIG. 9.

The key signal is identified by scanning the keys with time-sequential pulses released through the lines KS1–KS5 as shown in FIG. 10 and sensing the obtained outputs at the input port K1–K4 in synchronization with said pulses. The keys are arranged in a gate matrix with said lines to provide the key state dynamically into the microcomputer CPU1. For example if the key "1" is actuated, the pulse KS1 provides an output signal to the port K1, which is identified as key signal "1" and stored in the register. The entry data from the numeral keys are stored in the random access memory as a copy preset number.

The numeral display unit 245 is controlled by the combination of the 7-segment selection signals DSPA–DSPG supplied from the same output ports as for the pulses KS1–KS5 and the digit signal DG1 or DG2. As an example a number "1" is displayed at the first digit by a combination of signals DSPA, DSPB and DG1. Also a number "88" is displayed by the signals shown by broken lines in FIG. 10. In this manner a dynamic display is achieved by the signals from DG1–DG3. During the absence of said digit signals DG1 DG3, the ports DSPA–DSPE release the scanning signals as shown in FIG. 10 for allowing key entry operation.

As explained in the foregoing, it is rendered possible to reduce the number of ports by utilizing the segment selecting ports also for key scanning.

Also in the present embodiment, the waiting indicator lamp 246 is lighted by the combination of the digit signal DG3 and the segment signal DSPB. Other indicators for example for jam indication can also be constructed in the same manner.

(Key entry and display control)

Now the control function of the CPU1 for key entry and display will be explained by the flow charts shown in FIG. 20.

Figures 1A, 20:
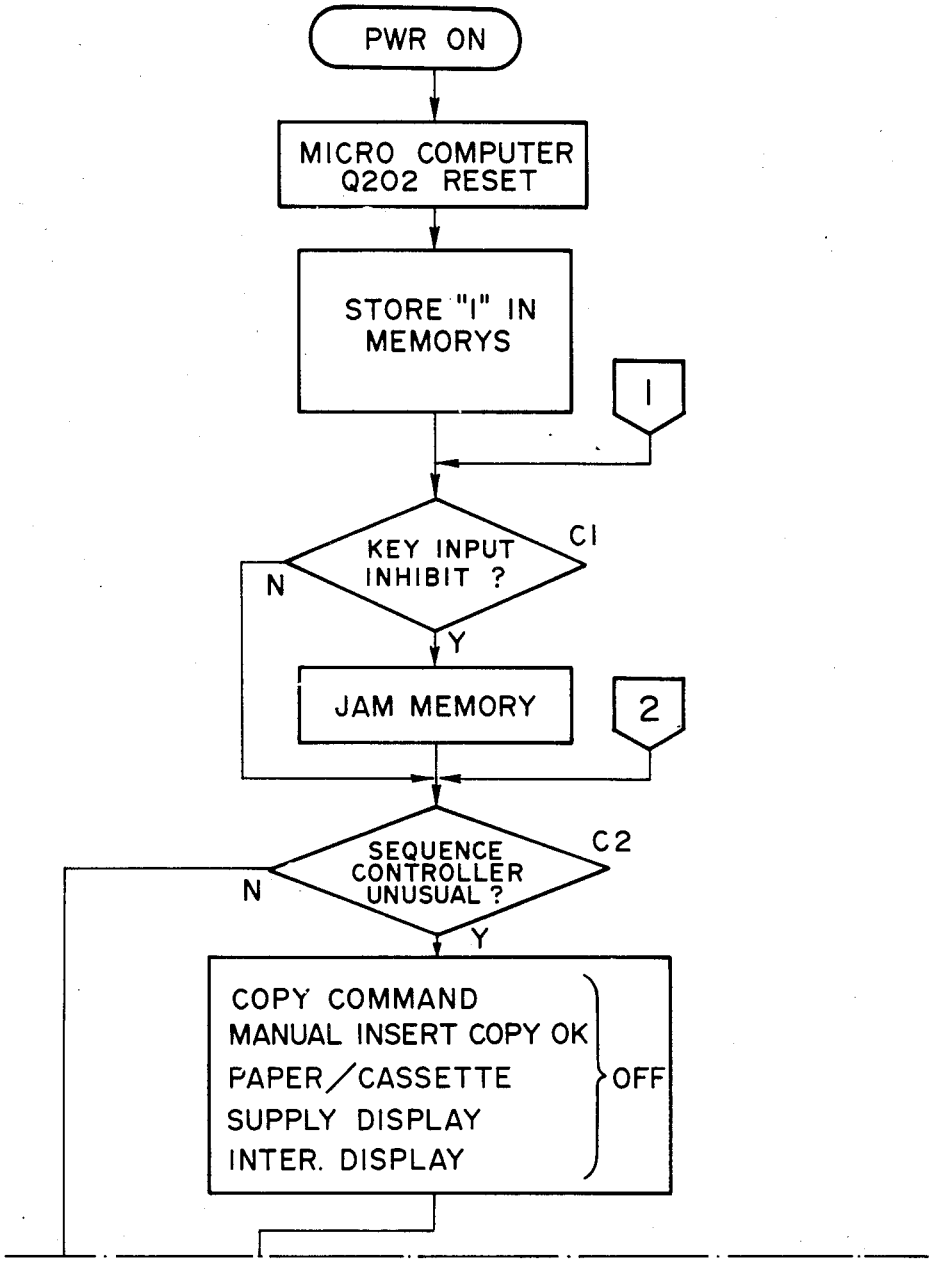

After the execution of the preparatory routines shown in FIG. 20-1, the CPU1 proceeds to the routine (4) for identifying the key actuation (C20) by releasing serial pulses from the ports DSPA–DSPE as shown in FIG. 10. In case a key is actuated, the CPU1 at first identifies if it is the interruption key 253 (C23), and, if so, sets the output port PO1 to activate the display. If it is the stop key (C24), the CPU1 identifies if the copying operation is in progress (C31), executes the display and proceeds to another routine (5). If the actuated key is identified not the copy start key (C27) nor the clear key (C27, C28), the CPU1 identifies the actuated key as a numeral key and stores the corresponding number in a determined area and a display area in the random access memory. The storage into the memory is not effected for a numeral key actuated for the third time (C29). Also in case the clear key is actuated, said areas of the memory are reset to "1". The above-mentioned key identification is effected by checking the state of the input ports K1–K4 in synchronization with the key scanning signals.

At the step C20, a display clear timer is started (L10) at the trailing end of the signal corresponding to the end of key actuation. Then, after the lapse of 60 seconds (C38) the copy count area of the RAM is reset to "1". This number is cancelled in case of the interruption copy mode.

Said resetting is prohibited (C33–C37) in case a trouble such as sheet jamming, waiting state, or the absence of sheet or toner during said 60-second period. Also said timer is reset in case any key is actuated.

In case of the sheet jamming, said key entry routine is omitted (C22) to prohibit the signal entry from the keys. Same situation applies during the copying operation or during certain other states to be explained later (C25, C26).

The numeral display unit 245 is controlled in the steps C203–C206 after the above-mentioned key entry operation. At first the number stored in the display area of the RAM is decoded (C203), and the obtained signals are supplied from the segment ports DSPA–DSPG and digit signal ports DG1, DG2 to perform dynamic display. The period of the signal DG1 is approximately 10 milliseconds. The number stored in said display area is decreased stepwise at each copy cycle, and the reduced number is displayed during the copying operation, through the steps C223–C226 shown in FIG. 20-4. The resetting of the display in response to the actuation of the interruption key during a copying operation, or the display of the initially preset number in response to the actuation of the stop key is also conducted in the similar manner.

The stepwise reduction of the number stored in the display memory in the step C207 is effected by the identification in the step C41 shown in FIG. 20-3 that the inhibition for key entry is cancelled, at the trailing end of a signal S of the control signals B from the sequence control microcomputer CPU2. As will be explained later, said signal S is supplied during the forward motion of the optical system in each copy cycle. When said number is reduced to zero (C51), the automatic clear timer is started (C208) and the number stored in the preset area is transferred to the display area(C209) to display said number in the step C209 and thereafter.

Upon actuation of the interruption key, and if an interruption copying operation is not in progress (C52, C53), the preset copy number and the displayed copy number are transferred to other areas of the RAM and the display area is reset to "1" after the inhibition for key entry is cancelled (C41). The number setting with the numeral keys for the interruption copying operation is enabled after the optical system is reversed.

Upon actuation of the stop key (C48) the corresponding display control is immediately effected. If the stop key is actuated during an interruption copying, the memory is returned to a state prior to the start of said interruption copying, whereby displayed is the number diverted by the actuation of the interruption key. On the other hand if the stop key is actuated while an interruption copying is not in progress, the clear timer is started and the preset copy number is displayed in the same manner the copying operation is completed. These steps are effected regardless of the inhibition of the key entry.

As explained above, the interruption key and the stop key function differently in the display and in the timing of display change. It is therefore rendered possible to cancel the actuation of the interruption key within a same copying cycle.

(Control for copy execution and code mode)

Figures 11, 12:
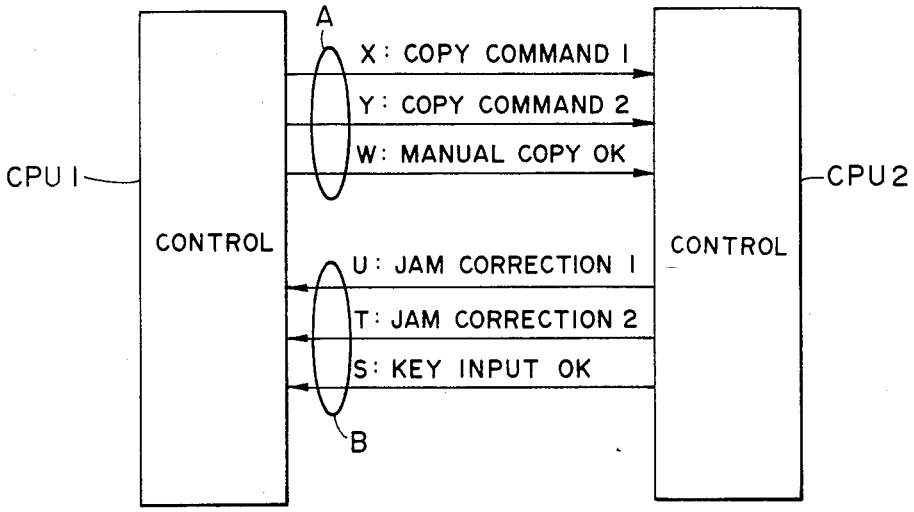
FIG. 11 shows a circuit diagram of a transfer circuit.
FIG. 12 shows a chart showing the modes of signals in the circuit shown in FIG. 11.

FIGS. 11 and 12 explain the transfer of control signals A from the CPU1 to the CPU2. The signals A are composed of 3-bit signals; a copy command signal 1(line X0, a copy command signal 2 (line Y) and a manual insertion copy enable signal (line W). Upon actuation of the copy start key 240, the CPU1 identifies if the copying operation is possible, and if so, transfers a copy start signal to the CPU2 through the lines X and Y. Said signal is: Y="1" for a full-sized (A3) copying; X="1" for a middle-sized (B4) copying; and X=Y="1" for a half-sized (A4) copying. Also said signal is reset to X=Y="0" if the copying operation is not possible or is to be interrupted. Such transfer of plural information through common lines reduces the number of ports and lines. Also in case the manual insertion copying is enabled, the CPU1 transfers a signal W="1" to the CPU2.

These control functions are executed according to the flow chart shown in FIG. 20-4. In the absence of the copy start signal (C64), the CPU1 identifies from the aforementioned input signal if the copying operation is enabled (C64–C68), and if so, releases the signal W for enabling the manual insertion copying (cf. FIG. 12). A step C63 identifies the signals from the CPU2, and, in the presence of said signals, inhibits the entry from the numeral keys and turns off the signal W, as will be explained later. Upon receipt of the signal W, the CPU2 identifies said signal W in the step C112 (FIG. 21-1) and initiates the copying cycle when the photosensor 15 is activated.

The steps C70–C72 for identifying the cassette size read the signals from the cassette detecting switches 51, 52 which transfers the signals indicating the presence of cassette and the full-, half- or middle-size of the cassette to the CPU1, according to the logic table shown in FIG. 6-2. In these steps the CPU1 sets "1" in the copy command 2 register for a full-sized cassette, "1" in the copy command 1 register for a middle sized cassette, and "1" in both registers for a half-sized cassette. Also in the absence of the cassette, the indicator lamp 247 is lighted by the step C211.

The steps C75–C79 identify if the copying operation is possible, and if not, the copy command registers are cleared (C213). If the copying operation is possible, the actuation of the stop key and the copy start key is identified (C80, C81), and the copy command signals are supplied to the lines X and Y according to the contents of the copy command registers (C212, C214).

The CPU2 identifies the signals sent through the lines X and Y (C113 and C114 in FIG. 24-1) and stores the obtained size data in the RAM for controlling the timing for reversing the optical system.

As explained in the foregoing, the number of input-/output ports of the microcomputers can be minimized by utilizing two lines X and Y for transmitting the copy stop signal, copy start signal and copy size information. In case the number of sizes increases, it is possible to add another signal line or to transmit the corresponding signals in a suitable coding. Also in case copying modes with modified image magnifications are provided by changing the lens position and the scanning speed, it is possible to transmit the signal for selecting the image magnification together with the copy start signal. A similar control is furthermore possible for selecting multiple cassettes, selecting multiple exits for copies, or selecting one-, two- or three-colored copying.

(Count correction)

Now there will be explained the control signals B from the CPU2 to the CPU1, transferred through three signal lines: a jam correction signal 1 (line U), a jam correction signal 2 (line T) both for copy counter, and a key entry control signal (line S).

The jam correction signals U, T indicate the number of copy sheets present in the copier only in case of sheet jamming, and are not present otherwise to indicate the normal state.

Figures 1, 21:
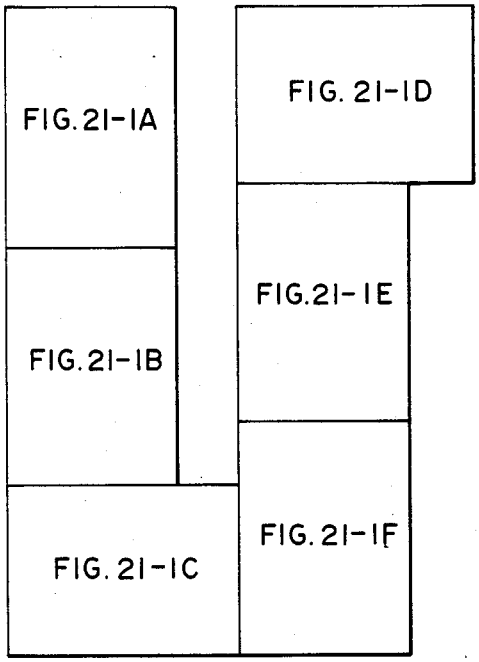
Figures 2, 21:
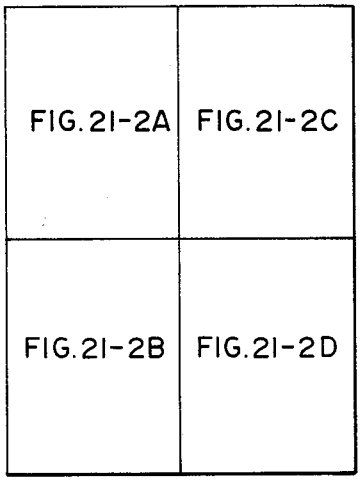
Figures 3, 21:
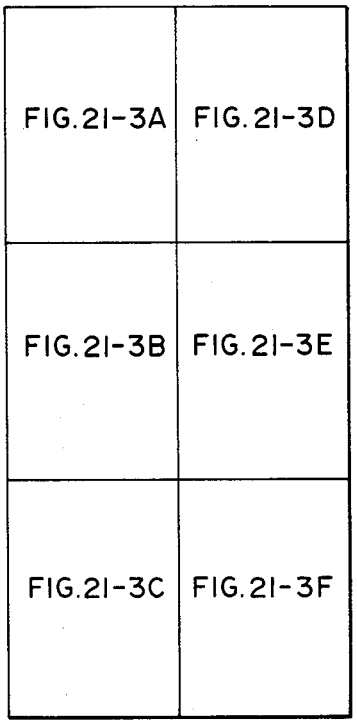
Figures 1A, 21:
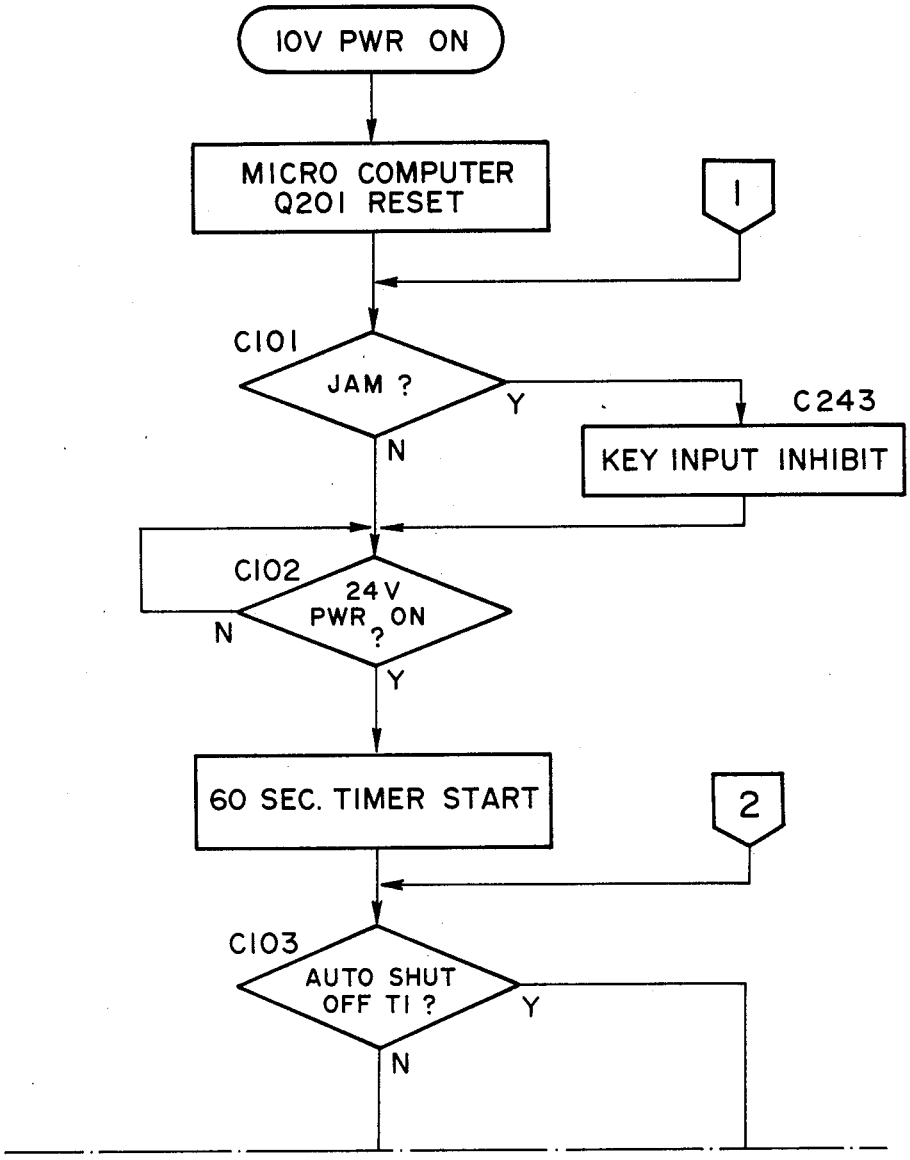
Figures 1B, 21:
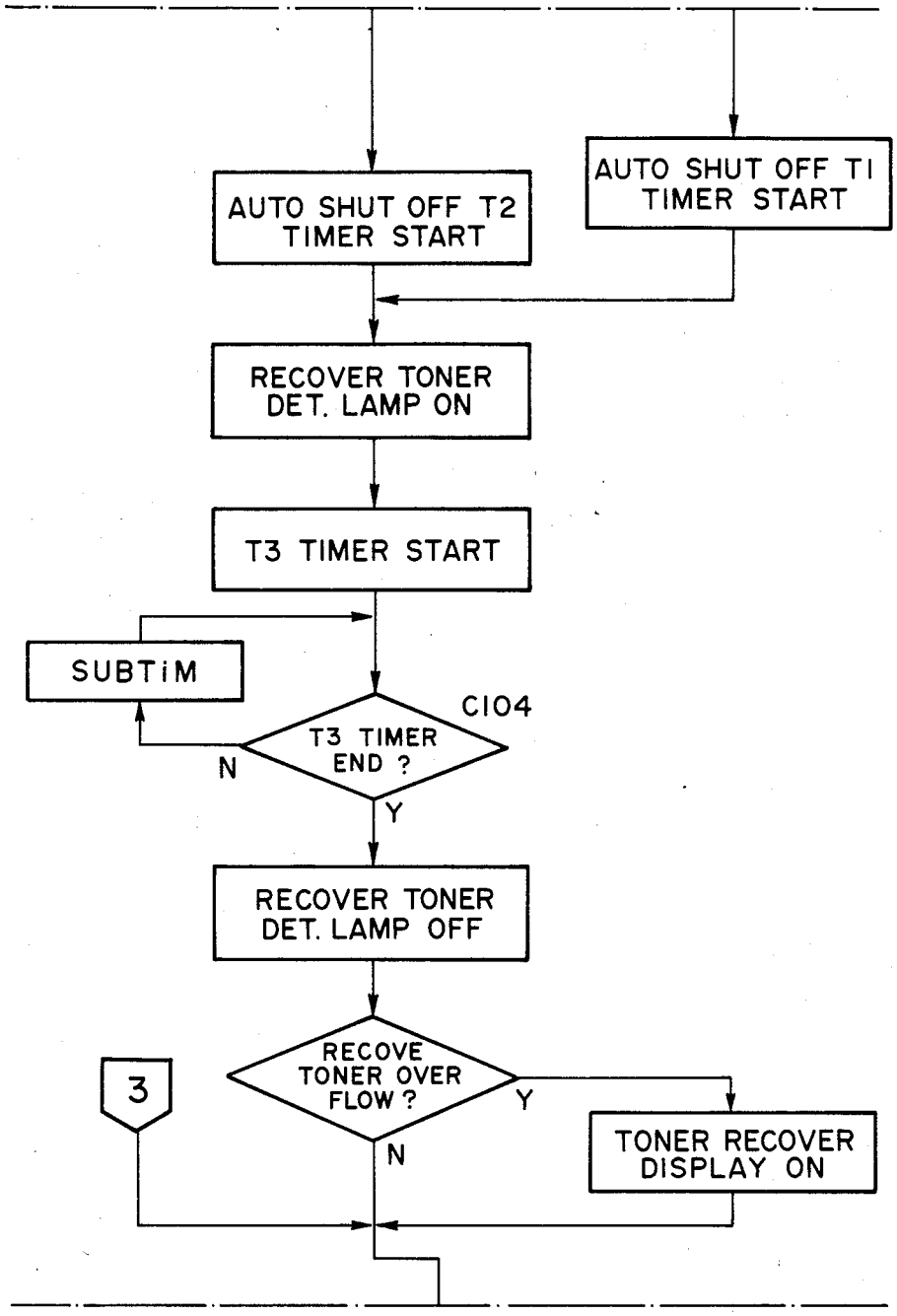
Figures 1C, 21:
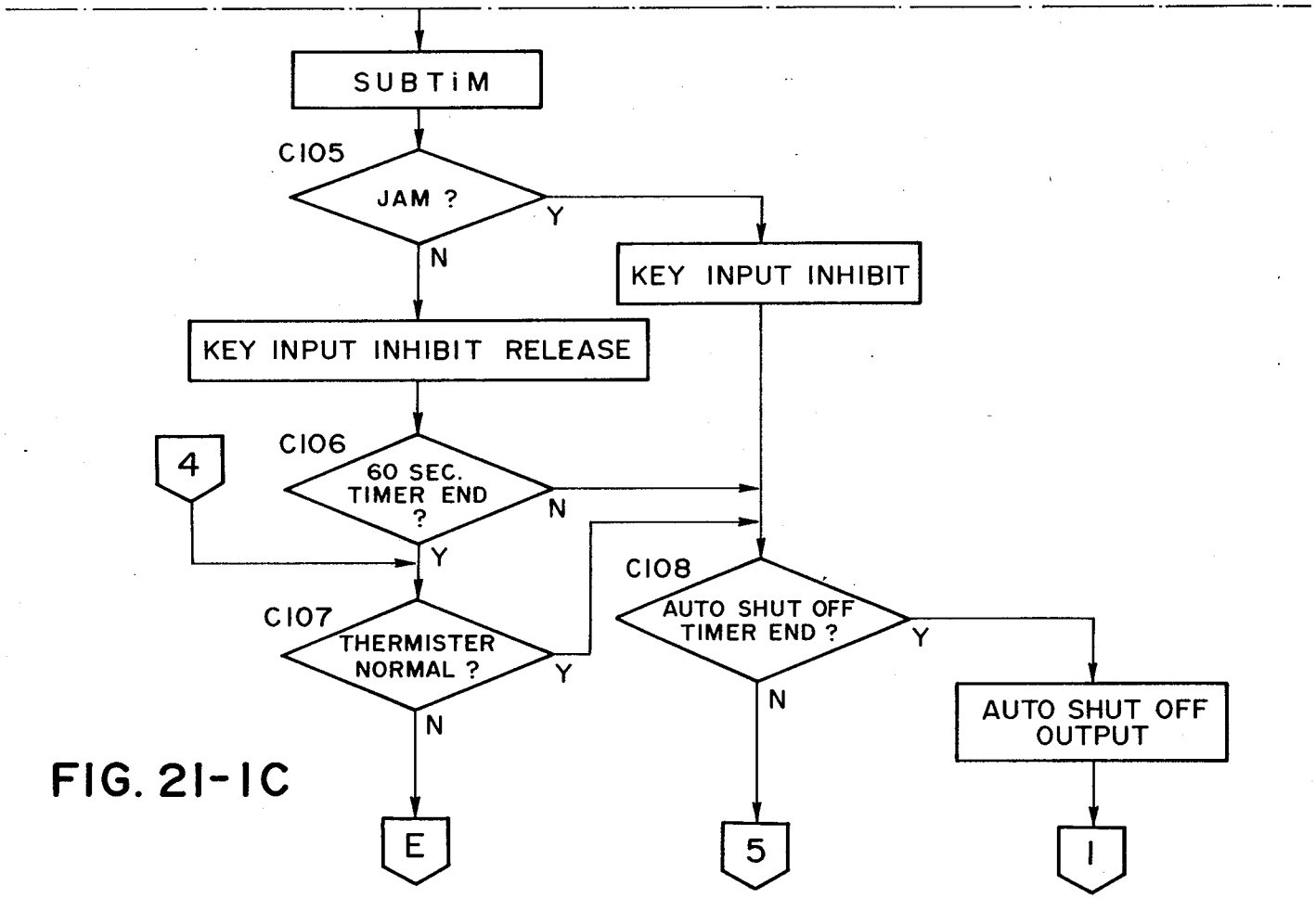
Figures 1D, 21:
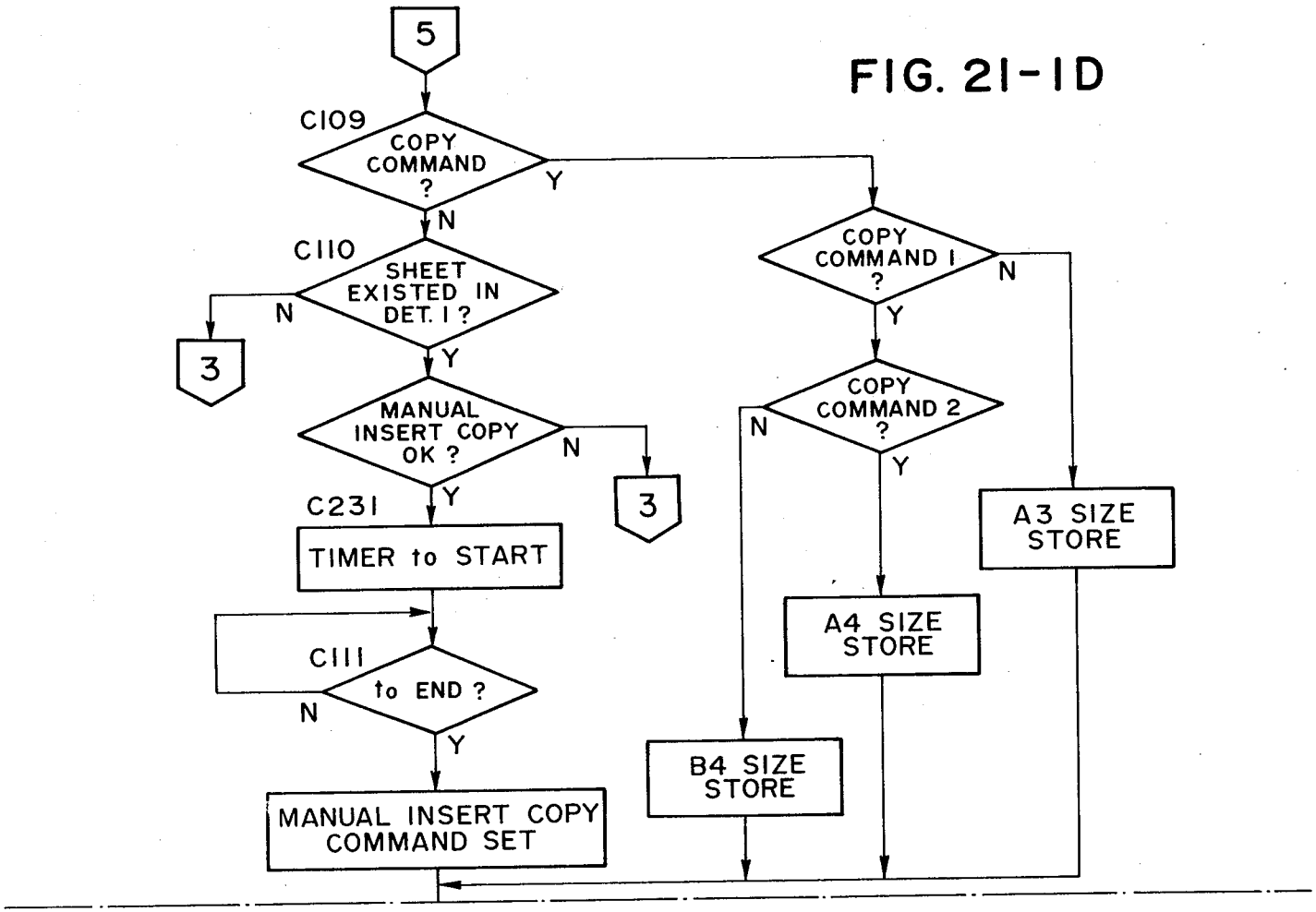
Figures 1E, 21:
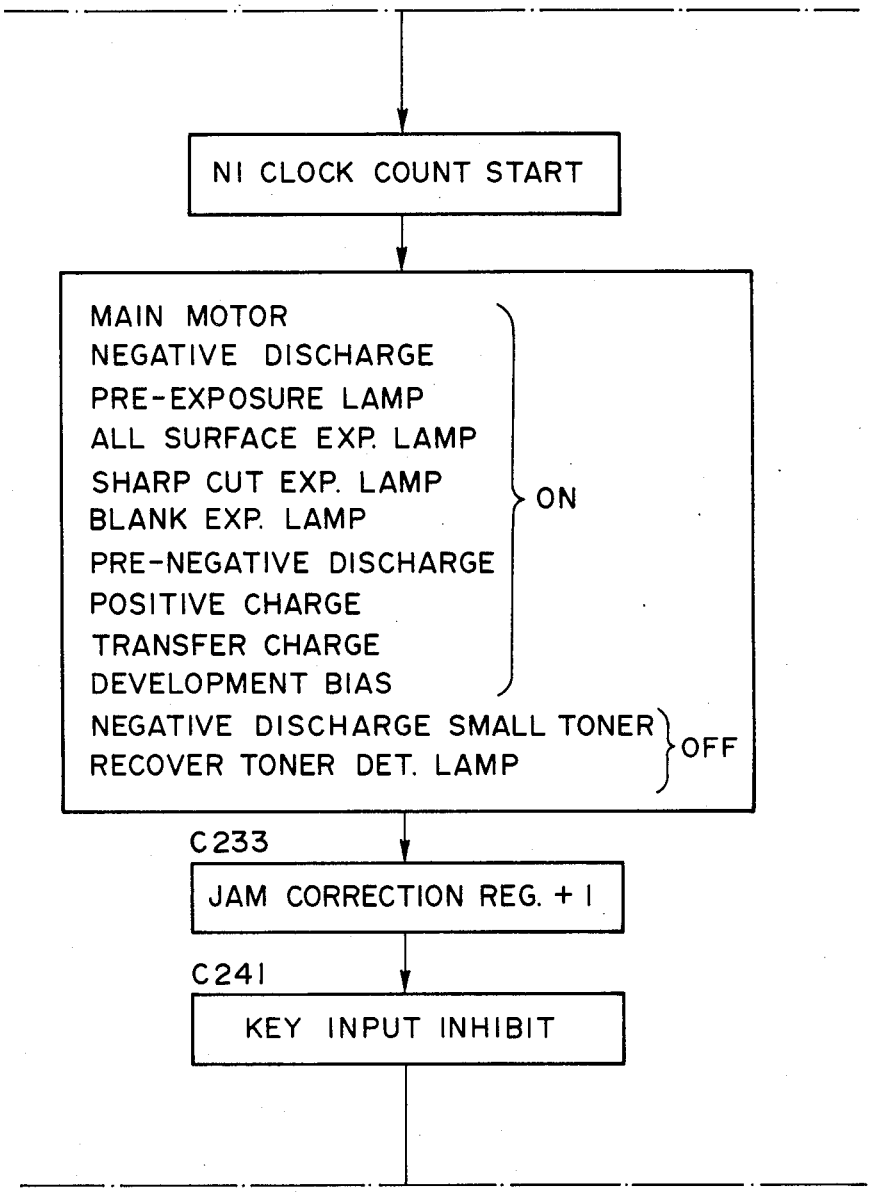
Figures 1F, 21:
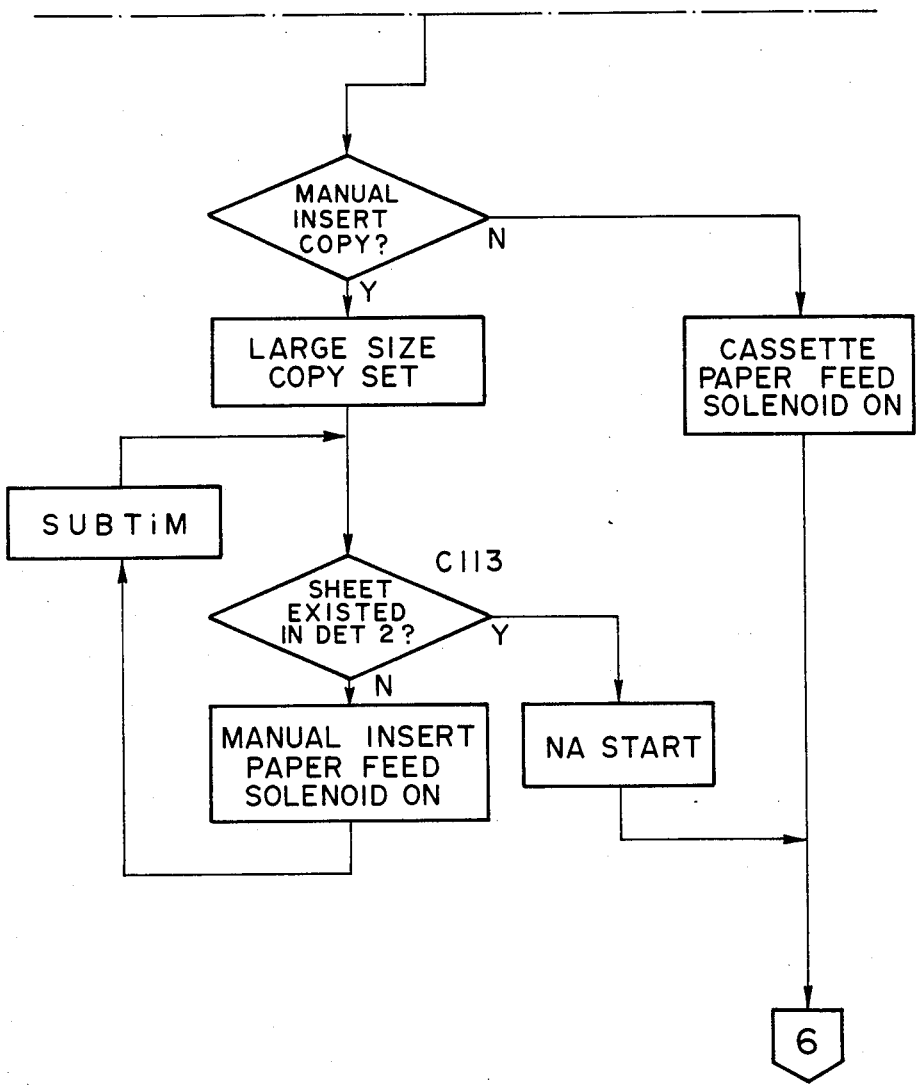
Figures 2A, 21:
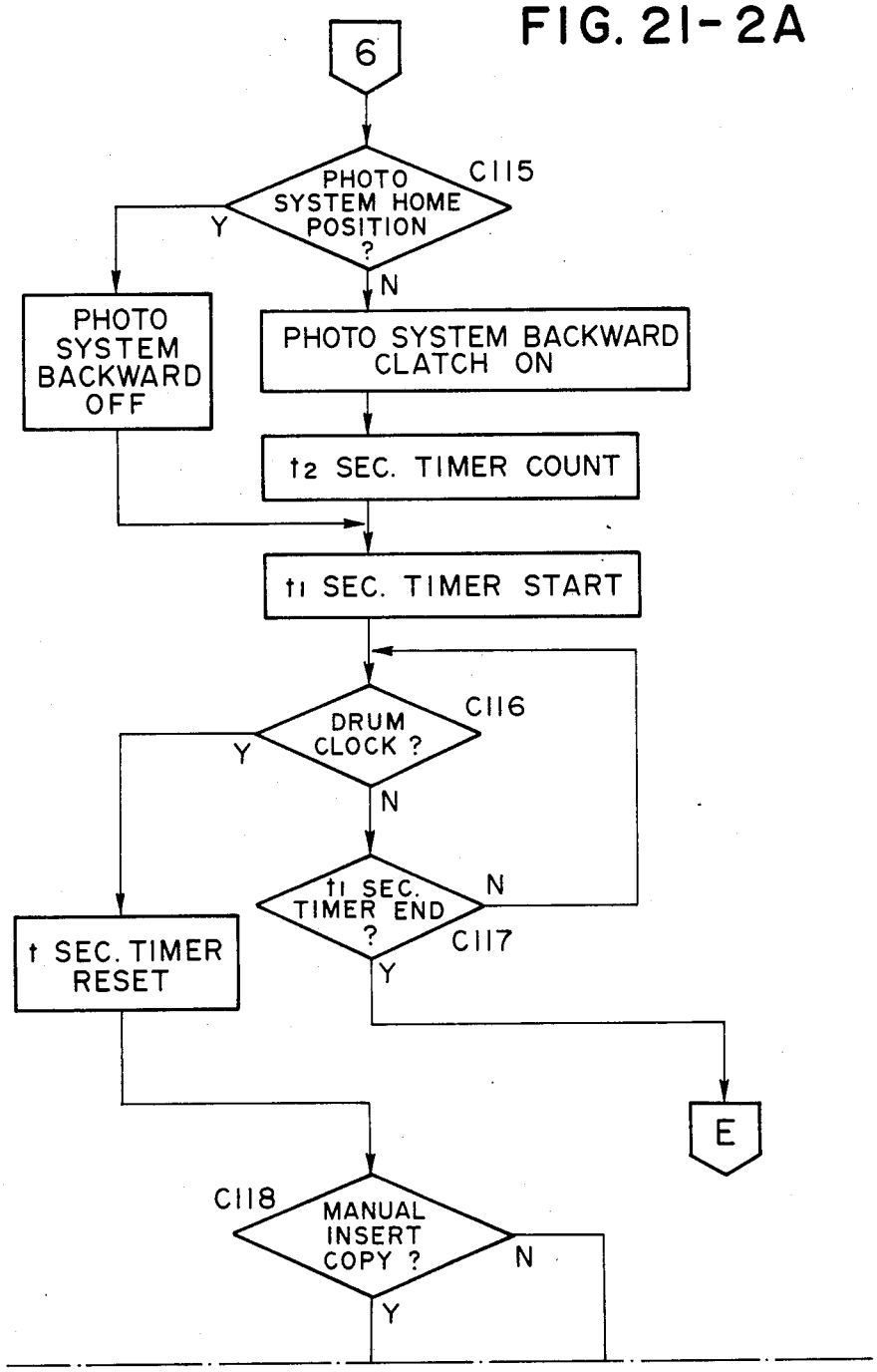
Figures 2B, 21:
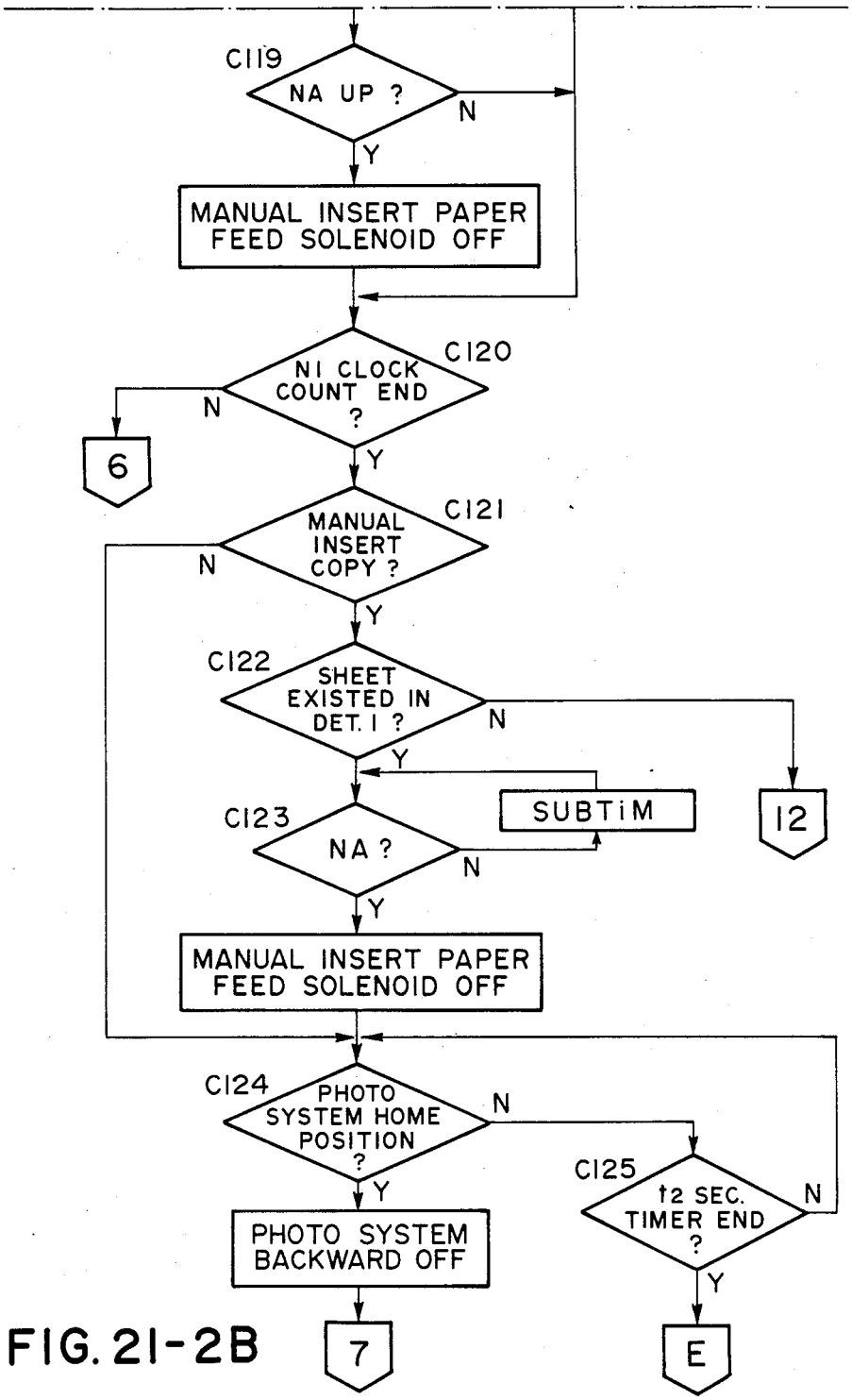
Figures 2C, 21:
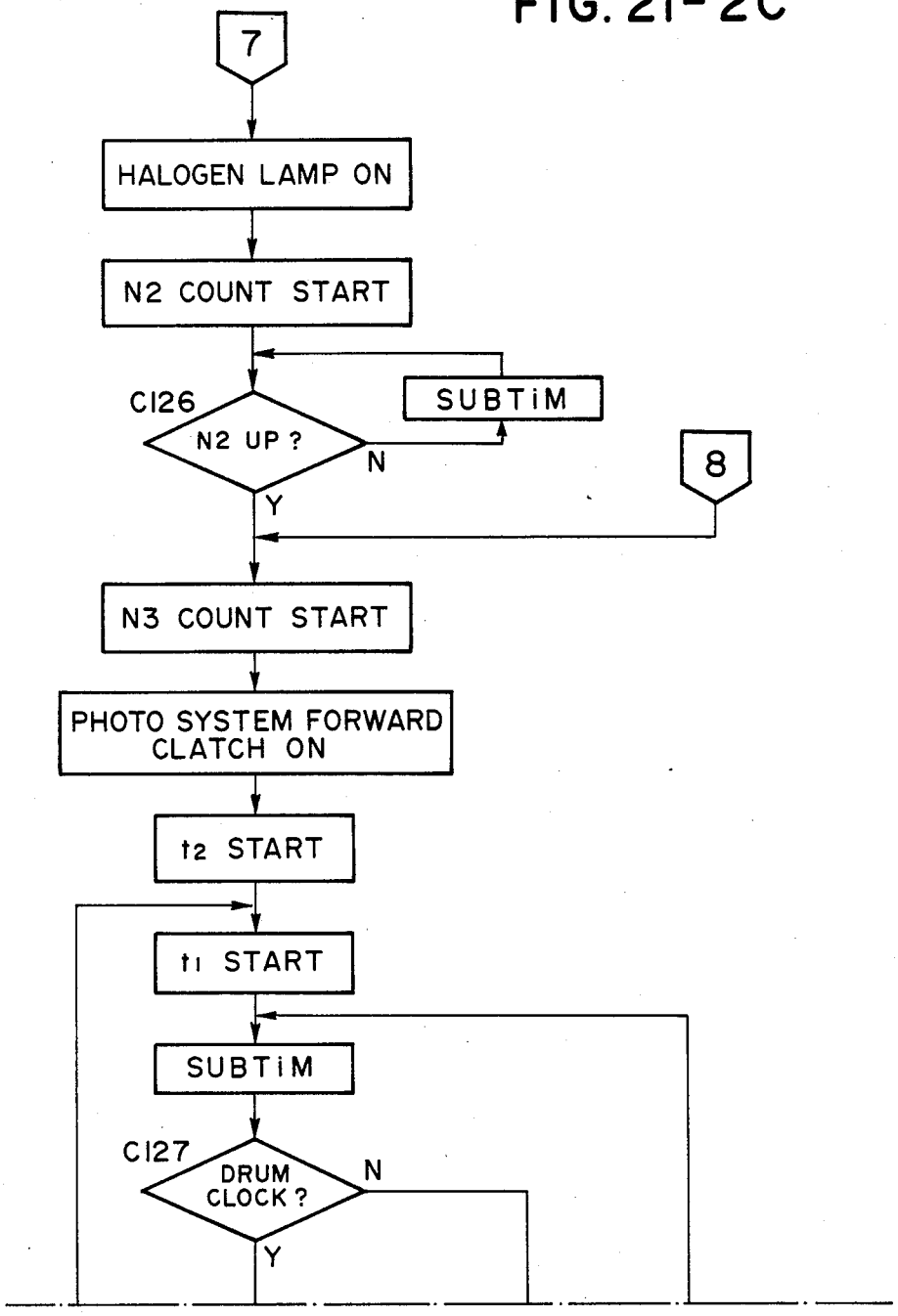
Figures 2D, 21:
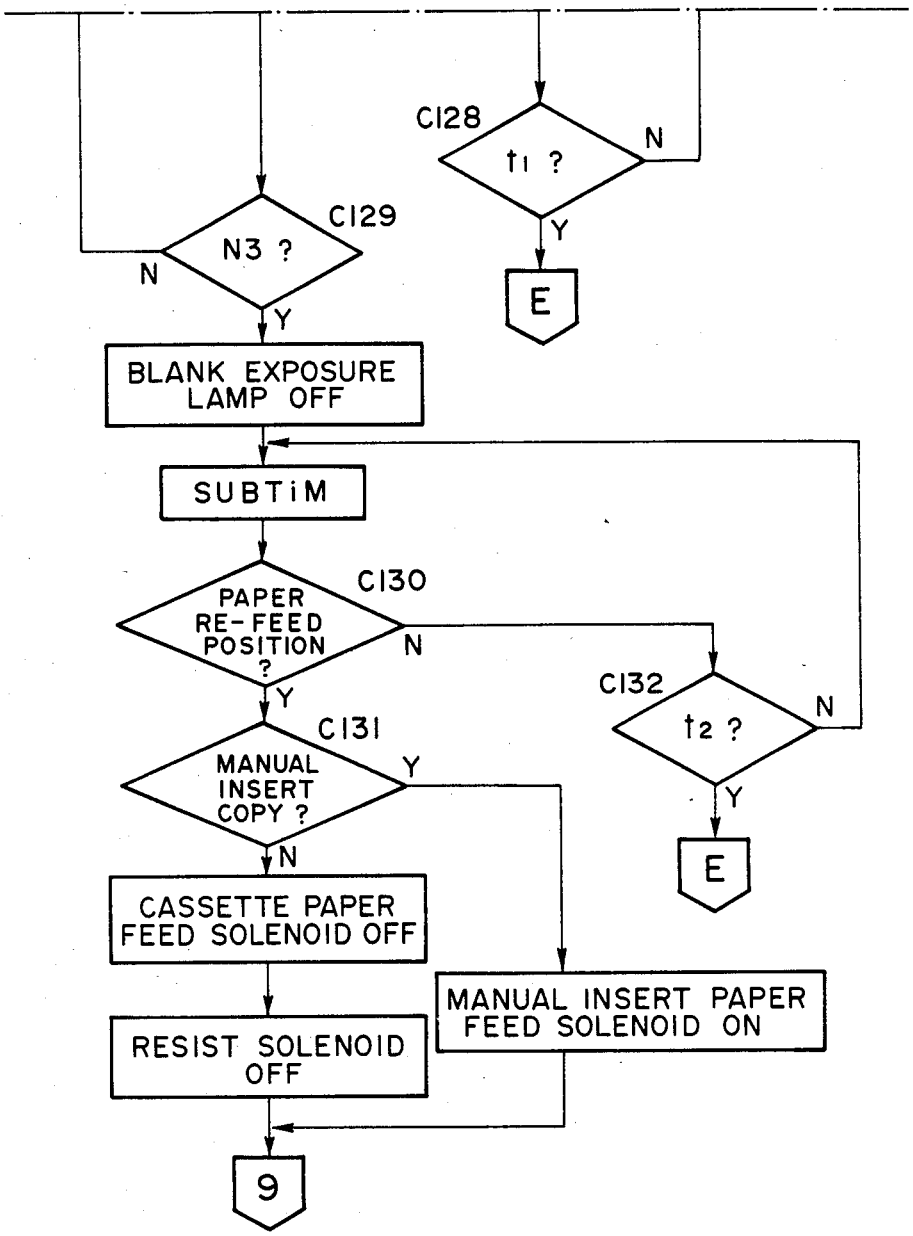
Figures 3A, 21:
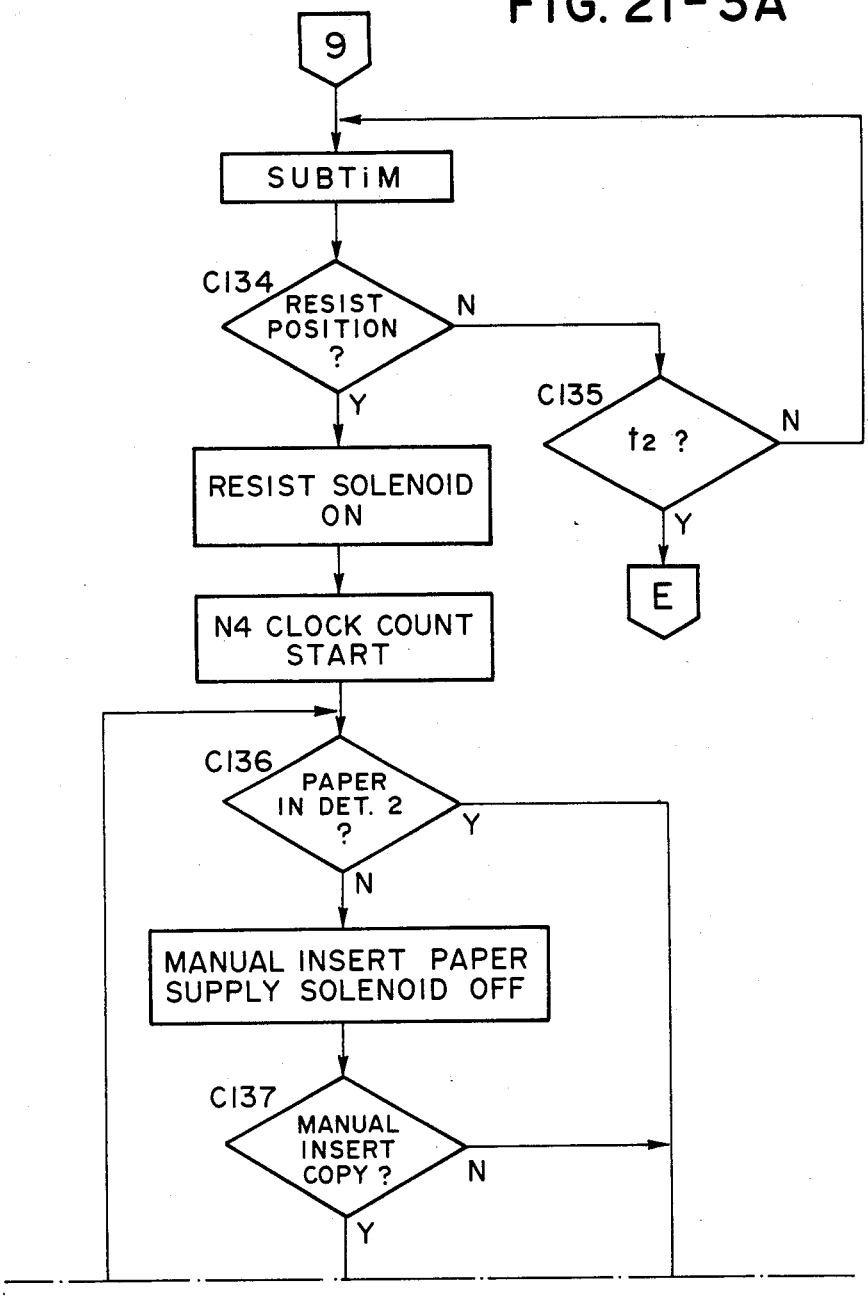
Figures 3B, 21:
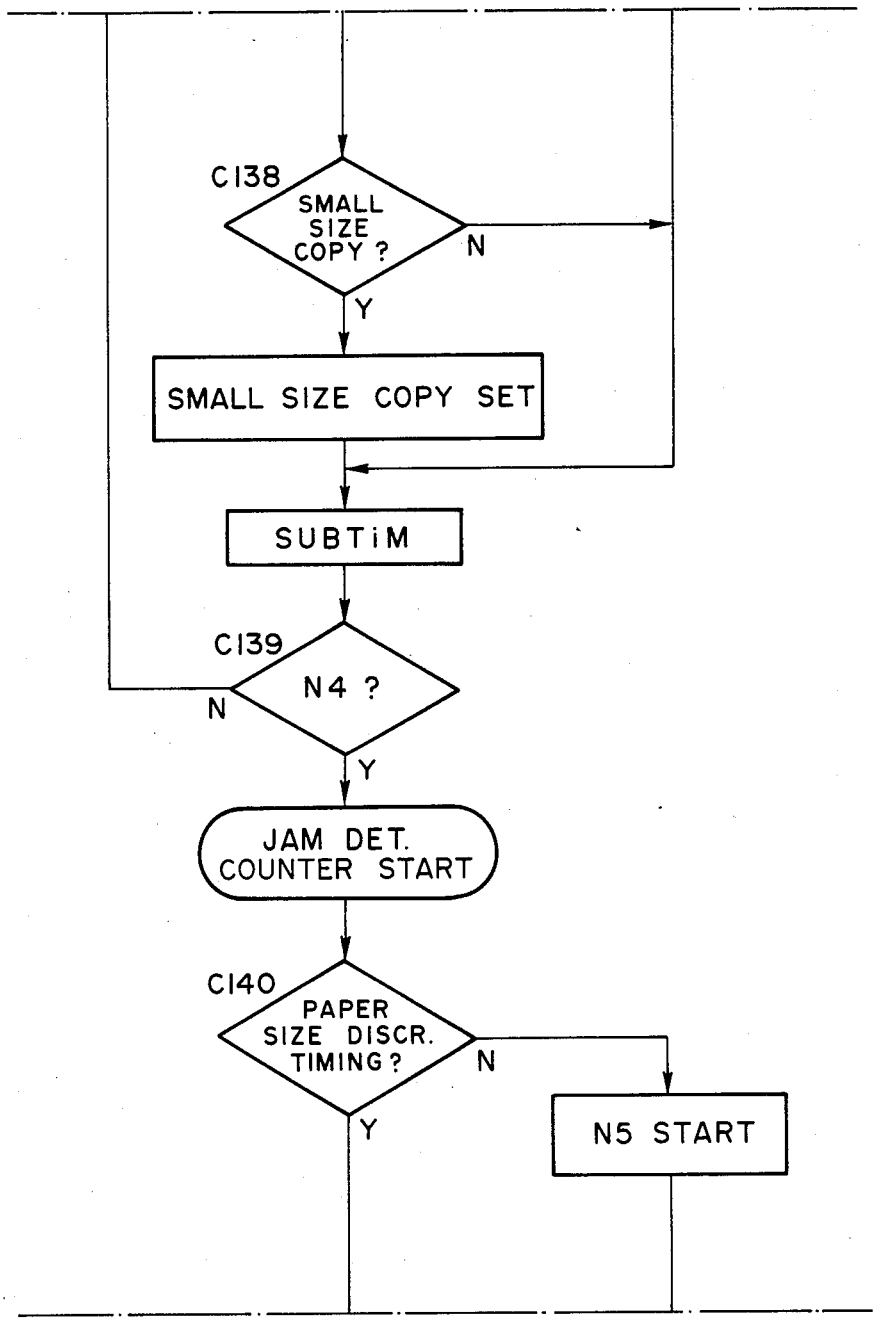
Figures 3C, 21:
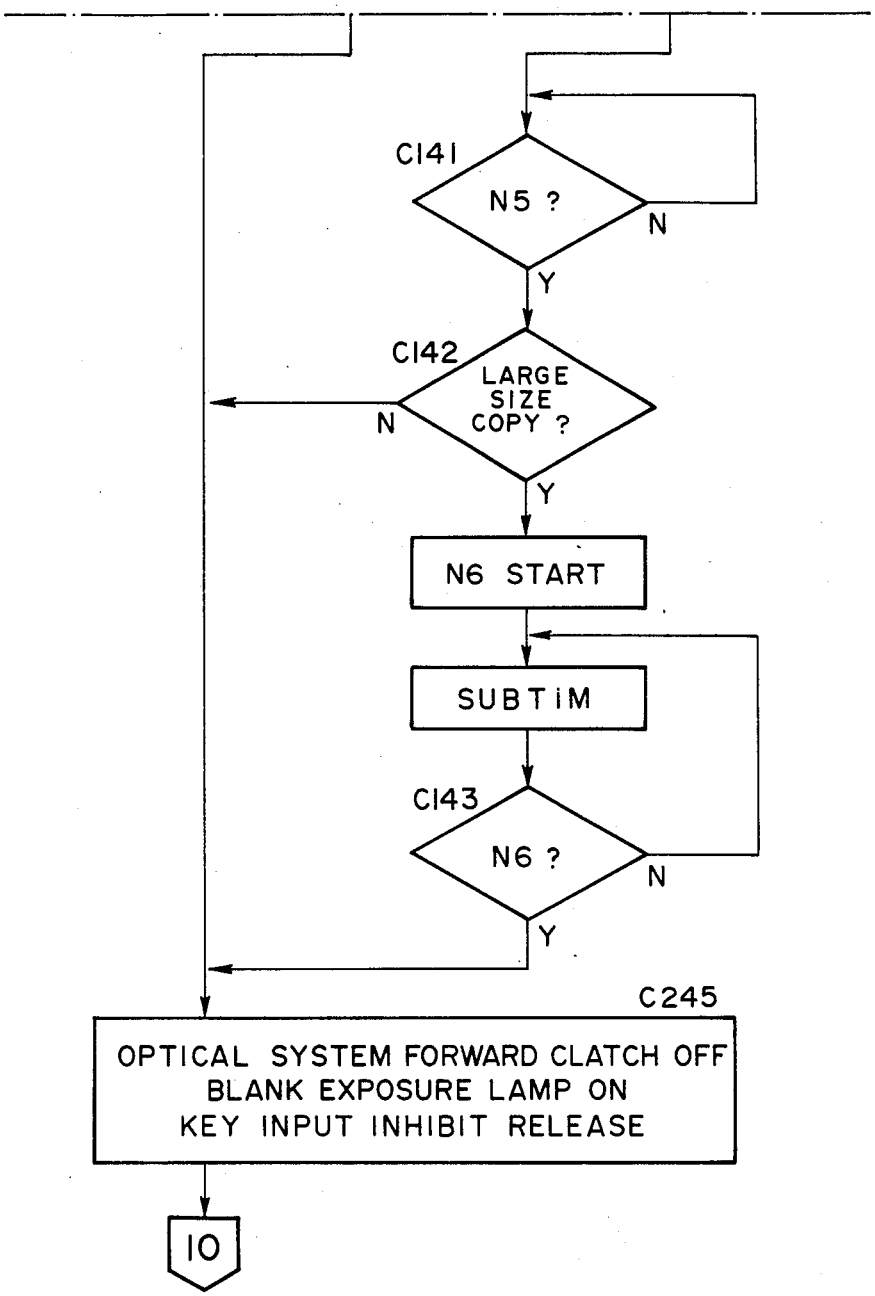
Figures 3D, 21:
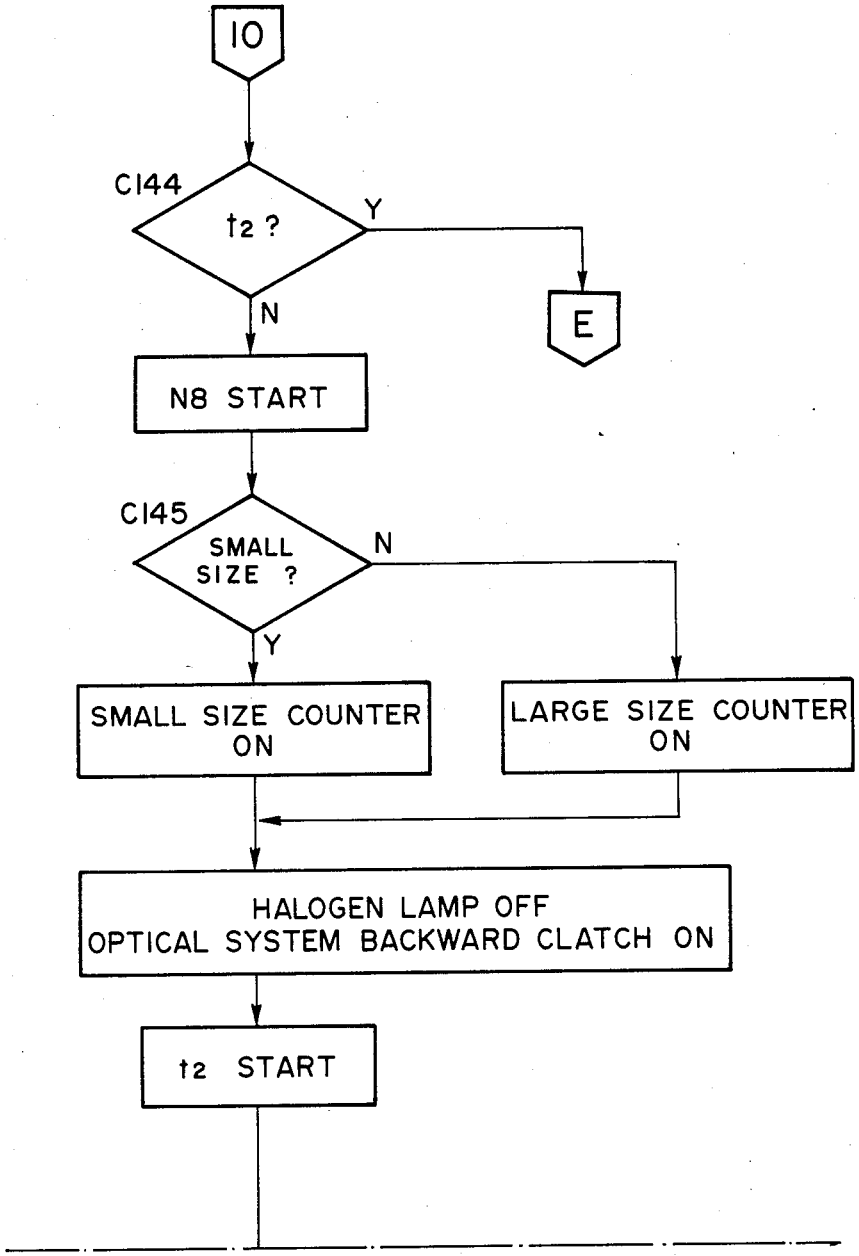
Figures 3E, 21:
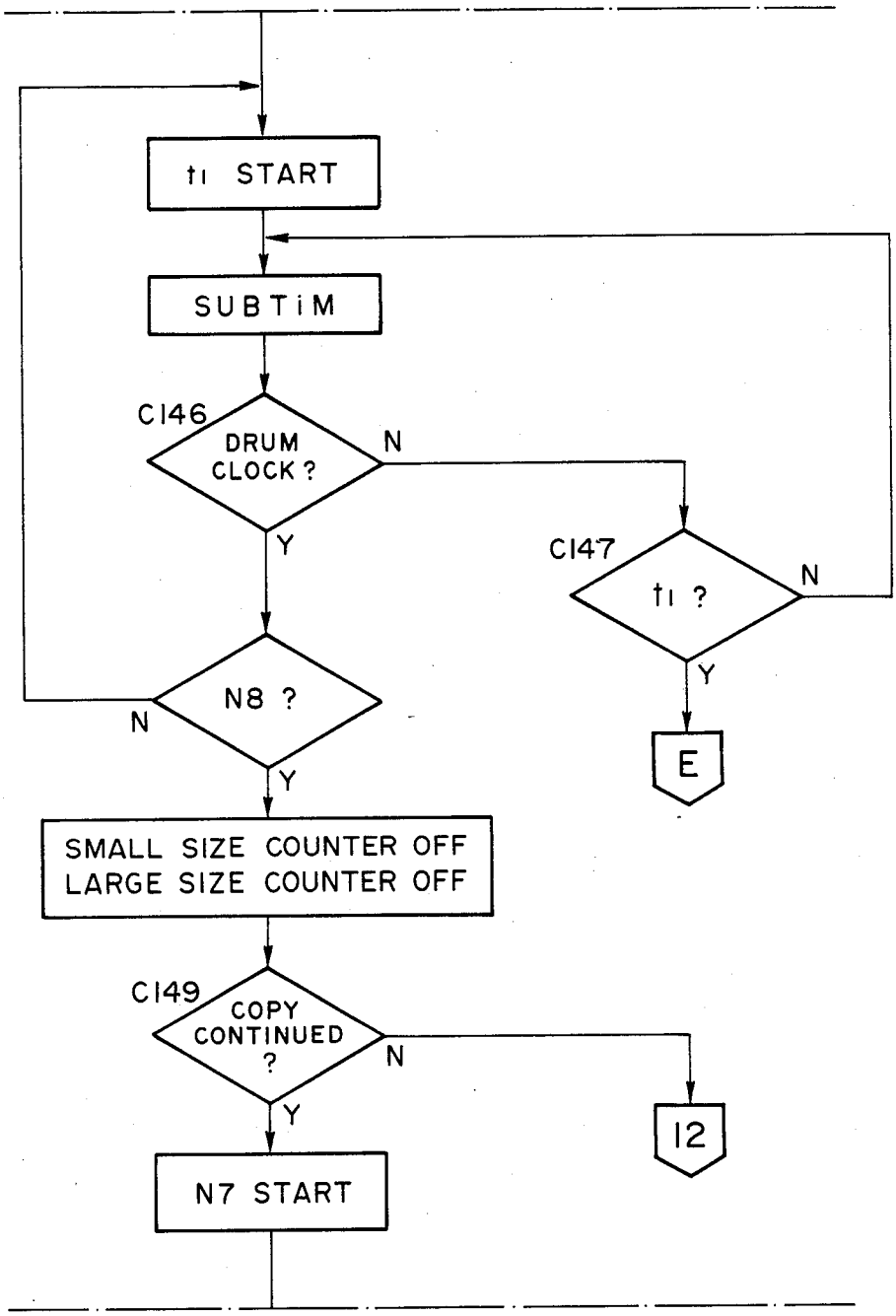
Figures 3F, 21:
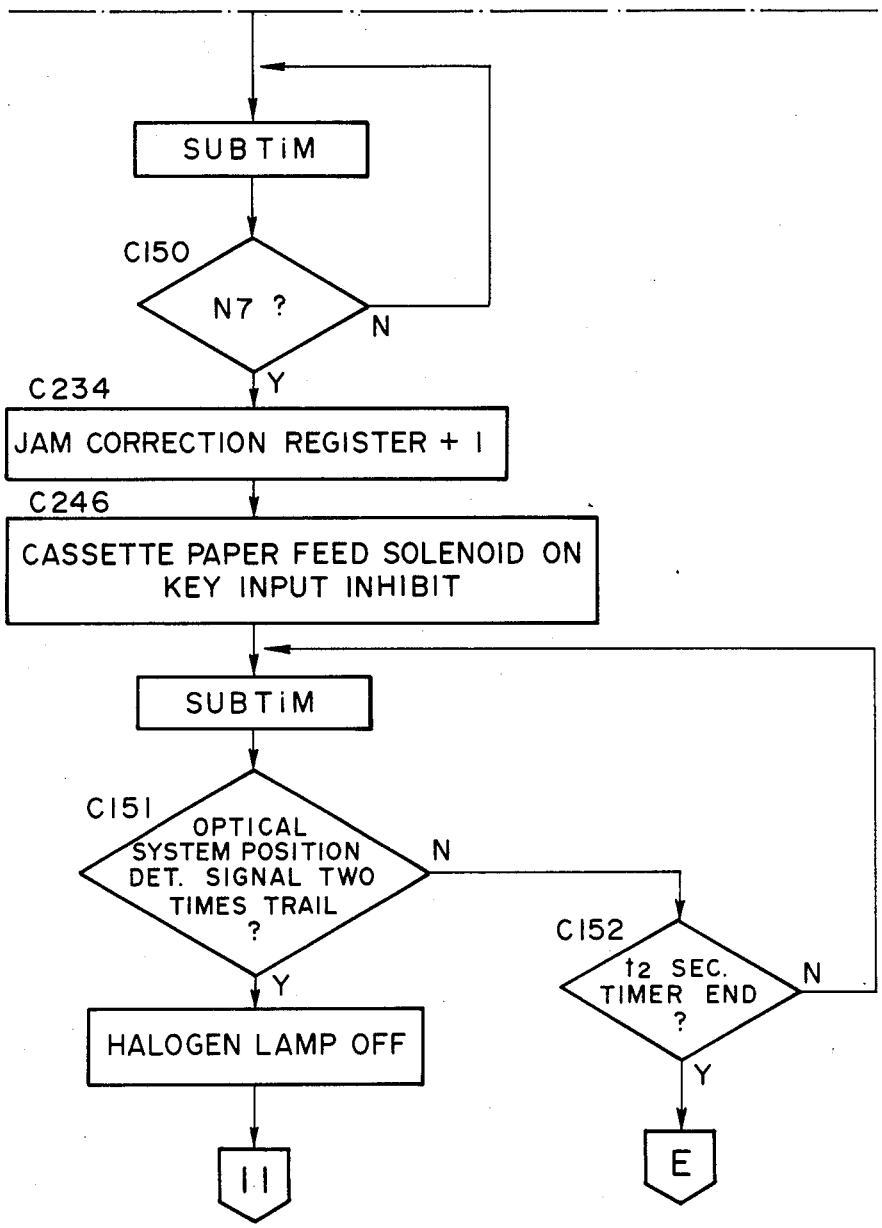
Figures 4, 21:
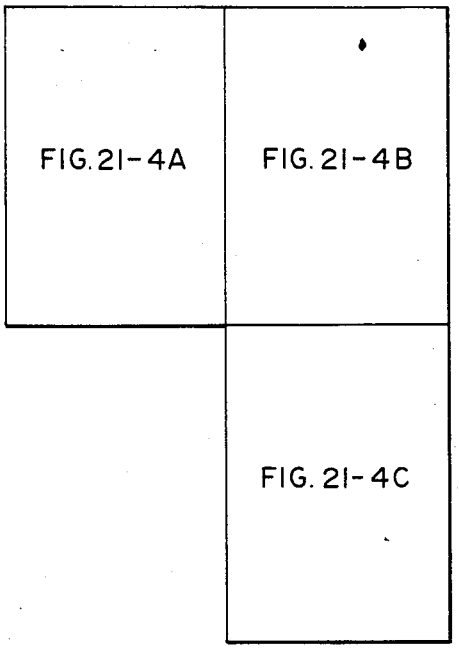
Figures 5, 21:
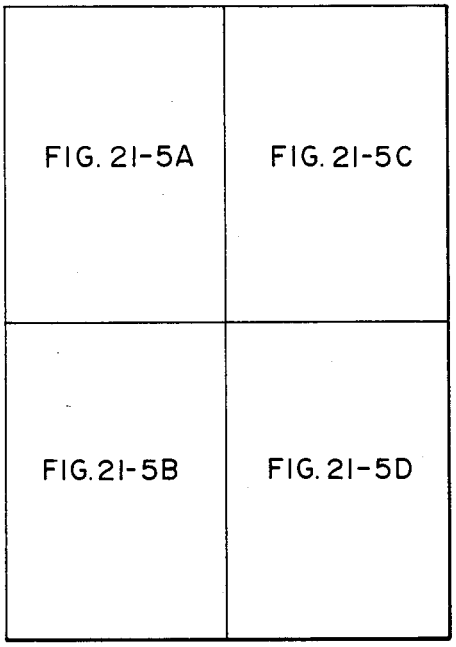
Figures 4A, 21:
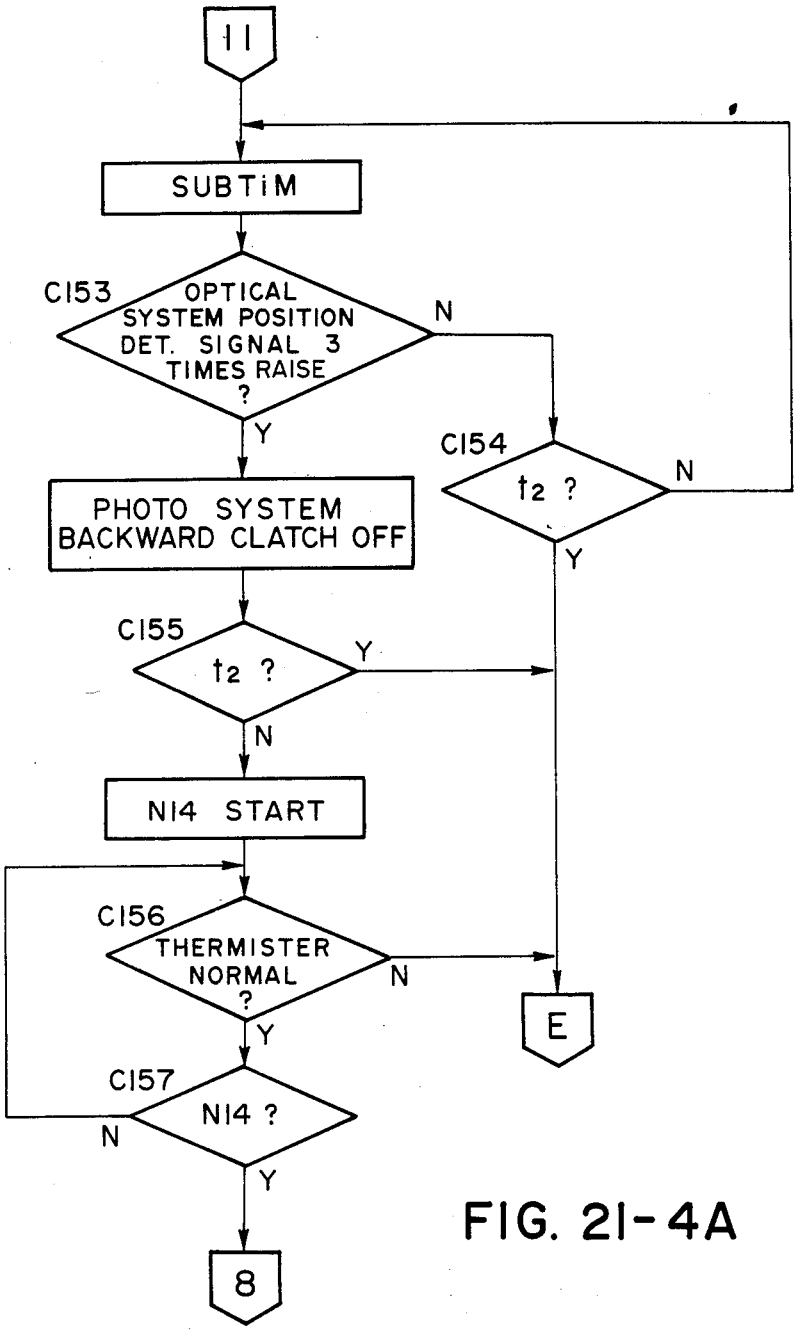
Figures 4B, 21:
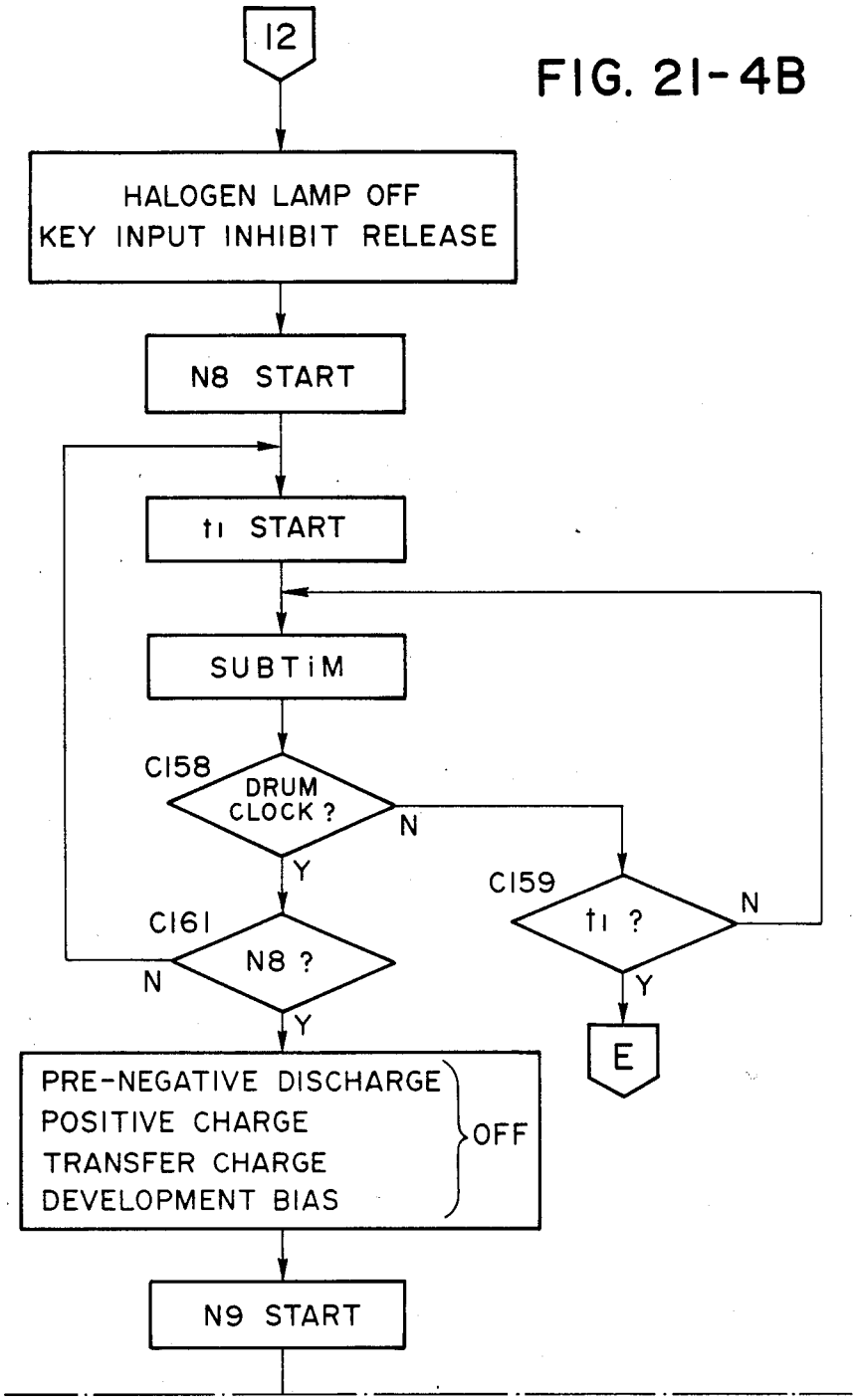
Figures 4C, 21:
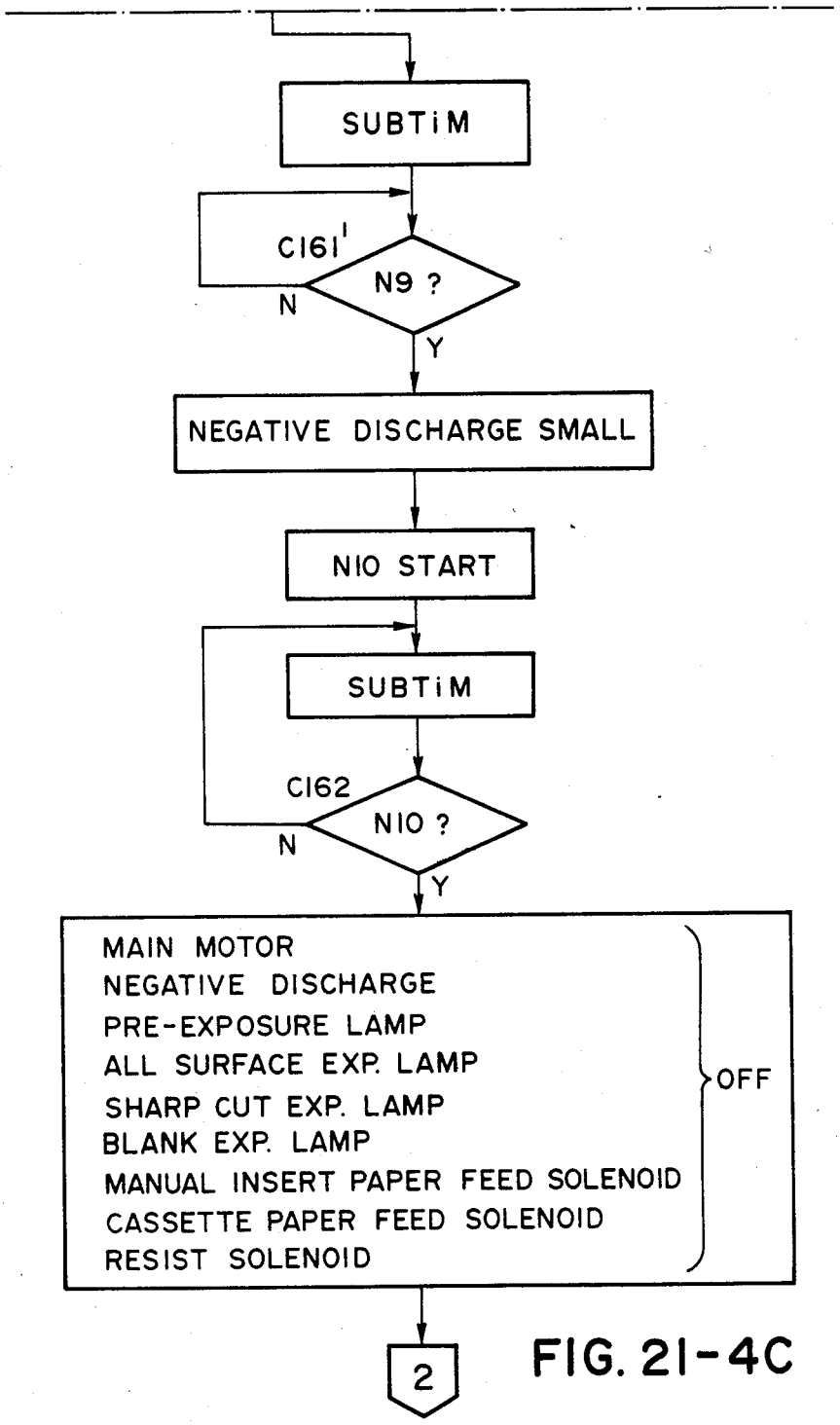
Figures 5A, 21:
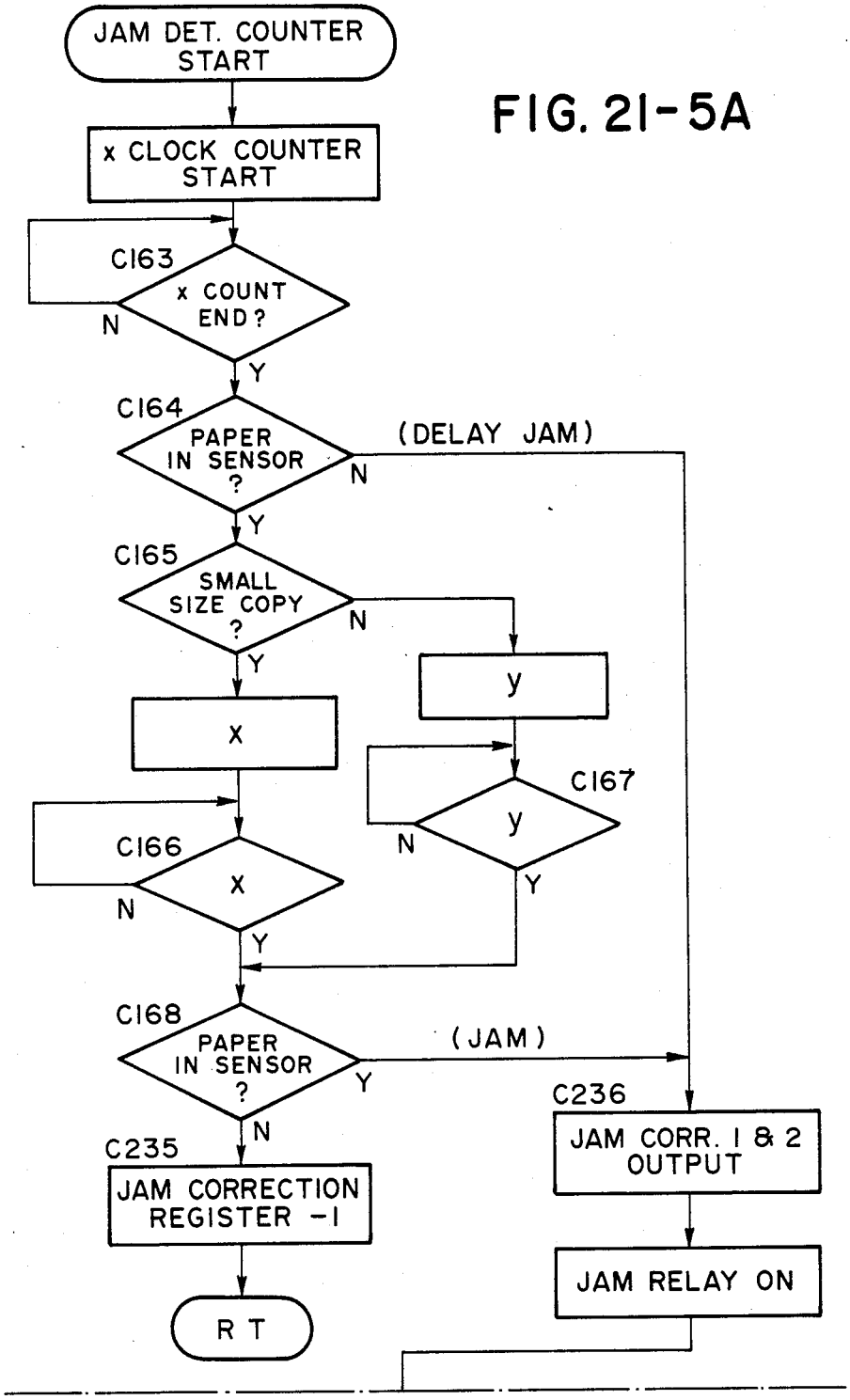
Figures 5B, 21:
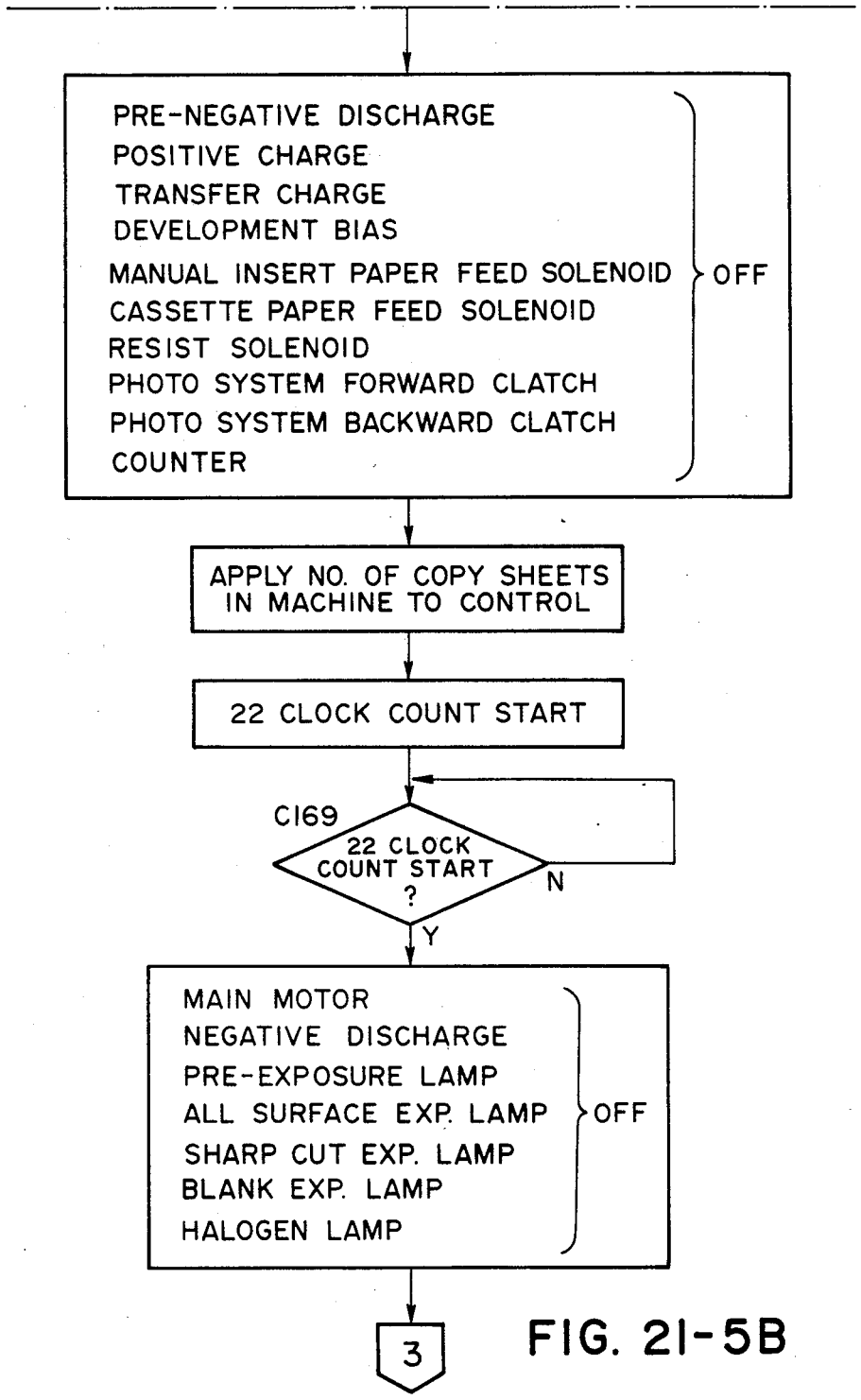

According to the flow charts shown in FIGS. 21-1 and 21-3, the content of the jam correction register present in the CPU1 is increased simultaneously with the sheet feeding (C233, C234), and is decreased (C168) upon each sheet detection by the exit sensor (C235). In this manner the jam correction sensor can exactly memorize the number of copy sheets remaining in the copier.

Upon jam detection (C164, C168) the number stored in the register is supplied to the lines U, T (C236), in response to which the CPU1 corrects the number in the display memory to amend the display.

Figure 22:
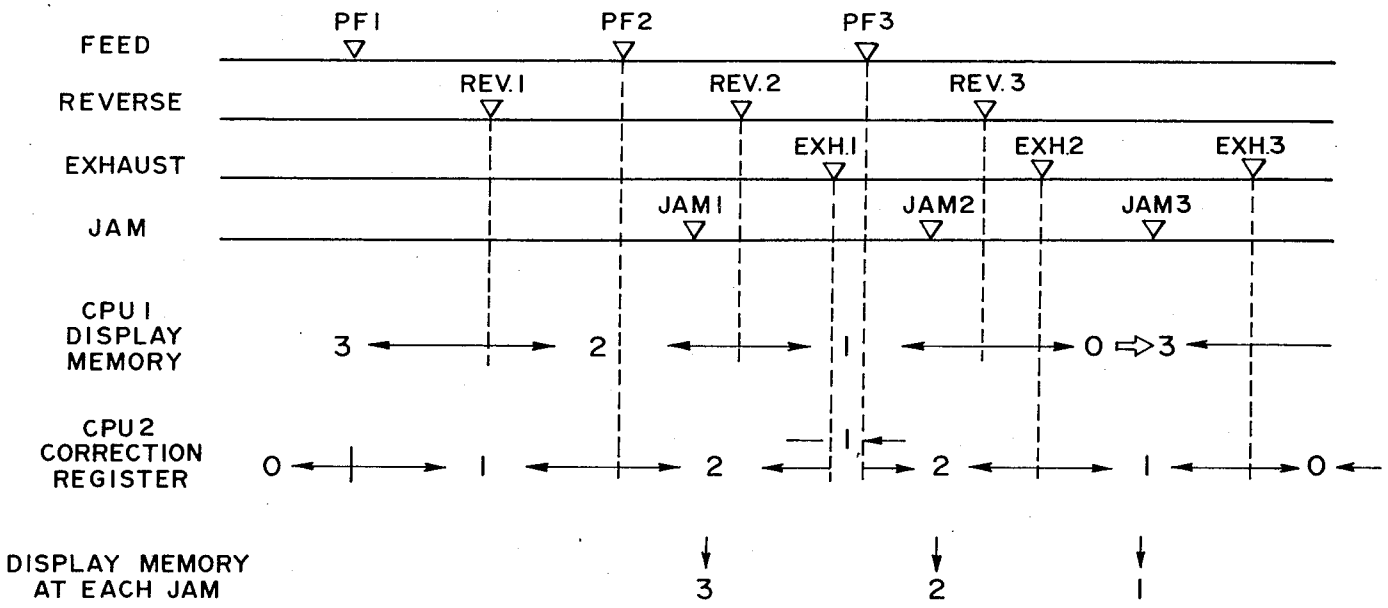
FIG. 22 shows a timing chart for count correction.

Now reference is further made to FIGS. 20-1 and 22. The CPU1 identifies the states of T and U at C10, and proceeds to the routine (4) without correction on the counter if they are 0. On the other hand if T=1, U=1 or T=U=1 is identified at the sheet jamming, the CPU1 proceeds to the routine for correcting the display memory. If the operation in progress is not a manual insertion copying nor a final cycle of an interruption copying (C14, C15), the state of the operation in the sequence is identified (C16).

Referring to the timing chart in FIG. 22 indicating a case of three large-sized copying cycles, if a jam signal JAM1 for a sheet delay occurs when the display memory is reduced from "3" to "2", the display unit indicates "3" at the jam detection or at the restart of copying since no sheet is present in the state of completed copy. Also in case of a jam signal JAM2 when the display indicates "1", the display unit newly indicates "2". In either case the step C16 identifies that the jamming in question has occurred before a copy is completed, and the content of the correction register is subtracted by one (C17), added then to the copy counter (C18) and displayed in the steps C203–C206.

Also in case of the jam signal JAM3 in FIG. 22 it is necessary to display the presence of an uncompleted copy. However in the present example the copy counter already displays the initial preset number "3" at the jam signal JAM3. For this reason the jamming in the final sheet is identified in the step C16, then the copy counter is returned to zero in the step C19, and the content "1" of the correction counter storing the transmitted content of the correction register is displayed. In this manner it is rendered possible to prevent the inconvenience in the display when the final sheet is jammed.

The content of the correction register can reach "3" as three sheets at maximum may remain in the transport path in case of the small-sized copying, but the correction of the display can be achieved in the similar manner by the correction counter storing the data U, T.

The above-explained procedure is also applicable to the interruption copying. In the final copying cycle in the interruption copying mode the display prior to the interruption copying is automatically revived when the optical system is reversed, but in case of a jamming in the final sheet in the present embodiment the display is retained without such automatic reviving in order to indicate an abnormal state.

Also in case of the manual insertion copying mode the count correction for sheet jamming is inhibited. This is to avoid the change in the display in case a manual insertion copying cycle is conducted after a copy number is set on the copier for a continuous copying operation.

Furthermore the above-explained procedure is also applicable to the processing of other troubles, such as the overheating of the exposure lamp, requiring immediate stopping of the copier and thus causing certain number of sheet to remain in the copier.

The signal S is utilized for key entry control as explained before, and for reducing the copy counter, thus inhibiting the key entry during the sheet jamming or copying cycle and enabling the key entry at an appropriate time.

Referring to the flow chart shown in FIG. 21, a step C105, for checking the signal PI from the jam process circuit Z3 set upon jam detection in the steps C164 and C168 in FIG. 21-5, latches the signal S (C242). Then the jam state is checked (C101) and the signal S is released (C243). When the jam process circuit Z3 is manually released from the jam state, the signal S is turned off (C244), thereby enabling the key entry. Consequently the change of the preset copy number, which is disabled during the jam state even with the actuation of the clear key, is enabled by the actuation of the numeral keys with or without the actuation of the clear key after the jammed state is resolved.

The above-mentioned key enable control can similarly cover the touch keys for selecting one of multiple image magnification or one of plural cassettes.

Also at the start of copying operation in the same flow chart, the signal S is released in the step C243, immediately after the first sheet feeding from the cassette. Prior to said signal S, the preset copy number can be altered by the numeral keys. Also signal S is turned off in the step 245 in FIG. 21-3 when the forward displacement of the optical system for each copy size is completed. However the signal S is again supplied in the step C246 in FIG. 21-3 through the step C149 in the continuous copying operation. The above-mentioned procedure is repeated, then in the final copying cycle, the program proceeds to the post-rotation cycle upon identification of zero copy count in the step C149, and the key entry is enabled after the optical system is reversed in said final copying cycle. However the pulse counting for jam detection for the final copy sheet is conducted during said post-rotation stage, and, upon jam detection said signal S is again released in the aforementioned manner to inhibit the key entry.

In response to said signal S, the CPU1 inhibits the key entry not only during the presence of said signal S but also during the intervals between the succeeding signals S in the continuous copying operation. More specifically the numeral keys are disabled by checking a copying-in-progress flag set in the RAM in the step C25 in FIG. 20-2, but the interruption key and the stop key are enabled. However these keys are also disabled during the jam state (C22). Also the CPU1 performs the copy count at the trailing end of said signal S (0207).

Figure 14:
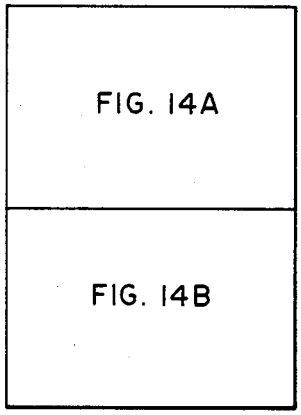
FIG. 14 shows a combination relationship between FIGS. 14A and 14B.
Figure 13:
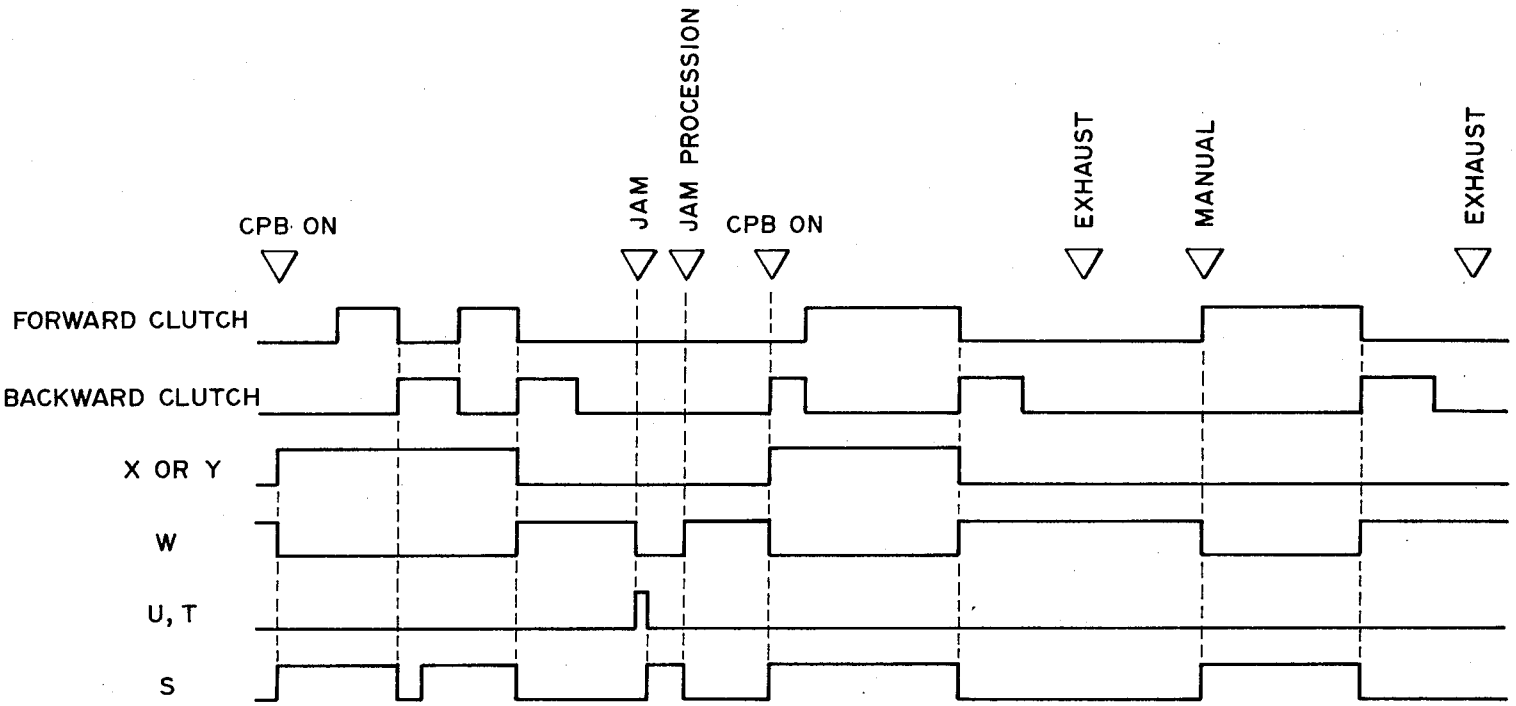
FIG. 13 shows a timing chart showing the output signals of the circuit shown in FIG. 11.
Figure 14A:
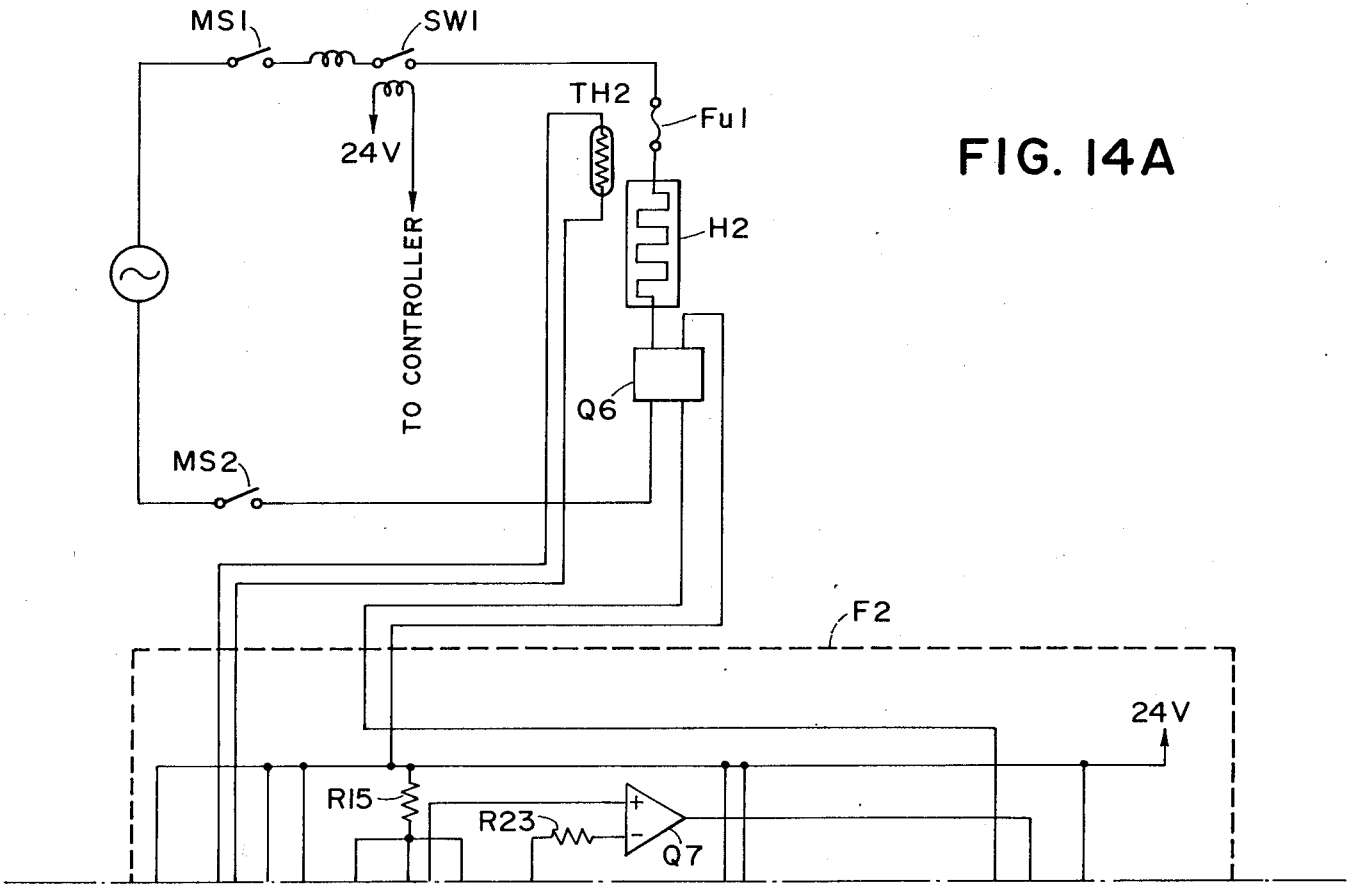
FIGS. 14A and 14B show a circuit diagram of a control circuit for a fixing heater.
Figure 14B:
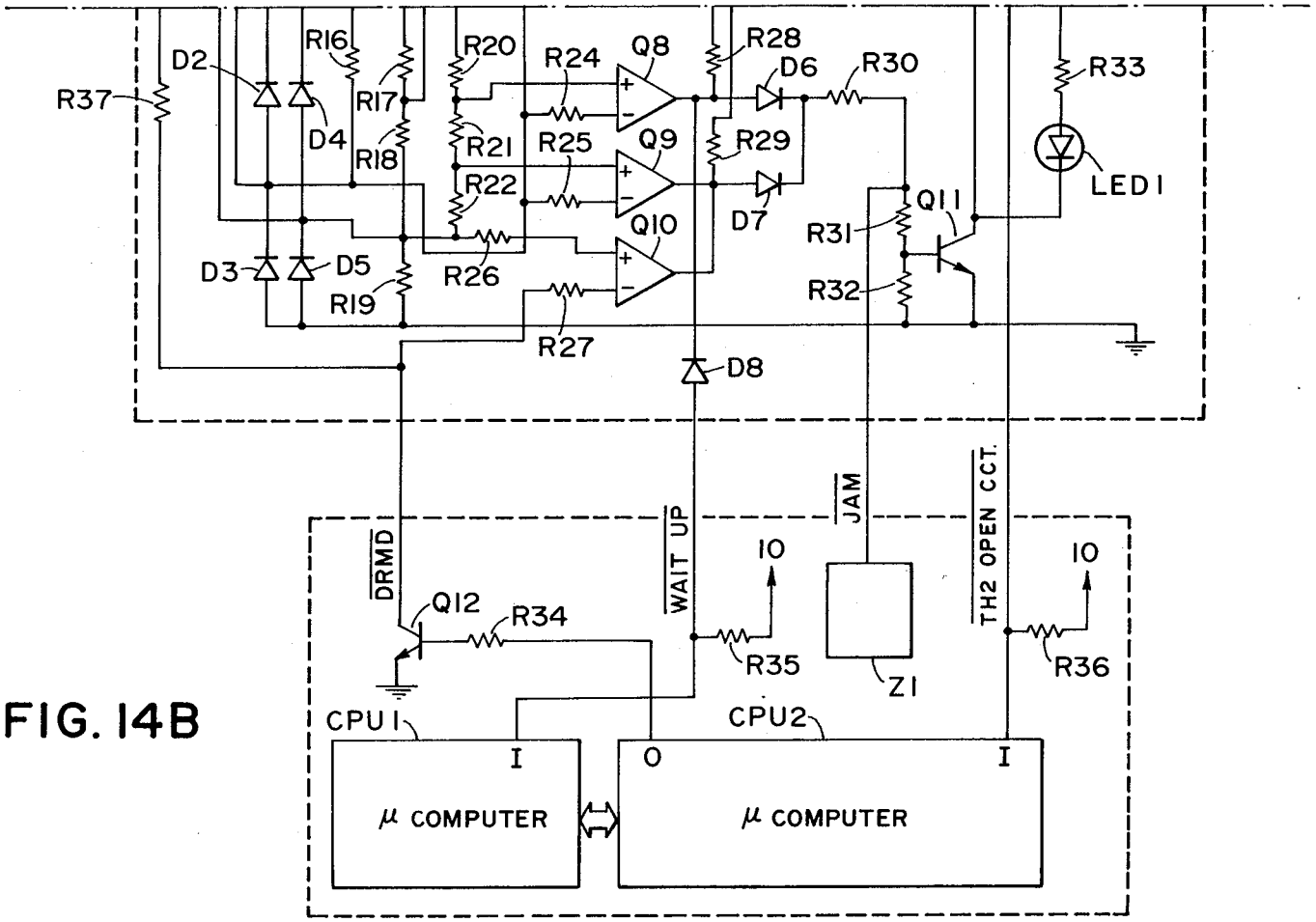

The relationship between the above-explained signals A and B is shown in FIG. 14. Upon actuation of the copy start key during the stand-by state, the CPU1 releases the signals X and/or Y according to the cassette size as shown in FIG. 13, and in response to said signals the CPU2 activates the feed roller 13 to feed a sheet and simultaneously sends the signal S to the CPU1 thereby disabling the keys except the interruption and stop keys. The jam correction signals U, T are utilized for correcting the display on the copy count display unit according to the number of copy sheets remaining in the copier at the jamming. At the sheet jamming, the CPU2 releases the signal S and the jam correction signals U, T, in response to which the CPU1 corrects the display on the display unit and disables all the keys. Upon termination of the jam state, the CPU2 turns off the signal S to enable the key entry through the control panel. The signals X, Y are continued during a continuous copying operation and are turned off by the CPU1 when the signal S is terminated at the reversing of the optical system in the final copying cycle. The manual insertion copy enable signal W shifts to L-level after a copying cycle is started. Upon insertion of a copy sheet when the signal W is at the H-level, the CPU2 start the manual insertion copying sequence. The signal W is set again when the optical system is reversed at the final copying cycle, or when the jam state is resolved.

Figure 15:
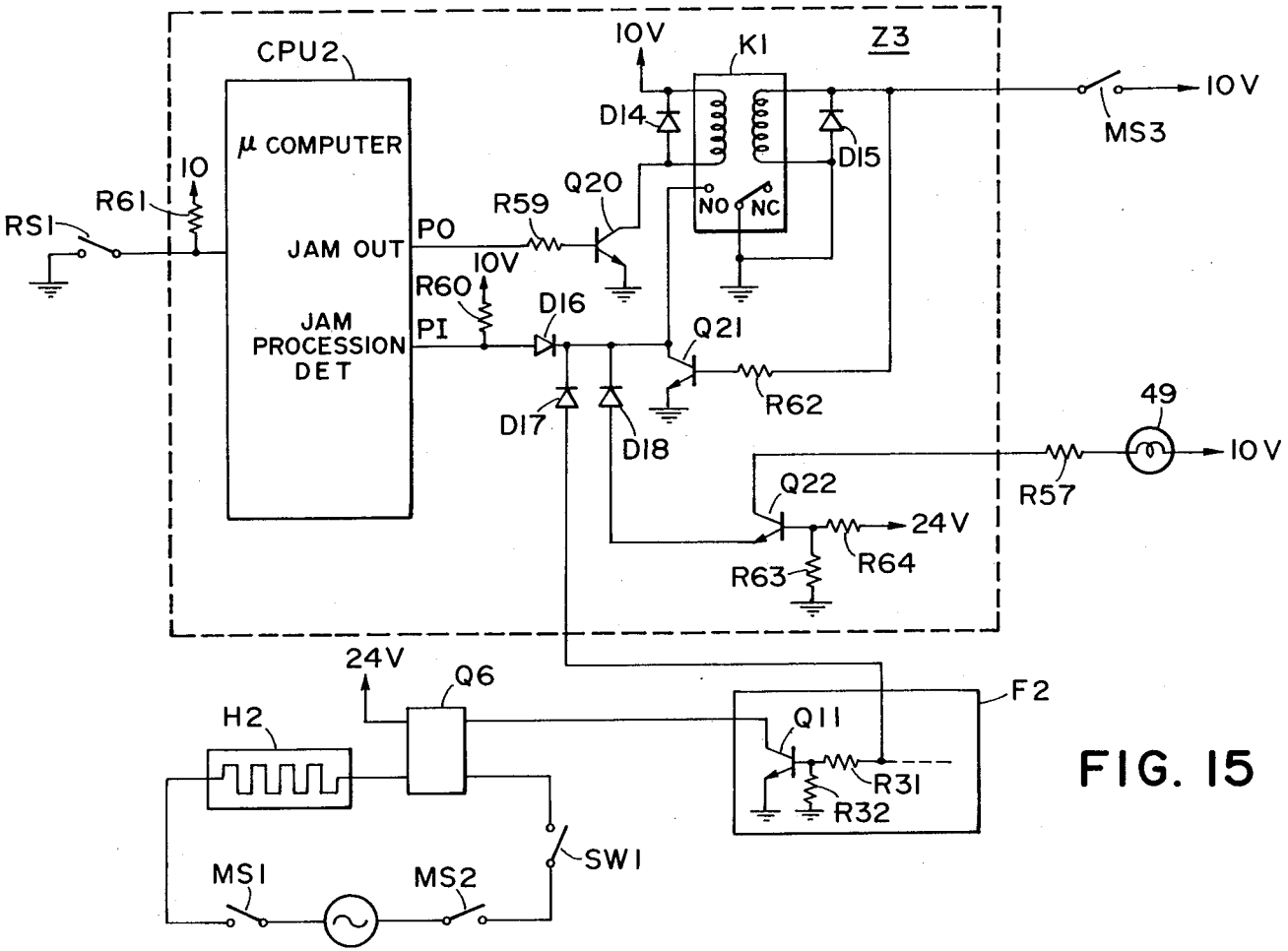
FIG. 15 shows a circuit diagram for sheet jam processing.
Figure 16:
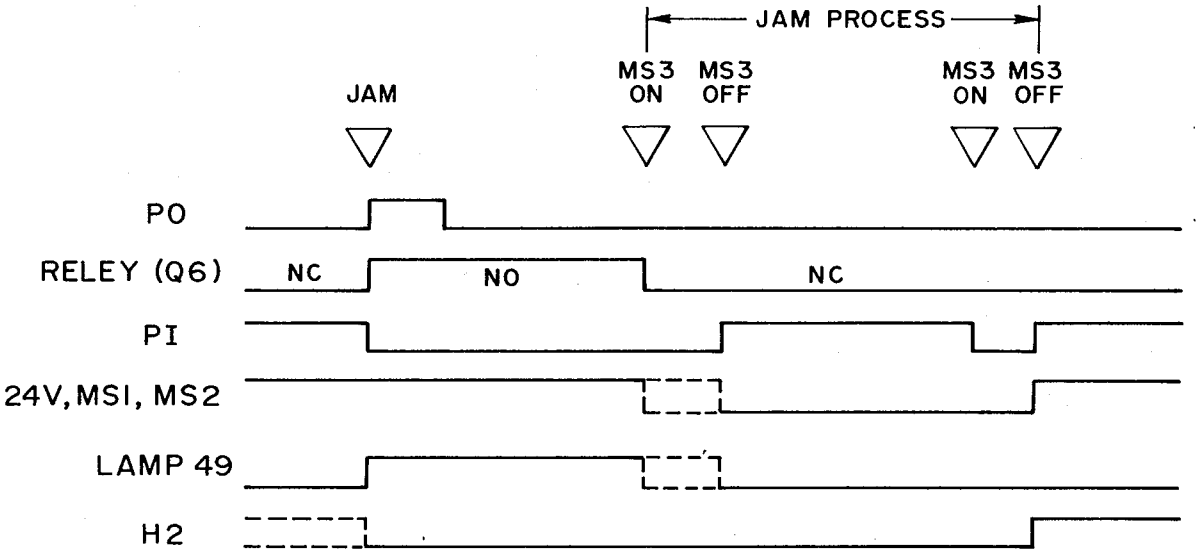
FIG. 16 shows a timing chart showing the functions of the circuit shown in FIG. 15.

FIGS. 15 and 16 respective show the jam process circuit Z3 and the corresponding timing chart. The CPU2, upon identification of a jam state by the absence of the signal from a sheet eject sensor RS1 provided at the outlet side of the fixing roller within a period of a determined number of clock pulses after the registering sensor is activated, releases a jam signal to an output port PO to turn on a transistor Q20. Thus a latch relay K1 is changed over to the normally-open contact to provide an L-level signal to a jam process input port PI of the CPU2, thereby lighting the jam indicator lamp 49. At the same time a transistor Q11 in the fixing heater control circuit is turned off to deactivate a solid-state relay Q6, thereby turning off the fixing heater H2. Thus the operator turns on a jam reset switch MS3 and removes the jammed sheets by lifting the upper unit of the copier. Said switch MS3 is so structured as to be turned on when the upper unit is lifted, but remains turned off while the copier body is opened for jam processing. Door switches MS1, MS2, also shown in FIG. 7, are also turned off to interrupt the 24 V power supply when the copier body is opened. When the upper unit of the copier is returned to the original position after the sheet jamming is resolved, the door switches MS1, MS2 are again turned on to supply power to the fixing heater. If the doors are closed to turn on the door switches MS1, MS2 but the upper unit is not completely clamped with the lower body, a transistor Q21 is turned on by the turning on of the jam reset switch MS3 to shift the input port PI to the L-level thereby disabling the copying operation and lighting the indicator lamp 49. In this manner it is possible to avoid eventual damage to the mechanical parts often resulting from the copying operation with incompletely closed doors or copier body. The control circuit is simplified by the use of the jam reset switch MS3 also for checking incompletely closed doors. A transistor Q22 is provided for preventing the lamp 49 from lighting in case the doors are incompletely closed while the main switch is turned off. Diodes D14 and D15 are provided for consuming the currents induced in the coils of the relay K1 when it is off, and diodes D16–D18 are provided for checking reverse currents. As will be apparent from the steps C166, C167 in FIG. 21-5, the present embodiment employs different numbers of drum clock pulses CLK for checking the passage of sheets of different sizes through the exit sensor, so that the circuit Z3 can correct the count exactly for any sheet size.

FIG. 14 shows the control circuit F2 for the fixing heater H2, wherein a heater 25 of a halogen lamp is controlled by a bridge circuit composed of resistors and thermistors. A solid-state relay Q6 turns on and off the heater H2 according to the on-off states of the transistor Q11. Q7–Q10 are comparators with open-collector transistors at the output stages. The comparator Q7 detects an abnormally high resistance, or breakage, of a thermistor TH2, through a bridge circuit composed of resistors R16–R18 and said thermistor TH2, and supplies the detection signal to the CPU2 to interrupt the sequence as will be explained later. The comparators Q8, Q9 control said thermistor TH2 in such a manner that it attains a resistance determined by a bridge circuit composed of resistors R16, R20–R22 and said thermistor RH2, wherein the set temperature corresponding to the comparator Q9 is higher than that corresponding to the comparator Q8. Said temperatures are selected by a transistor Q10. When the drum rotation signal DRMD from the CPU2 is at the L-level, a transistor Q12 is turned off to provide an L-level signal from the transistor Q10, whereby the output signal from the comparator is not transmitted to the transistor Q11 and the heater H2 is controlled by the output signal from the comparator Q8. In this manner, when the drum is stopped before or after the copying operation, the heater is maintained at a somewhat lower temperature by supplying power thereto only when the heater is below said temperature. When the signal DRMD is at the H-level, the transistor Q11 is controlled by the outputs of the comparators Q8 and Q9 through diodes D6 and D7 but in fact controlled by the output of the comparator Q9 with a higher set temperature, since said two signals are logically summed. In this manner a temperature allowing complete fixing, even with extremely low room temperature, is obtained during the copying operation. A light-emitting diode LED1 is turned on and off according to the state of the transistor Q11.

When the copying operation is interrupted by a sheet jam, the transistor Q11 is turned off regardless of the temperature of the thermistor TH2. This is achieved by utilizing the jam signal JAM from the jam control circuit Z1 (FIG. 15) to cancel the output signal through a resistor R30. As will be explained later, the power supply is revived when the jam state is removed.

Also the comparator Q8 transmits a fixing temperature signal WAIT-UP to the CPU1 through D8 to control the waiting period and to light the wait indicator lamp 246.

Upon connection of the power plug to the power supply line, the microcomputer CPU1 is reset to turn off all the output ports. Then the presence of the key counter and the toner is checked, and any abnormality is memorized (C3, C4). The above-mentioned steps are repeated until the power switch 239 is turned on to activate the 24 V power supply (C25). Upon said activation a 15-minute timer is started, then the waiting state is identified (C6) and the fan is started when the waiting stage is completed. The fan is continuously driven until the completion of the function of said timer even if the power switch is turned off (C8, C9). If a process trouble signal Ab indicating for example a lamp failure is supplied from the CPU2, the CPU1 does not execute the key entry routine shown in FIG. 20-2 but merely lights the indicator 245 to indicate said trouble.

The CPU2 does not also execute the program until the 24V power supply is activated. If a jam state, such as incompletely closed doors, is present at this point, said state is identified in the step C101 to release the signal S for disabling the key entry (C243). Upon turning the power switch on, a shut timer is started for automatic power shut-off. Then the thermistor is checked (C107), and in case of a failure, the trouble routine is executed to transmit the signal Ab to the CPU1. In the normal state, the program returns to the routine (1) if the copy cycle is not started within the preset time of the shut timer (C108). Said shut timer is started when the motor is switched off after the post-rotation cycle even when the copy cycle is interrupted by the jamming or absence of copy sheet. In this manner the control for said shut timer is different from that for the timer for clearing the display.

Figure 17:
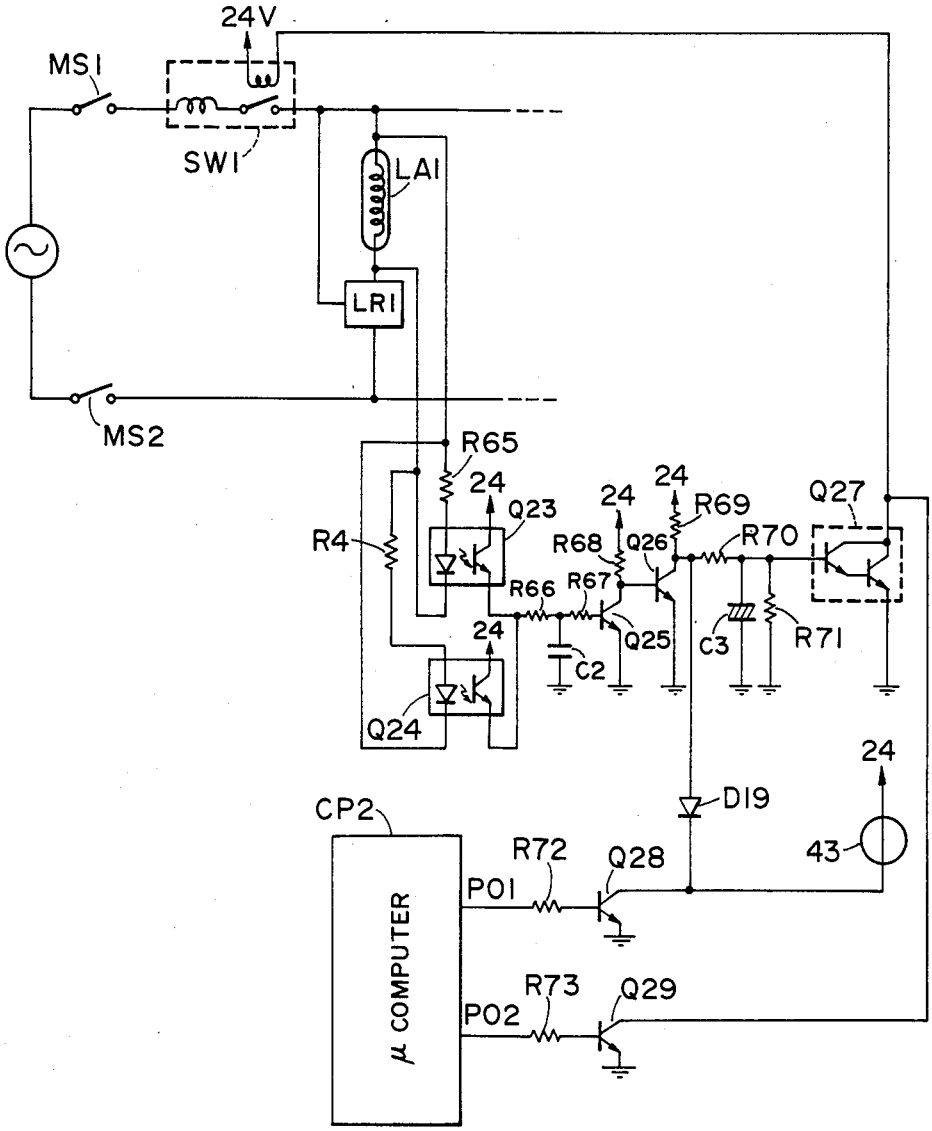
FIG. 17 shows a circuit diagram of a lamp checking circuit.

Referring to FIG. 17, if the halogen lamp 2 is abnormally lighted when the optical system is not in the forward displacement, photocouplers Q23, Q24 are activated to charge a condenser C2, whereby transistors Q25 and Q26 are respectively turned on and off. Thus a condenser C3 is charged through resistors R69, R70 to turn on a transistor Q27 after a determined time, whereby a solenoid relay switch SW1 is turned off. Said switch SW1 also turns the power off if the stand-by state continues for a determined period, by releasing an H-level signal from the shut timer of the CPU2 through the output port P02 to turn on the transistor Q29.

A diode D19 is provided to prevent the charging of the condenser C3 by the lamp LA1 during the forward displacement of the optical system. The output port PO1 is used for providing the forward signal to the clutch 43.

Figure 18:
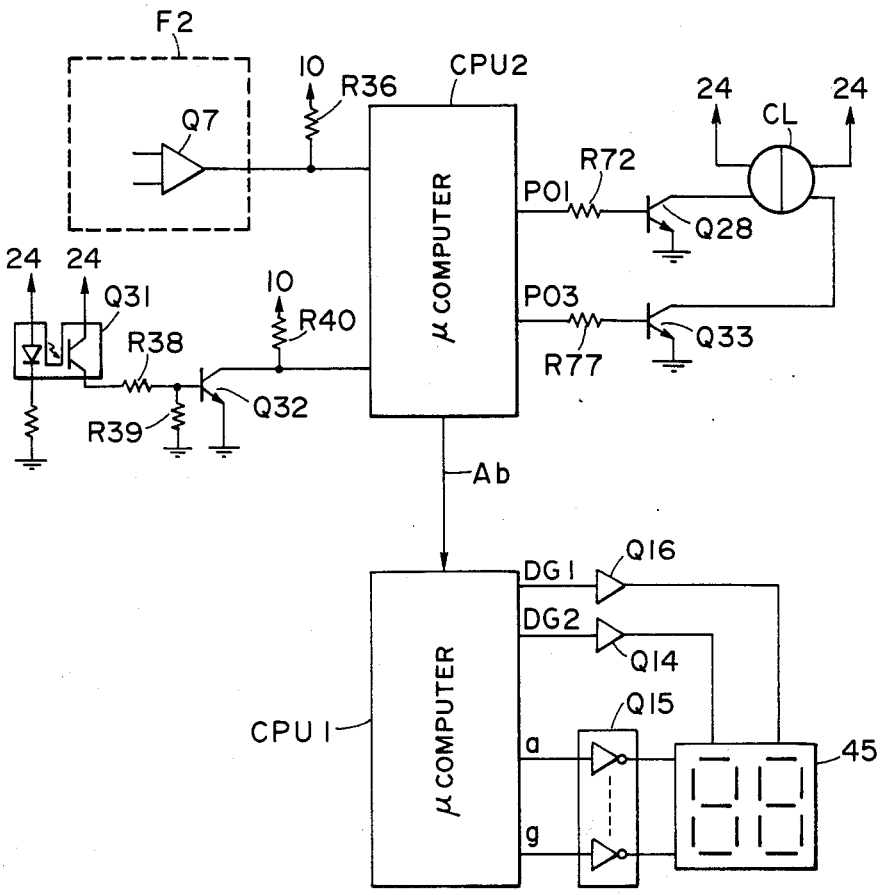
FIG. 18 shows a circuit diagram of a trouble display circuit.

FIG. 18 shows the warning circuit embodying the present invention. If the signal from the comparator Q7 of the fixing heater control circuit F2 does not change after approximately one minute from the start of power supply to the fixing heater H2, or if the drum clock pulses are not received for approximately 2.5 seconds during the copying cycle, or if the forward or backward clutch for displacing the optical system is not switched off within a determined time after it is switched on, the CPU2 transmits an abnormality signal Ab to the key entry signal line. The CPU1 identifies said signal and stops the copier, turning off all the output ports of the CPU2. Also the CPU1 displays "00" on the copy count display unit to inform the operator of the abnormal state. In this manner the display unit performs the function of the alarm buzzer or service-call lamp conventionally used.

Figure 19:
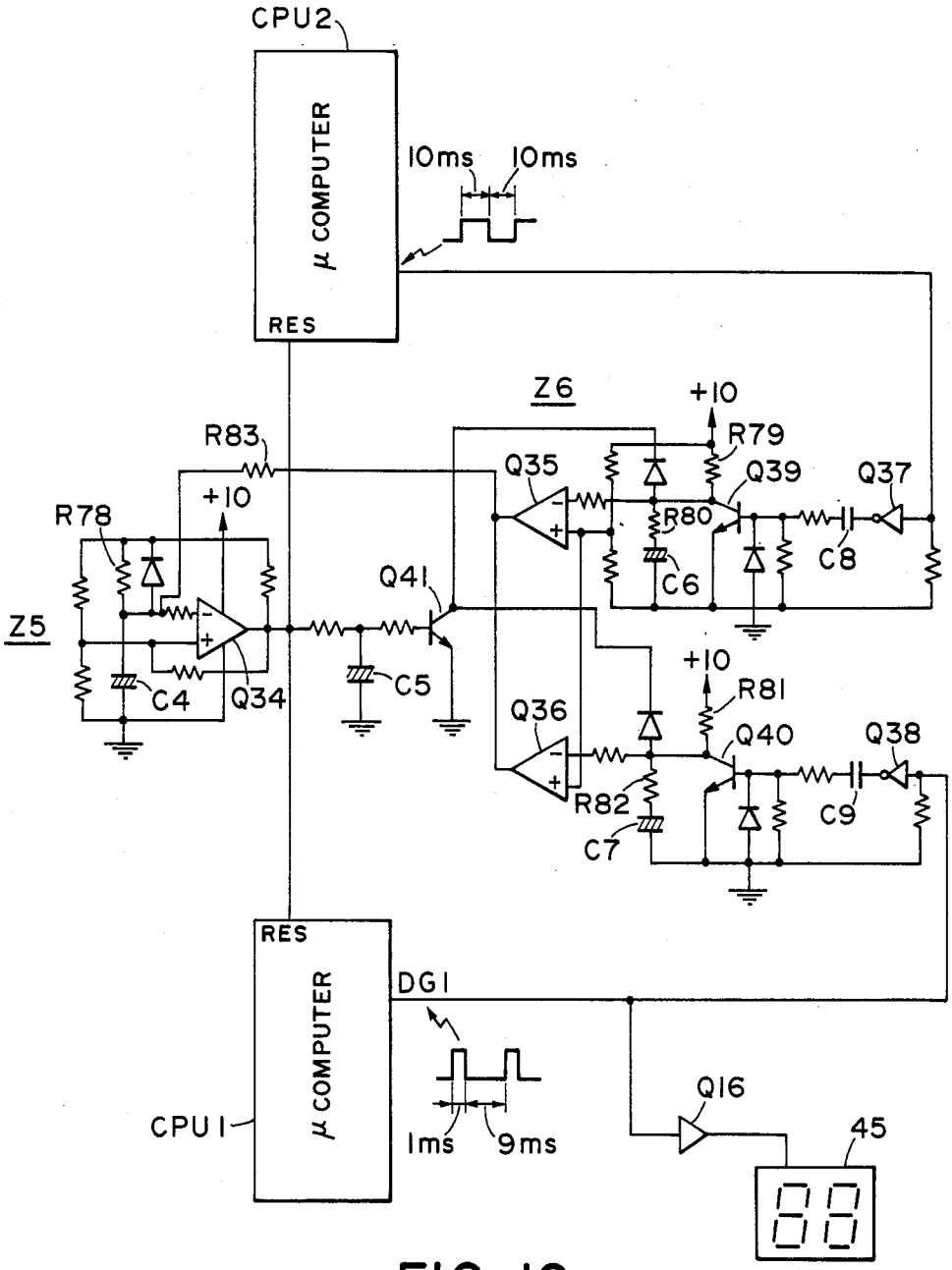
FIG. 19 shows a circuit diagram of a computer resetting circuit.

FIG. 19 shows the microcomputer failure detecting circuit and the resetting circuit shown in FIG. 8.

As explained before, the CPU1 constantly releases the digit signal DG1 with a duration of 1 msec and a duty ratio of 1/10, as shown in FIG. 10.

In the flow chart shown in FIG. 20-3, the signal DG1 is turned on (C204) for executing the display (C205) and is turned off after 1 msec. (C206). Also a similar procedure is conducted in the steps C222, C223 in FIG. 20-4.

Also the CPU2 releases a signal with a duration of 10 msec. and with a duty ratio of ½ according to the subroutine program SBTiME shown in FIGS. 21-1 to 21-5. In this subroutiner a 10 msec. counter provided in the RAM is started (C251) and checked (C252). If 10 msec. has not elapsed the program returns to the main routine. After the lapse of 10 msec., the counter is reset and the output of the oscillator is checked (C253). The output of the oscillator is turned off if it exists, and vice versa (C254), and the program returns to the main routine (C255). The above-mentioned signal of 10 msec. is generated in this manner.

The above-mentioned signals from the CPU1 and CPU2 are differentiated through MOS inverters Q37, Q38. In the normal function of the CPU1, a transistor Q40 is repeated turned on and off, so that a condenser C7 is not charged to turn off a comparator Q36. However, in case of a failure in the CPU1, the above-mentioned pulses are no longer supplied to turn off the transistor Q40. Thus the condenser C7 is charged to turn on the comparator Q36, thus discharging a condenser C4 in the resetting circuit and supplying a reset signal to the reset port RES of the microcomputers CPU1, CPU2. At the same time a condenser C5 is charged to turn on a transistor Q41 after a determined time. Thus the condenser C7 is again discharged to turn off the comparator Q36, thus clearing the resetting circuit. The same process applied also in case of a failure in the CPU2. In this manner both microcomputers are reset to the initial state when at least one of the microcomputers shows a failure. In said resetting the CPU1 and CPU2 again execute the programs from the initial reset step. In this manner it is rendered possible to prevent errors resulting from a failure in a microcomputer by resetting all the microcomputers.

Upon actuation of the interruption key, the program proceeds to the steps C52, C56 through the subtraction routine (C207) if the copying cycle in progress is before the reversing of the optical system, or through the step C50 if the copying cycle is in progress after the reversing of the optical system. Then the steps C52, C53, C55 or C56–C58 are executed to divert the numbers of the counter and set memory into other areas of the RAM and to set "1" in the memory area of the RAM. Then the CPU1 proceeds to the subroutine (7), and, since the signal S is at the L-level, releases the manual insertion copy enable signal W under the conditions that the circuit Z3 is not in the jam state, that the waiting process is completed and that the toner and the key counter are present, thereby enabling the CPU2 for the manual insertion copying.

The manual insertion copying is also possible when the numeral keys are actuated to instruct a continuous copying operation, following the actuation of the interruption key.

Upon completion of the interruption copying, the diverted numbers are revived and the copy count, before the interruption, is displayed. In this case the display does not return to "1" as the clear timer is not checked.

Now there will be explained the control by the position sensors for the optical system.

Figure 23:
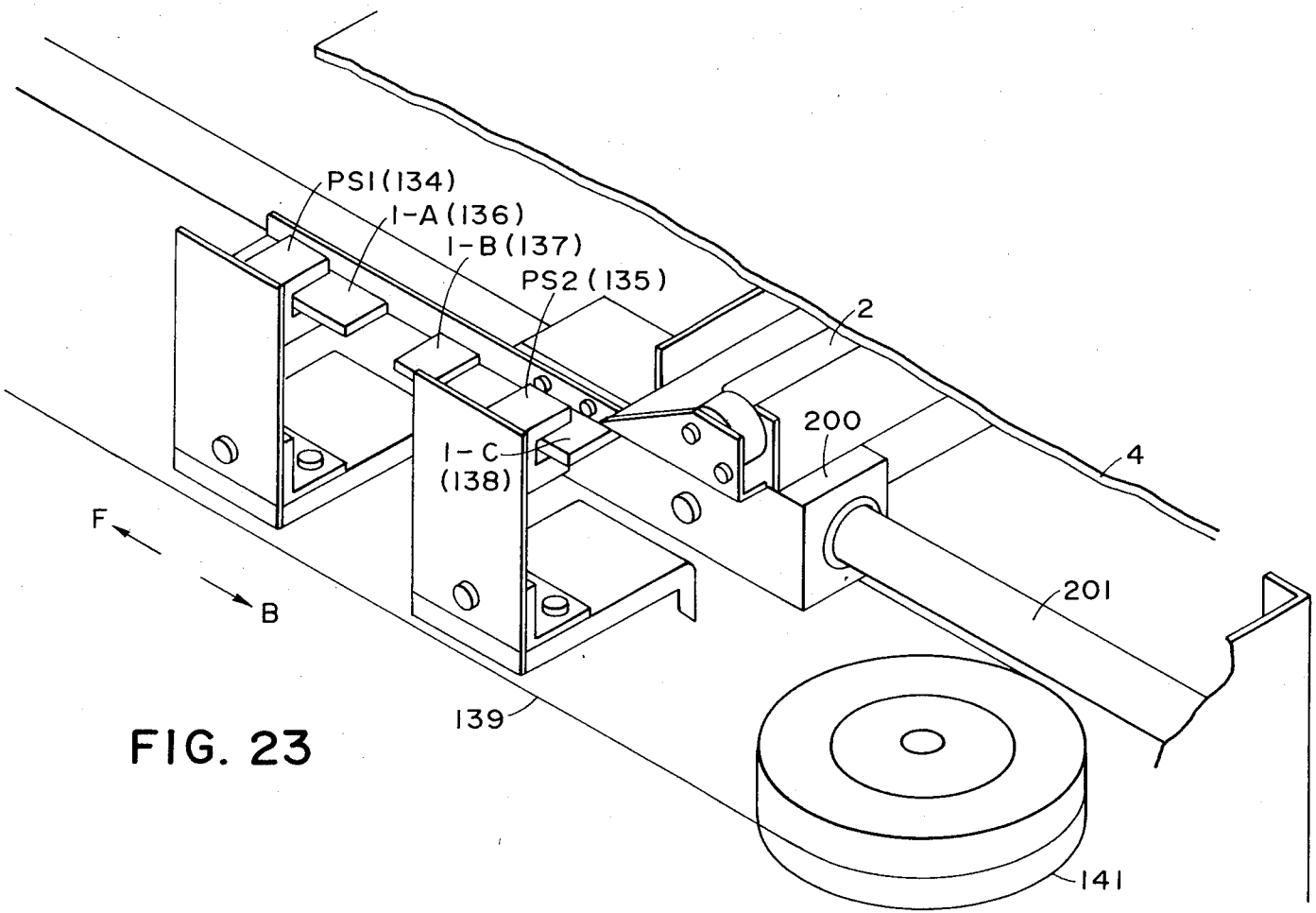
FIG. 23 shows a detailed perspective view of detection signal generating devices.

FIG. 23 shows the signal generating means in a perspective view, including light-shielding plates 1-A, 1-B and 1-C; photointerrupters PS1, PS2 adjustable in the mirror moving direction; an exposure lamp 2; an original carriage 4; and a lamp support 200 to be displaced in the forward direction (F) or backward direction (B) along a rail 201 by means of a wire. In the home position of the optical system the shiled 1-C is detected by the photointerrupter PS2 as shown in FIG. 23.

Figure 24:
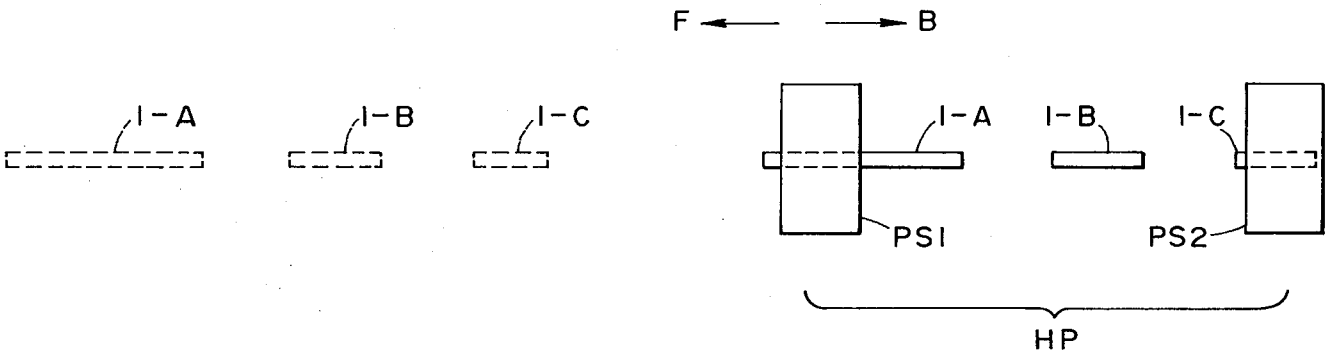
FIG. 24 shows a schematic view showing the positional relationship of the detection signal generating devices shown in FIG. 23.

The positional relationship between the photointerrupters PS1, PS2 and the shields 1-A, 1-B, 1-C is shown in FIG. 24, wherein HP represents the home position of the optical system. The shield 1-A is longer than 1-C and is so positioned that it activates the photointerrupter PS1 in the backward motion of the optical system before said photointerrupter PS1 is activated by the shield 1-C. Also the positional relationship is such that, in the forward motion of the optical system the shield 1-C passes the photointerrupter PS2 before the shield 1-A passes the photointerrupter PS1.

The shields 1-A, 1-B and 1-C are independently adjustable in the moving direction of the mirrors, so that the timing of activating the photointerrupters can be suitable modified.

Figure 25:
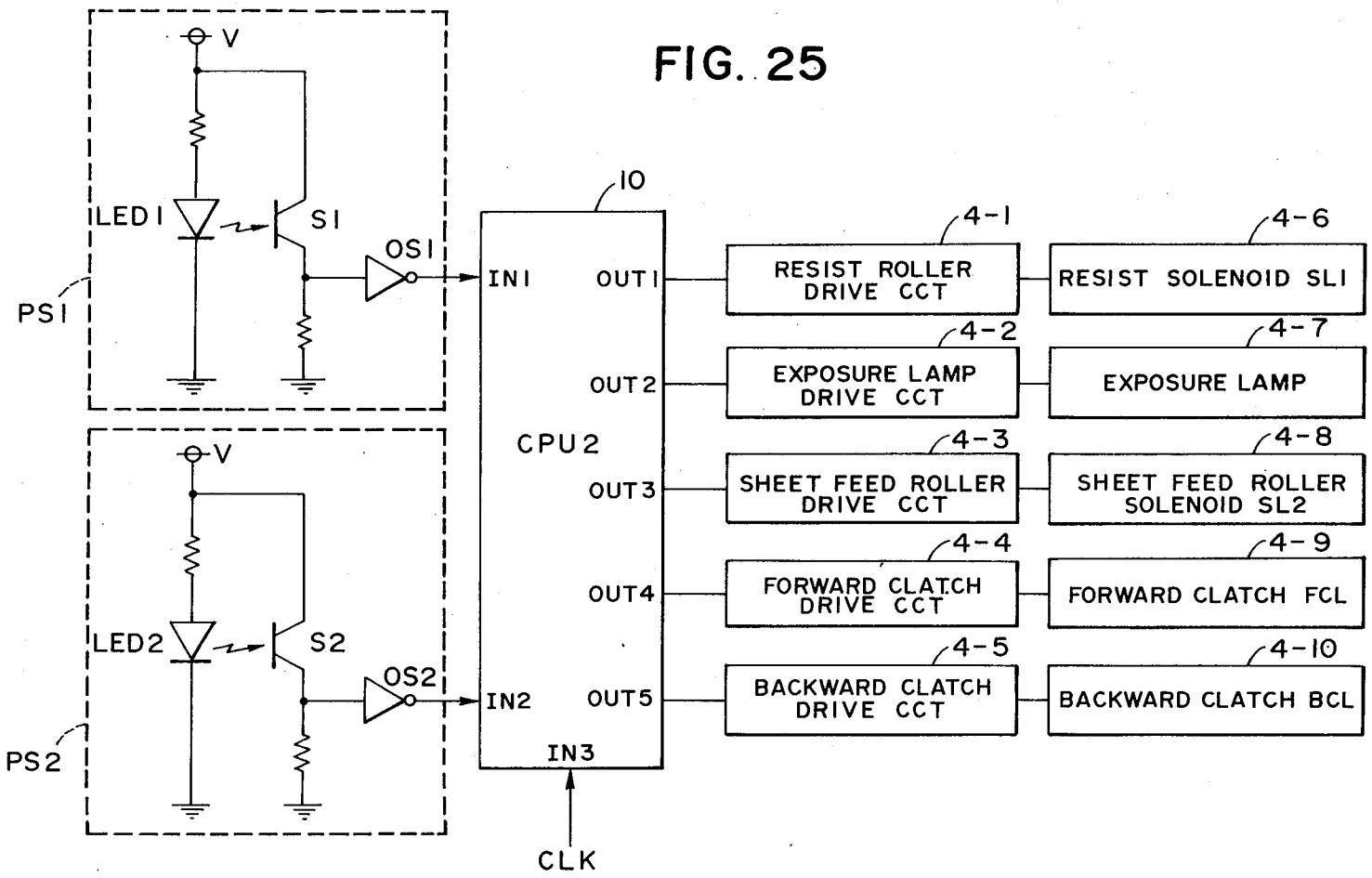
FIG. 25 shows a block diagram of the control circuit embodying the present invention.

FIG. 25 is a block diagram of the control circuit based on the detection signal OS1 from the photointerrupter PS1, the detection signal OS2 from the photointerrupter PS2 and the drum clock pulses CLK.

In FIG. 25 there are shown photointerrupters PS1, PS2; detection signals OS1, OS2 respectively from said photo-interrupters; a one-chip microcomputer CPU2 for example composed of the μCOM43 supplied by NEC; a registering roller drive circuit 4-1; a registering solenoid SL1; an exposure lamp drive circuit 4-2; an exposure lamp LAMP; a feed roller drive circuit 4-3; a feed roller solenoid SL2; a forward clutch drive circuit 4-4; a forward clutch 4-9 (FCL); a backward clutch drive circuit 4-5; and a backward clutch 4-10 (BCL).

In response to said detection signals OS1, OS2 supplied to input ports IN1, IN2 and said drum clock pulses CLK supplied to an input port IN3, the microcomputer CPU2 controls the registering roller 37, exposure lamp LAMP, feed roller 40, forward clutch FCL and backward clutch BCL according to the control programs stored in the ROM.

In the following explained is the signal generating functions of the photointerrupters PS1 and PS2.

The following embodiment is applied to a copier with a fixed original carriage, although a same effect can be obtained in a copier with a movable original carriage.

The photointerrupters PS1, PS2 fixed positioned provide L-level signals upon receiving power supply to light the light-emitting diodes. In the course of displacement of the optical system during the copying cycle, the shields 1-A, 1-B and 1-C interrupt the light from the light-emitting diodes to generate H-level signals OS1, OS2 from the photointerupters.

Figure 26:
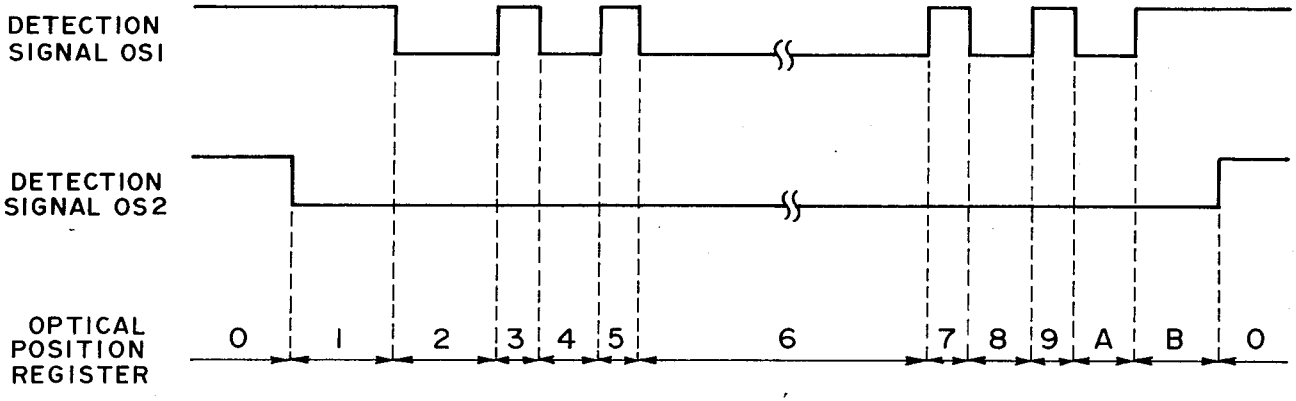
FIG. 26 shows a timing chart showing the relationship between the detection signals and an optical position register.

The timing of the control function of the CPU2, based on the detection signals OS1, OS2 and the drum clock pulses CLK, is determined by the content of a 4-bit register provided in the CPU2. FIG. 26 shows the counting operation of said 4-bit register, called optical position register OPRG, which is increased stepwise upon detection of the leading or trailing end of the detection signals OS1, OS2 from the photointerrupters The content of said register OPRG is zero when the optical system is at the home position and is advanced stepwise in the order 0, 1, 2, . . . , 9, A, B to indicate 12 states by the detection of the leading and trailing ends of the detection signals.

Figure 27:
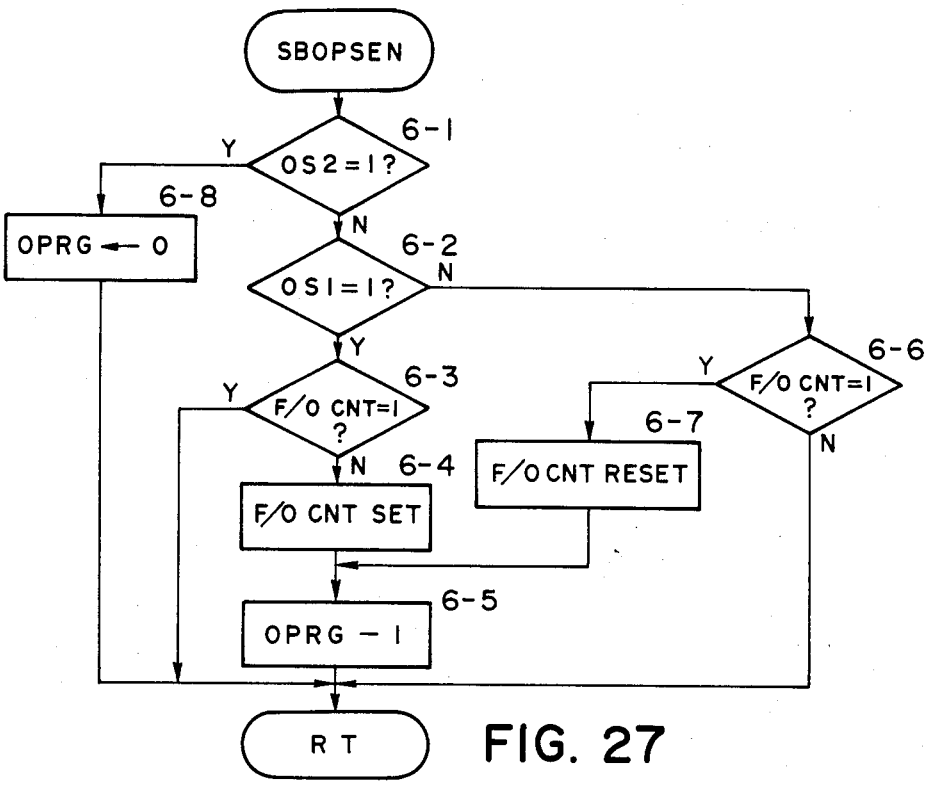
FIG. 27 shows a flow chart showing a subroutine for addition control in said optical position register.

FIG. 27 shows the subroutine SBOPSEN for controlling the adding operation of said optical position register OPRG. In this subroutine, a step 6-1 identifies if the detection signal OS2 is at the H-level, indicating the presence of the optical system at the home position, with the shield 1-C positioned in the photointerrupter PS2. If PS2=1, the program proceeds to a step 6-8 to reset the content of said register OPRG and the subroutine is terminated. If PS2≠1 in the step 6-1, the program proceeds to a step 6-2. If OS1=1 indicating the presence of a shield in the photointerrupter PS1, the program proceeds to a step 6-3 for identifying a count flag F/OCNT which is set or reset respectively at the leading end or trailing end of the detection signal OS1 or OS2. If said flag is not set in the step 6-3, the CPU2 identifies a new detection of a leading end and proceeds to a step 6-4 for setting the flag F/OCNT and then to a step 6-5 for step advancing the optical position register OPRG, thus terminating the subroutine SBOPSEN. Also if the count flag F/OCNT is already set in the step 6-3, the CPU2 identifies the absence of a new leading end of the detection signal OS1 and terminates the subroutine without altering the content of the optical position register OPRG. Also if OS1≠1 in the step 6-2 indicating the absence of a shield in the photointerrupter PS1, the CPU2 proceeds to a step 6-6 for checking the count flag F/OCNT. If said flag is not set, indicating the absence of a new trailing end of the detection signal OS1, the subroutine is terminated without altering the content of the optical position register OPRG. Also if the count flag F/OCNT is already set in the step 6-6, the CPU2 identifies the detection of a new trailing end and proceeds to a step 6-7 for resetting said count flag, then to a step 6-5 for step increment of the optical position register OPRG, thus terminating the subroutine. In the above-mentioned manner the subroutine SBOPSEN increases the content of the optical position register in response to the leading and trailing ends of the detection signals.

Figure 28:
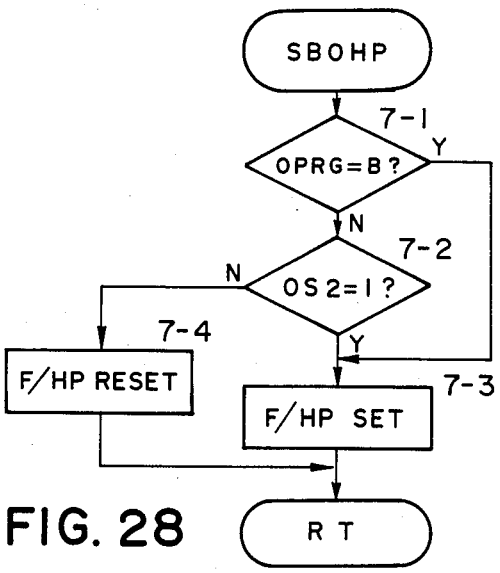
FIG. 28 a flow chart showing a subroutine for detecting the home position of the optical system.

FIG. 28 shows a control subroutine SBOHP for detecting the presence of the optical system at the home position. As explained before, the content of the optical position register OPRG is reset to zero when the optical system is returned to the home position. However, if the scanning is started while the optical system is not in the home position for some reason, the sequence control will be in error as the content of the optical position register OPRG does not correspond to the actual position of the optical system. For this reason the home position is detected by the subroutine SBOHP. At first a step 7-1 identifies if the content of the optical position register OPRG is "B", and, if so, the program proceeds to a step 7-3 for setting a home position flag F/HP. If it is not "B", the program proceeds to a step 7-2 for checking the detection signal OS2. If OS2="1" indicating the presence of the shield 1-C at the photointerrupter PS2 or the presence of the optical system at the home position HP, the program proceeds to a step 7-3 for setting the home position flag F/HP. In this manner the home position flag F/HP is set either when the optical position register OPRG has a content "B" or when the photointerrupter PS2 releases the detection signal OS2. Also if the detection signal OS1≠1, a step 7-4 is executed to reset the home position flag F/HP.

As explained above, the increment of the optical position register and the home position detection are executed by the above-mentioned two subroutines SBOPSEN and SBOHP.

Figure 29:
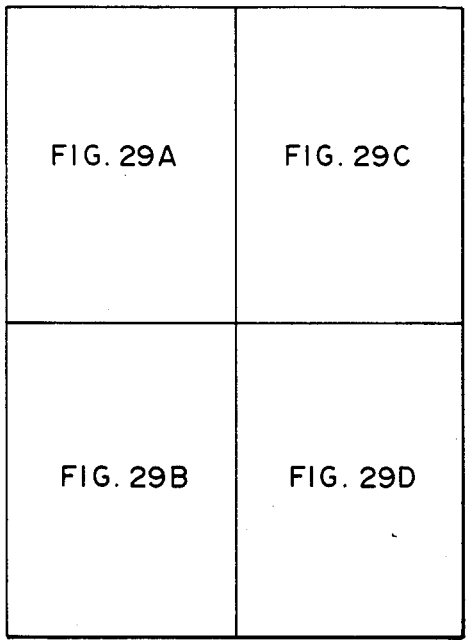
FIG. 29 shows a combination relationship between FIGS. 29A, 29B, 29C and 29D.
Figure 30:
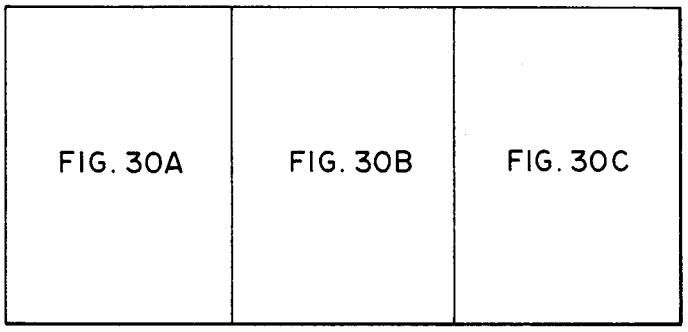
FIG. 30 shows combination relationship between FIGS. 30A, 30B and 30C.
Figure 29A:
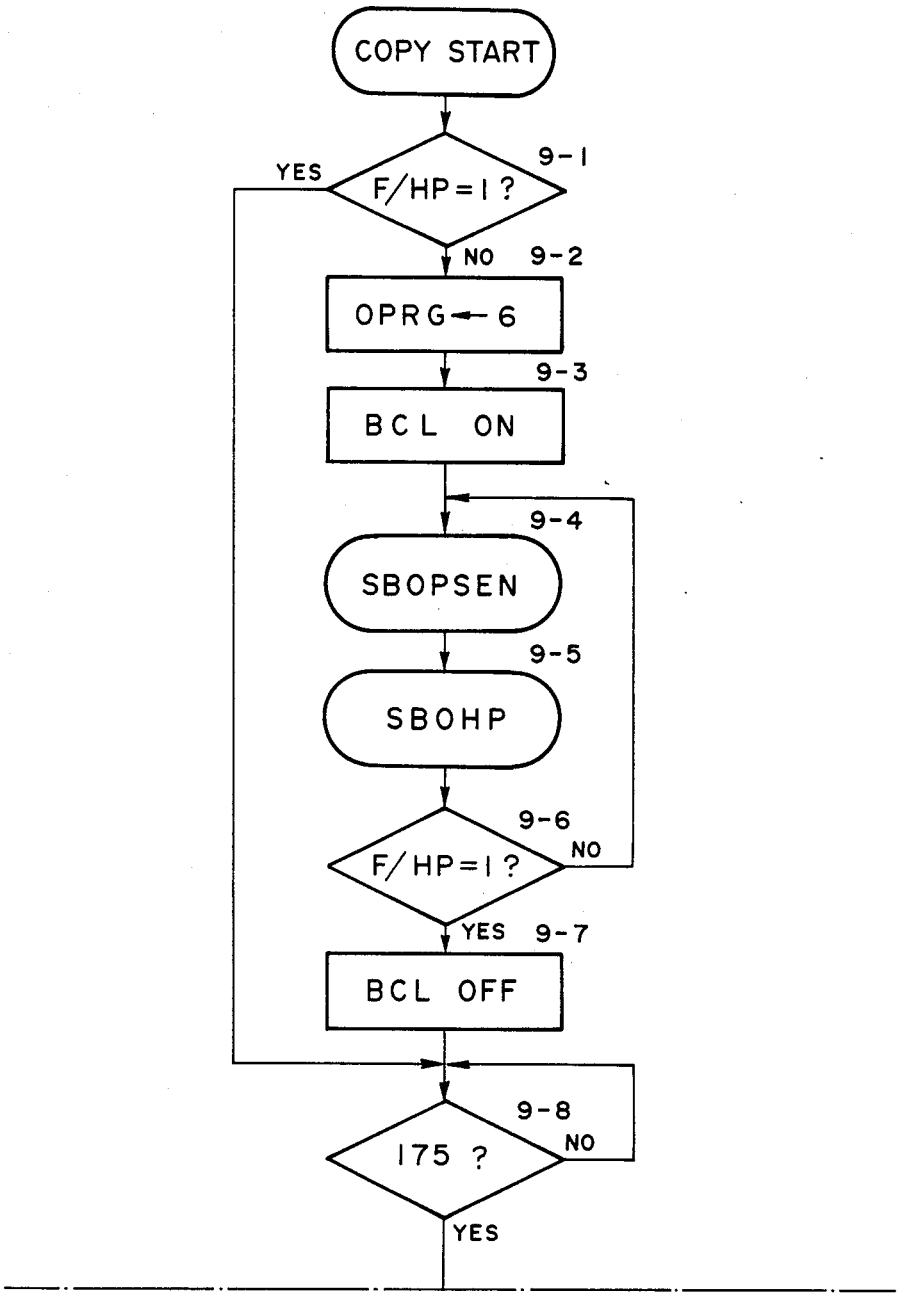
FIGS. 29A, 29B, 29C and 29D show a flow chart for function control of the copier.
Figure 29B:
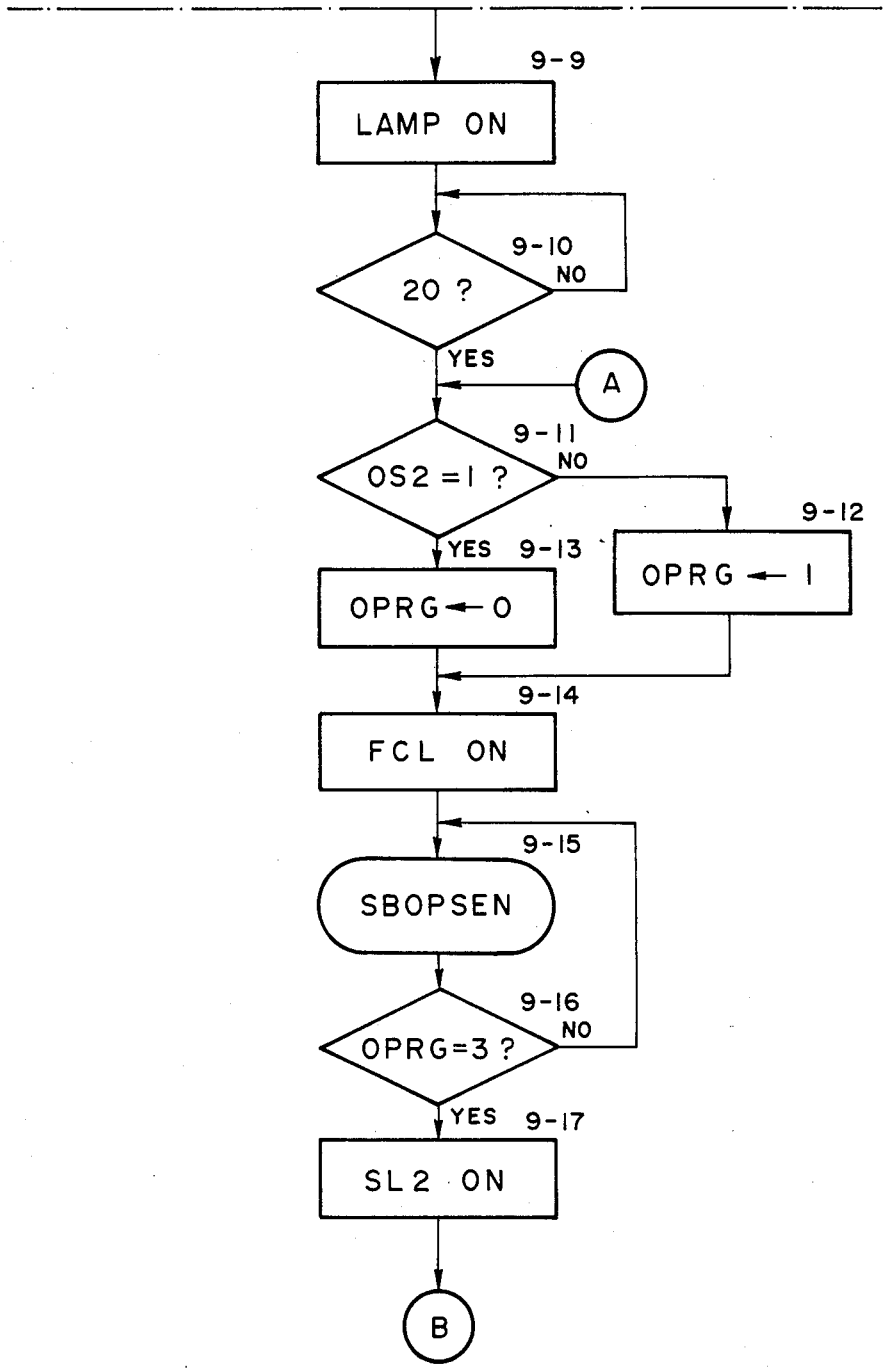
Figure 29C:
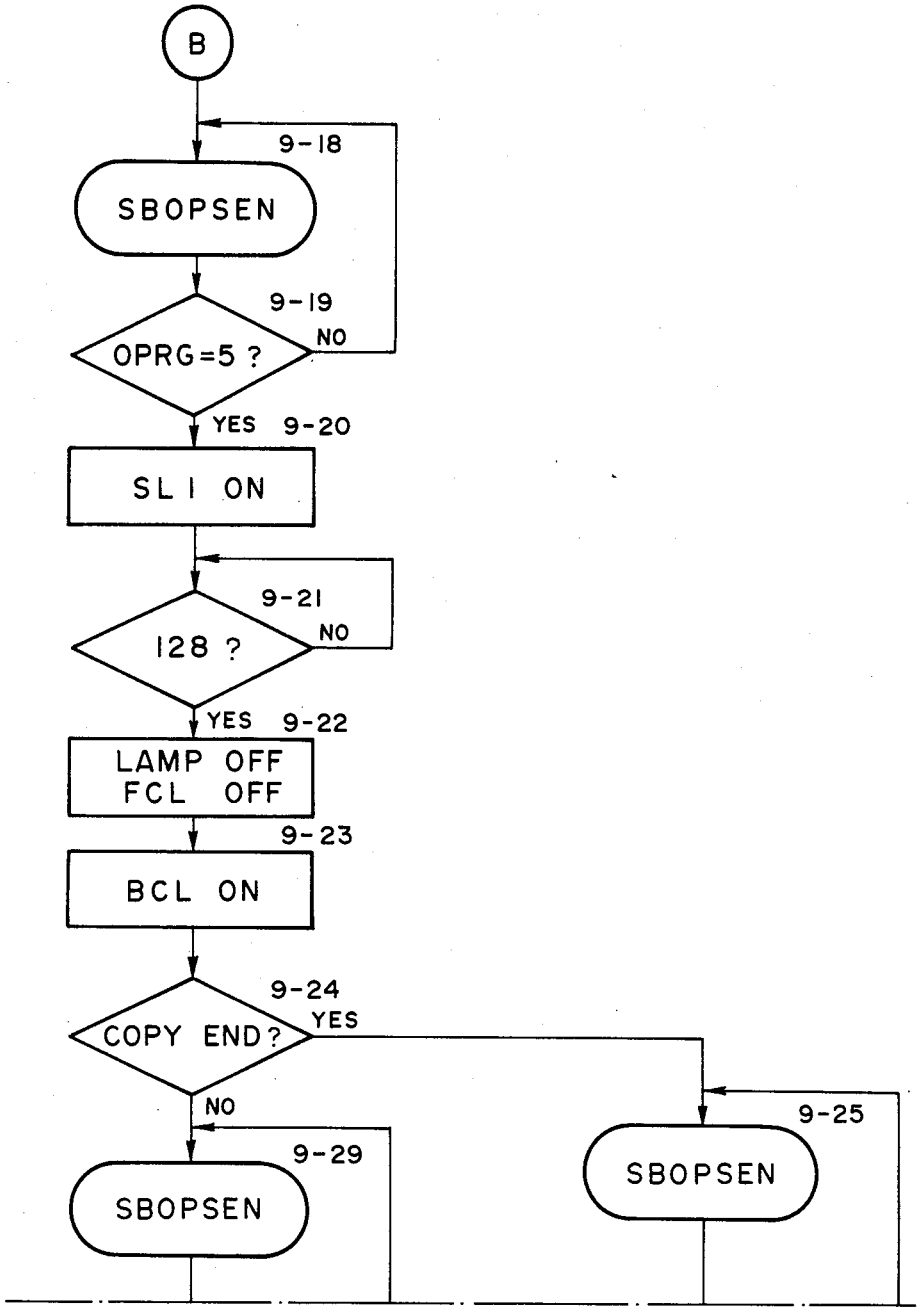
Figure 29D:
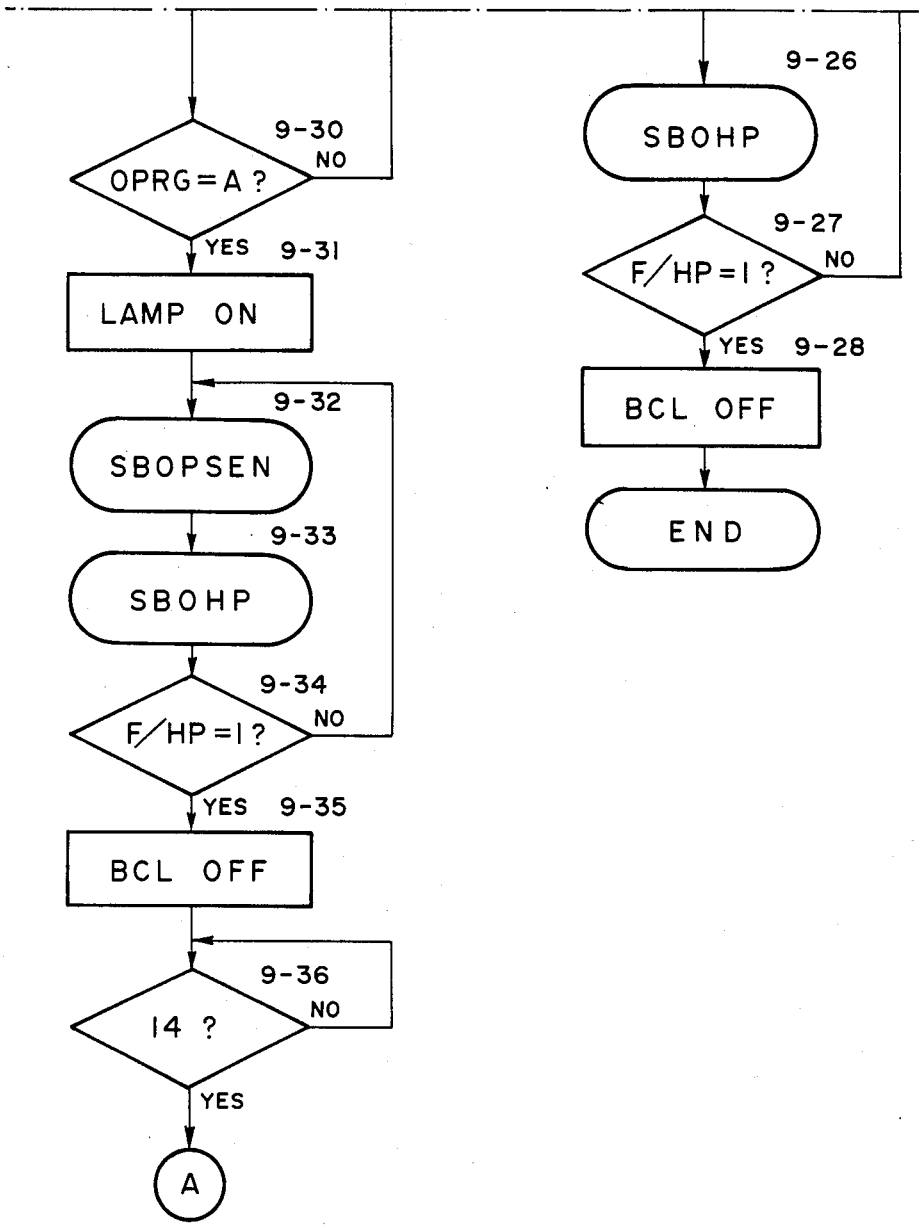

FIG. 29 shows a control flow chart, utilizing the above-mentioned subroutines, for a copier controlled by the detection signals OP1, OP2 from the photointerrupters PS1, PS2 and the drum clock pulses CLK. This flow chart corresponds to that shown in FIG. 21. Also FIG. 30 shows a timing chart of the various parts of the copier controlled according to said flow chart, said timing chart corresponding to that shown in FIG. 4. FIG. 30 shows a case of two consecutive copying cycles.

In the following given is the details of the function control.

At first the stand-by state is attained by turning on of the power supply. In response to the copy start signal, a step 9-1 in FIG. 29 identifies if the home position flag F/HP is set. If said flag is already set indicating the presence of the optical system at the home position, the program proceeds to a step 9-8. On the other hand if said flag is not set indicating the absence of the optical system at the home position, a step 9-2 is executed to set "6" in the optical position register, wherein said value "6" corresponds to a position farthest from the home position. Then a step 9-3 is executed to activate the backward clutch BCL, thus reversing the optical system. At a subsequent step 9-4 executed is the aforementioned subroutine SBOPSEN for the increment of the optical position register OPRG, and then in a step 9-5 executed is the subroutine SBOHP for detecting the presence of the optical system at the home position. A subsequent step 9-6 checks if the home position flag F/HP has been set. The program returns to the step 9-4 if said flag is not set, or proceeds to a step 9-7 if said flag is set. As expalined before, the home position flag F/HP is set either when the optical position register OPRG is set to "B" by the function of the shield 1-A in combination with the photointerrupter PS1 or when the photointerrupter PS2 is activated regardless of the optical position register OPRG. Then the backward clutch BCL is turned off in the step 9-7, and the program proceeds to a step 9-8. Said backward clutch BCL can be turned off in two timings, in the similar manner as the setting of said home position flag F/HP. Even after the backward clutch is turned off, the optical system continues backward motion over a certain distance by the inertia, and the home position is determined at a position where the optical system stops over said distance by inertial displacement. The photointerrupters PS1, PS2 are so positioned that the photointerrupter PS2 is actuated by the shield 1-C when the optical system is finally stopped. In this manner, in the present embodiment, the backward clutch BCL is not switched off when the optical system arrives at the home position but at a timing determined from the content "B" of the optical position register OPRG in turn determined by the detection signal OS1 of the photointerrupter PS1 in consideration of the inertial displacement of the optical system after the backward clutch BCL is switched off, and the arrival of the optical system at the home position is verified by the photointerrupter PS2. Also the backward clutch BCL is unconditionally switched off if the photointerrupter is actuated by the shield 1-C before the content of the optical position register OPRG reaches "B". Then, a step 9-8 counts 175 clock pulses, corresponding to approximately one turn of the drum; a step 9-9 turns on the exposure lamp; a step 9-10 counts further 20 clock pulses; and a step 9-11 identifies if the detection signal OS2 is at the H-level, indicating the presence of the optical system at the home position. If so, the optical position register OPRG is reset in a step 9-13 and the program proceeds to a step 9-14. However, if OS2≠1 in the step 9-11, the optical system is stopped at a position slightly in front of the position in which the shield 1-C interacts with the photointerrupter PS2. In such case the optical position register OPRG is set to "1" in a step 9-12 and the program proceeds to the step 9-14. Although at the true home position of the optical system the shield 1-C should be positioned in the photointerrupter PS2, the succeeding scanning cycle can be conducted without trouble even when the optical system is positioned slightly in front of said home position. For this reason the optical position register OPRG is set to "1" to prepare for the succeeding advancement of the optical system. As explained in the foregoing, the backward clutch BCL for reversing the optical system is switched off when the optical position register OPRG attains a value "B", i.e. when the photointerrupter PS1 detects the shield 1-A, and the photointerrupter PS1 and the shield 1-A are positioned in consideration of the inertial displacement of the optical system after the backward clutch BCL is switched off. Thus the optical system moves only by inertia in the vicinity of the home position and can be easily stopped mechanically with little vibration. Also exact position control is achieved by two photointerrupters which respectively perform the switching-off of the backward clutch BCL and the detection of home position. Even if the shield 1-C is not detected by the photointerrupter PS2, the resulting positional error is very small and in fact negligible for the scanning motion, and the correct process timing is ensured also in such case as the scanning is initiated after the optical position register is set to "1". Stated differently, in the present embodiment there exist two home positions; the shield 1-C being in the photointerrupter PS2 in the first home position, while the shield 1-C being positioned in front of the photointerrupter PS2 in the second home position. However these two home positions are mutually very close, so that the scanning motion can be started from either home position, and the exact process control is ensured by the content of the optical position register corresponding to the actual position of the optical system.

A subsequent step 9-14 turns on the forward clutch FCL to initiate the forward motion of the optical system, thus starting the scanning of the original document. Then in a step 9-15 executed is the subroutine SBOPSEN for the increment of the optical position register OPRG according to the detection signals OS1, OS2. A step 9-16 identifies if the content of the optical position register OPRG is equal to "3", and a step 9-17 turns of the feed roller solenoid SL2 to advance the copy sheet from the cassette to a determined position. Said value "3" always corresponds to a fixed position since the optical position register OPRG is set to "0" or "1" at the start of forward motion according to the position of the optical system. Then, a step 9-18 executes the subroutine SBOPSEN; a step 9-19 identifies if the content of the optical position register OPRG is equal to "5"; a step 9-20 turns on the registering solenoid SL1 to advance the copy sheet to the image transfer position; a step 9-21 counts 128 clock pulses from the energization of the solenoid SL1, corresponding to the period required for scanning of an A 4-sized original; a step 9-22 turns off the exposure lamp LAMP and the forward clutch FCL; and a step 9-23 turns on the backward clutch BCL. At this point the scanning of the original is completed, and the optical system initiates the backward displacement. Then a step 9-24 identifies if the copying operation is completed; if so a step 9-25 executes the subroutine SBOPSEN for increment of the optical position register OPRG according to the detection signals OS1, OS2; a step 9-26 executes the subroutine SBOHP to identify if the optical system is at the home position; a step 9-27 identifies if the home position flag F/HP is already set; and a step 9-28 turns off the backward clutch BCL to terminate a copying cycle. Thereafter the program proceeds to the post-rotation step shown in FIG. 8. At this point the optical system still continues inertial displacement and stops thereafter at the home position. Also in case of a continuous copying operation the program proceeds from the step 9-24 to a step 9-29 for executing the subroutine SBOPSEN for the increment of the optical position register OPRG. Then a step 9-30 identifies if the content of said optical position register OPRG is equal to "A"; a step 9-31 again turns on the exposure lamp; a step 9-32 executes the subroutine SBOPSEN for the increment of the optical position register OPRG according to the detection signals; a step 9-33 executes the subroutine SBOHP to identify if the optical system is at the home position; a step 9-34 sets the home position flag F/HP; a step 9-35 turns off the backward clutch BCL; and the program proceeds to a step 9-36. At this point the optical system still continues the inertial displacement to the home position. However the optical system may be eventually stopped immediately in front of the home position as the inertia is not constant. In order to cope with such situation, the steps 9-11, 9-12 and 9-13 are provided for identifying the detection signal OS2 at the start of scanning motion and for setting the optical position register OPRG, and said setting ensures that the content of said register OPRG corresponds to the actual position of the optical system during the forward displacement. Then, after the backward clutch BCL is turned off in a step 9-36, and a 14-count of the clock pulses, the program returns to (A) to initiate the second copying cycle.

It is possible also to execute the routine from the step 9-1 to 9-7 in response to turning on the main switch, and to repeat said routine when the copying operation is restarted after the jam state is resolved without turning off the main switch.

The detection system explained above allows reduction of the vibration resulting when the optical system is stopped and to perform exact position detection for the optical system. Also it is rendered possible to start the scanning motion exactly even when the optical system is not in the determined position for some reason.

Furthermore, the present invention is also applicable to other image forming apparatus, such as an image reading apparatus utilizing a solid-state scanning device or a facsimile apparatus.

What we claim is:

1. An image forming apparatus utilizing process sequence control for image formation with plural computers, comprising:

input means for entering an instruction signal for image formation;

a first computer for receiving the signal from said input means;

malfunction detecting means adapted for interrupting the image formation to inhibit the signal entry into said first computer from numeral keys and/or copy mode keys;

a second computer adapted for interrupting the image formation process in response to said malfunction detecting means; and transmission means composed of a plurality of transmission lines, for transmitting data from said second computer to said first computer, said transmission means being utilized for the transmission of both a signal for indicating a process cycle and a signal for indicating a disabled image formation, said disabled image formation signal being transmitted in parallel through the transmission means.

2. An image forming apparatus according to claim 1, wherein said signal entry by said keys is enabled after a malfunction detected by said malfuction detecting means is removed.

3. An image forming apparatus according to claim 1, wherein said disabled image formation signal includes jam correction signals.

4. An image forming apparatus according to claim 1, further comprising resetting means for resetting said first and second computers when a said malfunction is detected.

5. An image forming apparatus utilizing process sequence control for image formation with plural computers, comprising:

a power switch for supplying power to a plurality of image formation process means;

key switches for inputting plural data for image formation;

a first computer for receiving the signals from said key switches and processing said data; and a second computer for controlling the data processing;

wherein image formation data set by said key switches is returened to standard formation data by said first computer after the lapse of a predetermined period, form the completion of image formation, and the power supply to at least one of said image forming means is interrupted by said second computer after the lapse of a predetermined period from the completion of image formation.

6. An image forming apparatus according to the claim 5, further comprising, transmission means composed of a plurality of transmitting lines, said transmission means being provided between the first computer and said second computer and being utilizable for the transmission of the signal for indicating a process cycle.

* * * * *

UNITED STATES PATENT AND TRADEMARK OFFICE

CERTIFICATE OF CORRECTION

PATENT NO. : 4,758,860

DATED : July 19, 1988

INVENTOR(S) : YOSHIAKI TAKAYANAGI, ET AL.

It is certified that error appears in the above-identified patent and that said Letters Patent is hereby corrected as shown below:

AT [57] IN THE ABSTRACT

Line 10, "comprising" should read --made up of--.

IN THE DRAWINGS

Figure 4A:
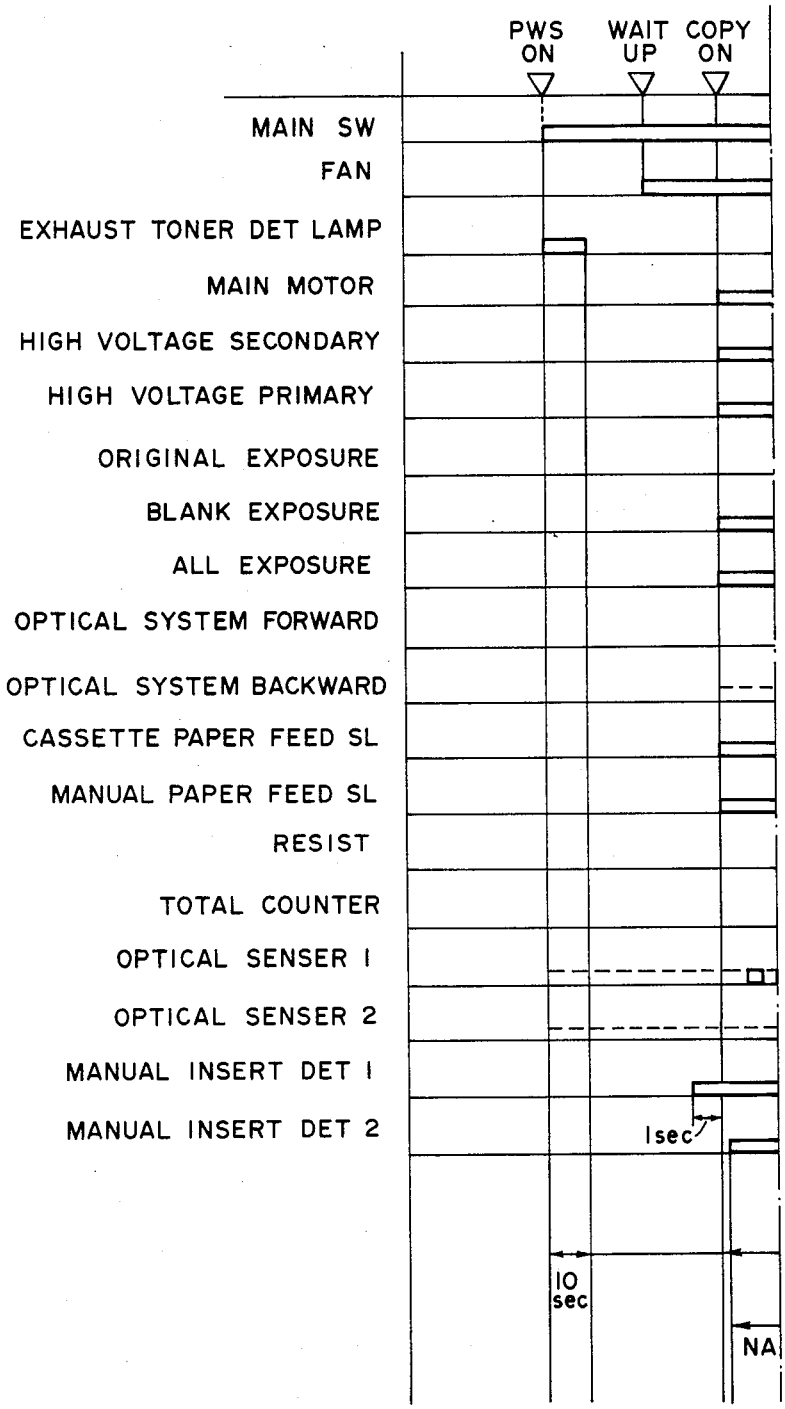
FIGS. 4A, 4B and 4C show a timing chart representing the functions of the apparatus shown in FIG. 1.
Figure 4B:
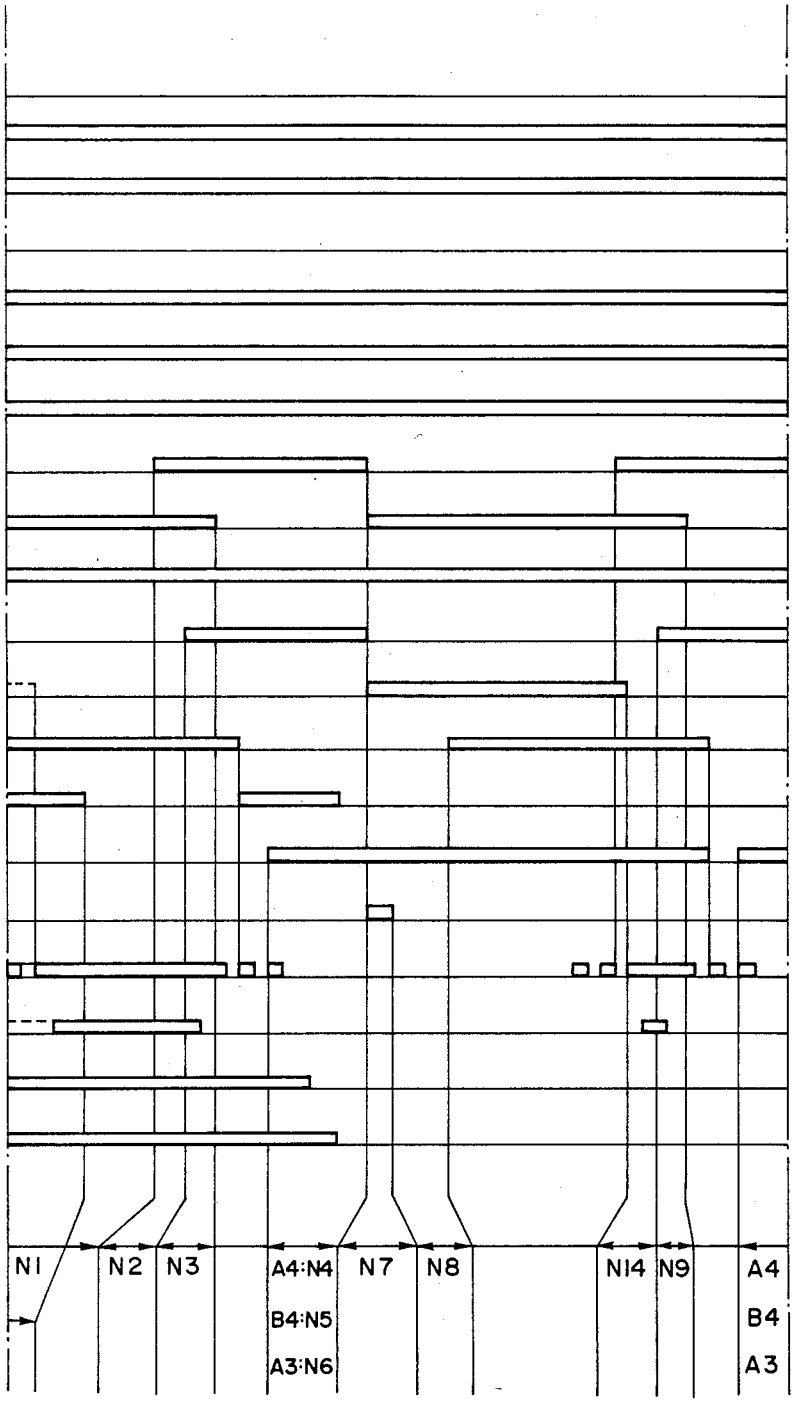
Figure 4C:
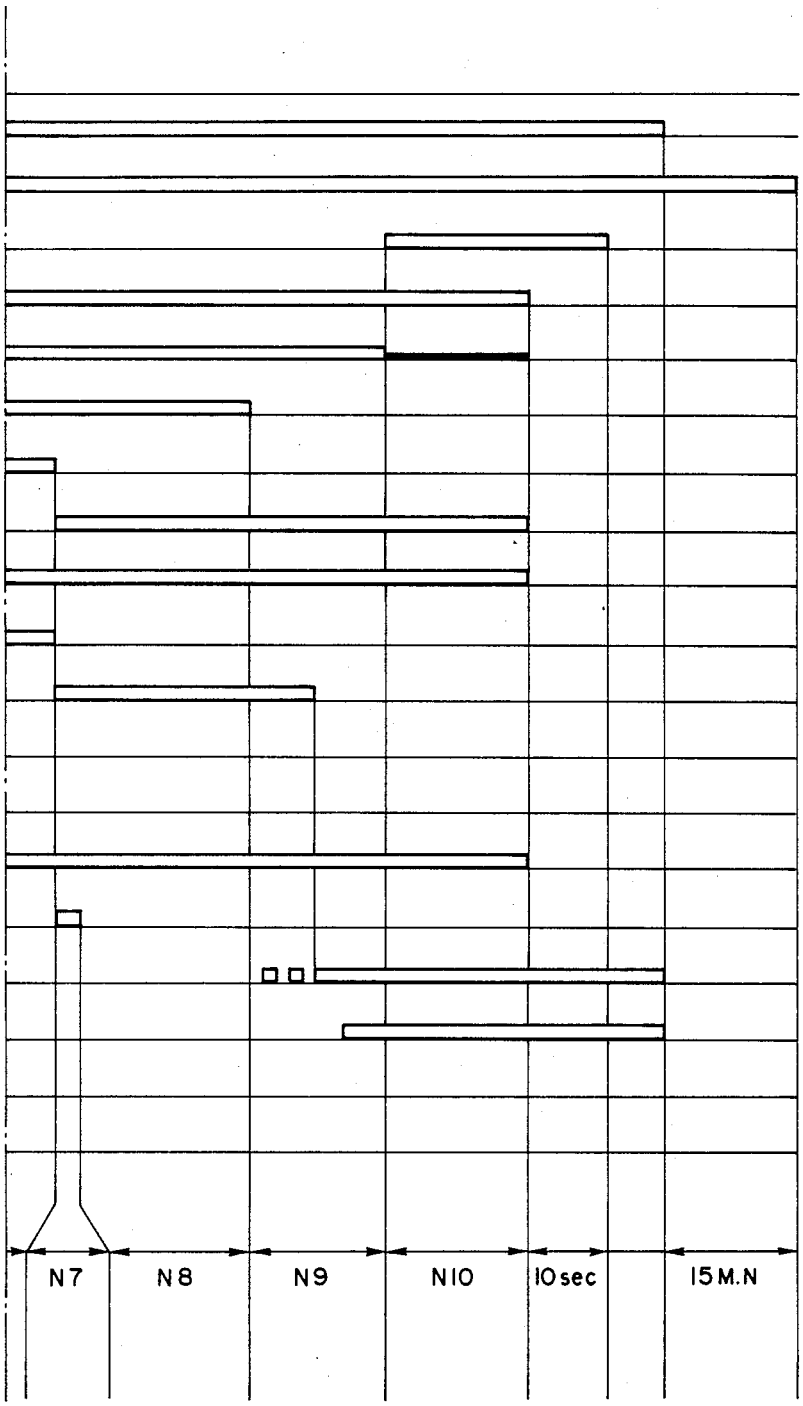
Figures 1B, 20:
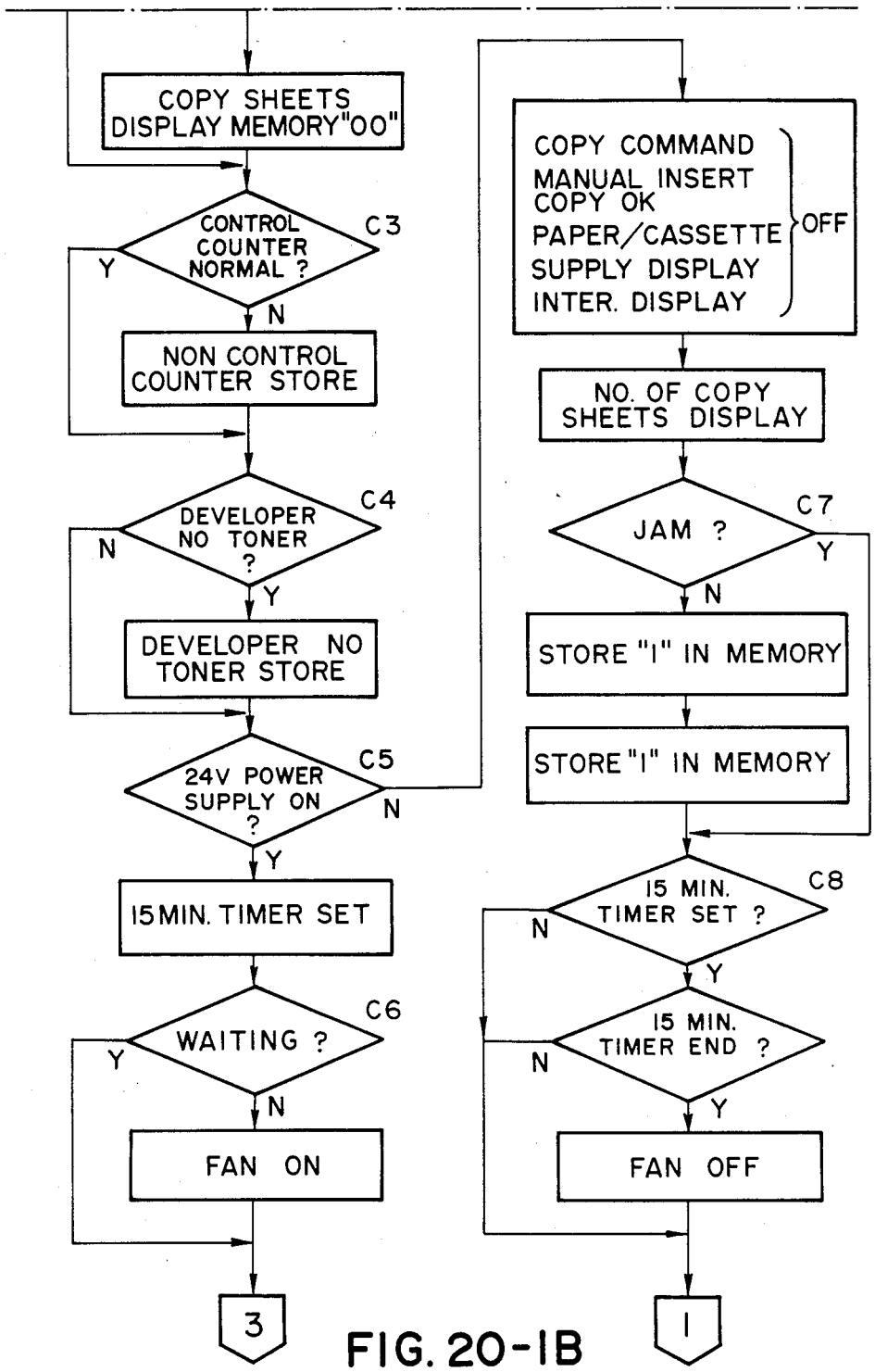
Figures 1C, 20:
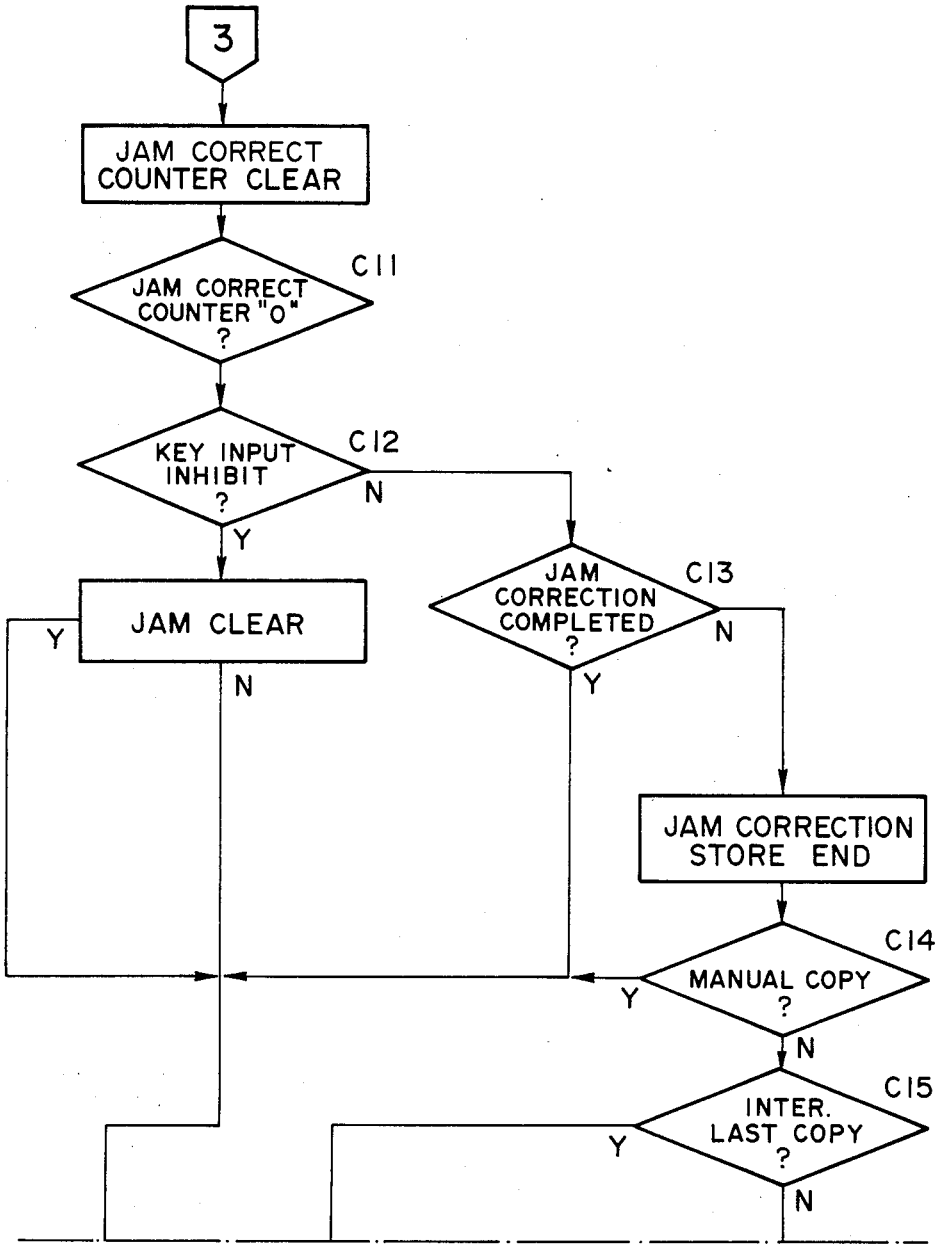
Figures 1D, 20:
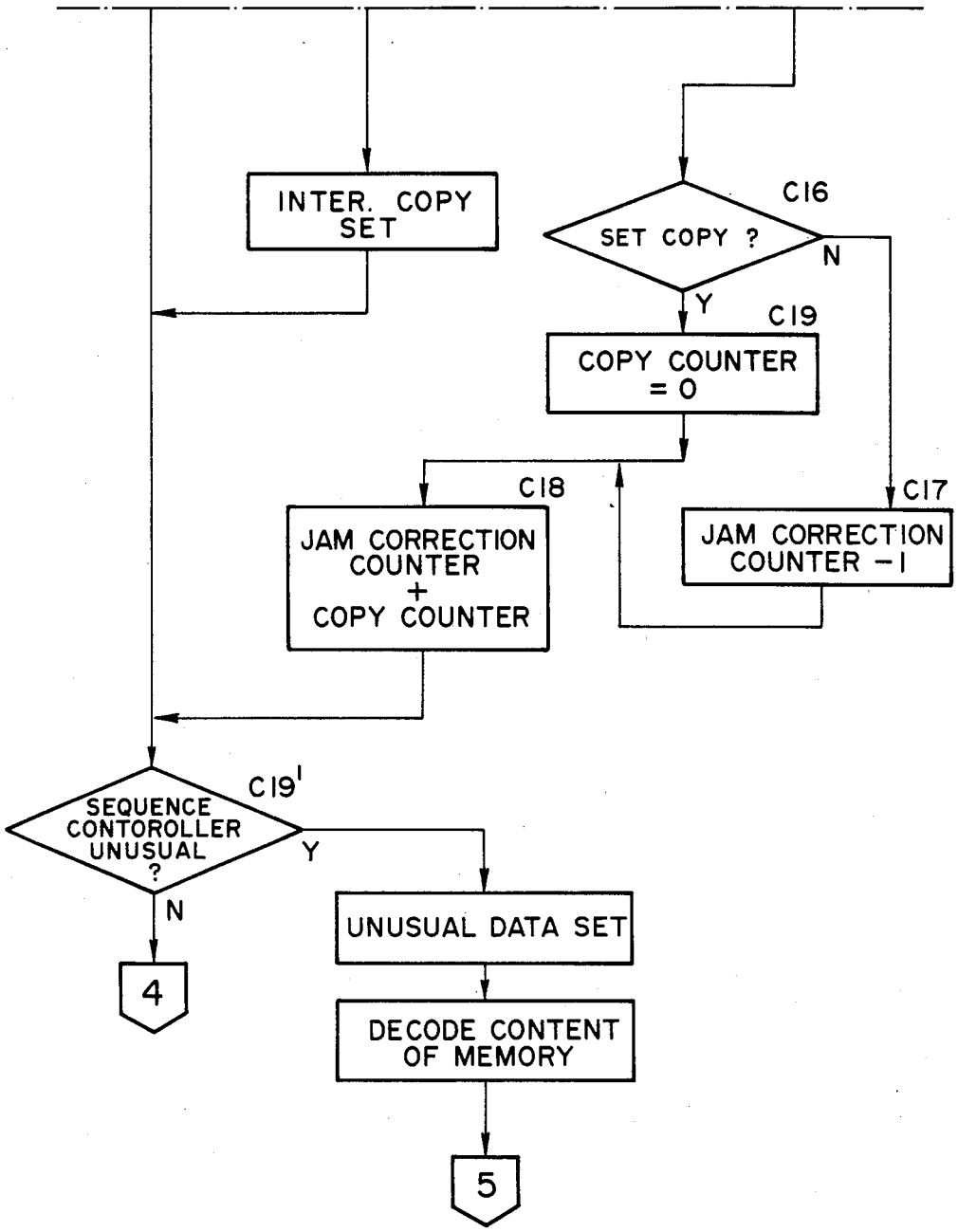
Figures 2A, 20:
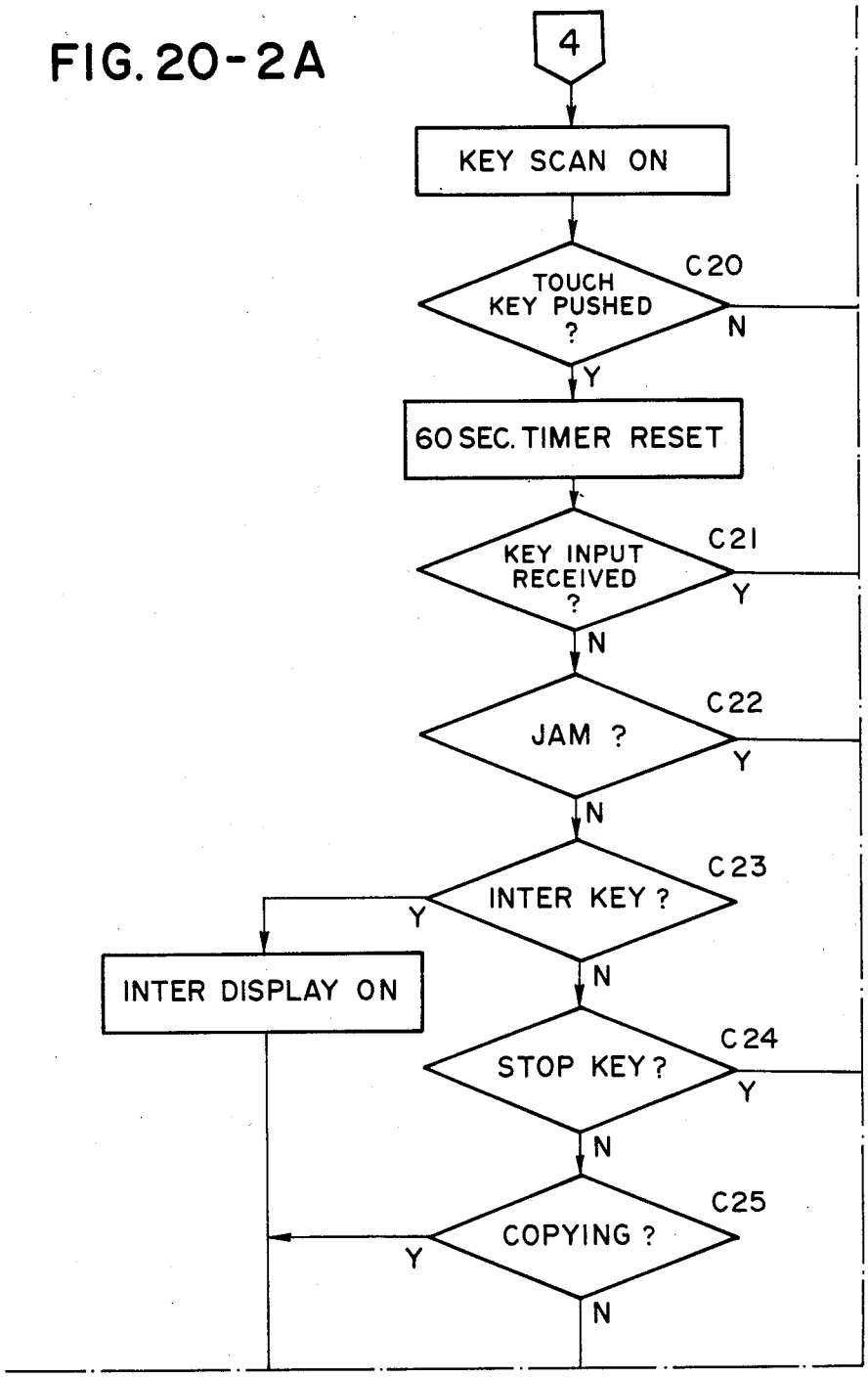
Figures 2B, 20:
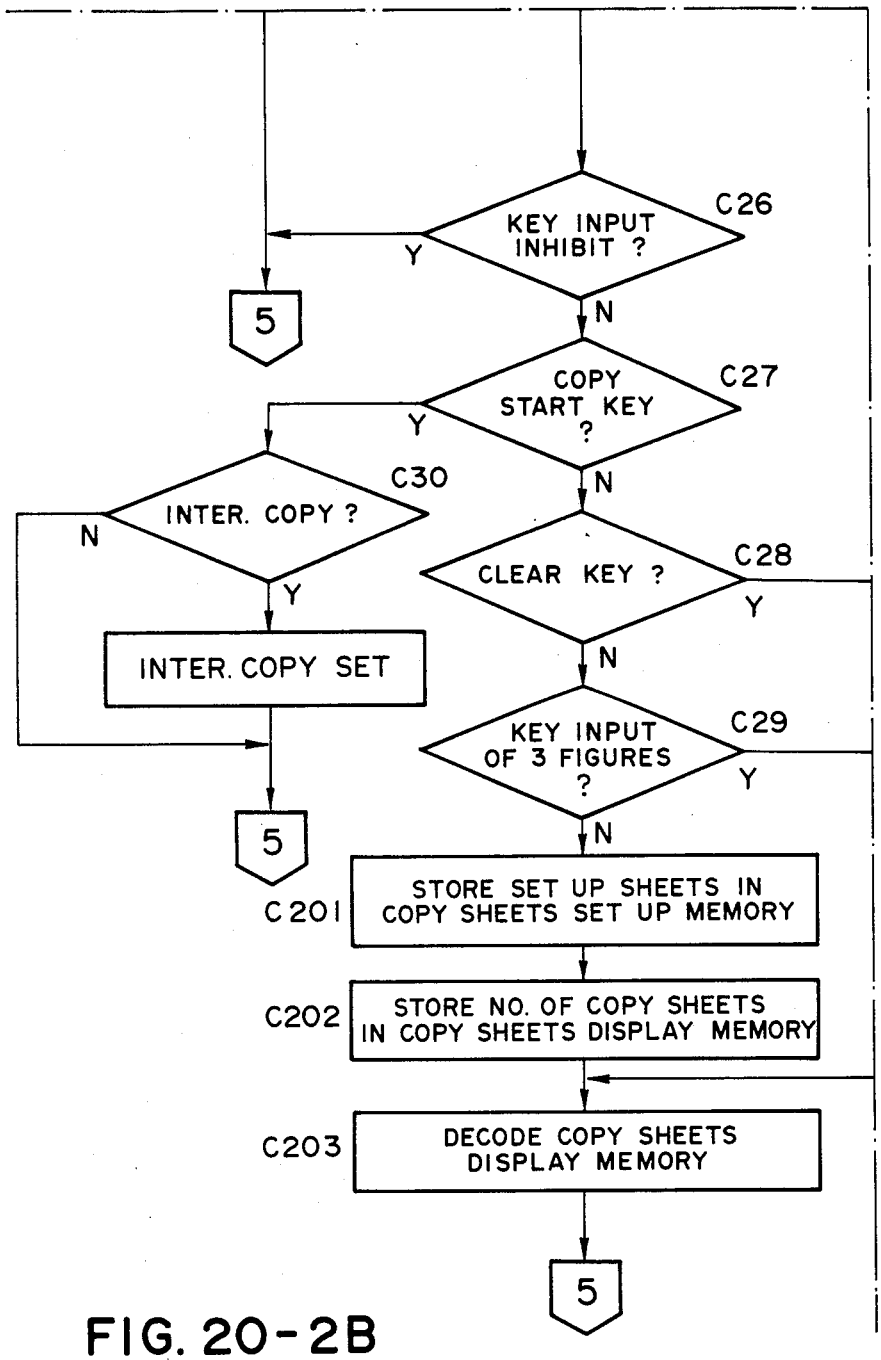
Figures 2C, 20:
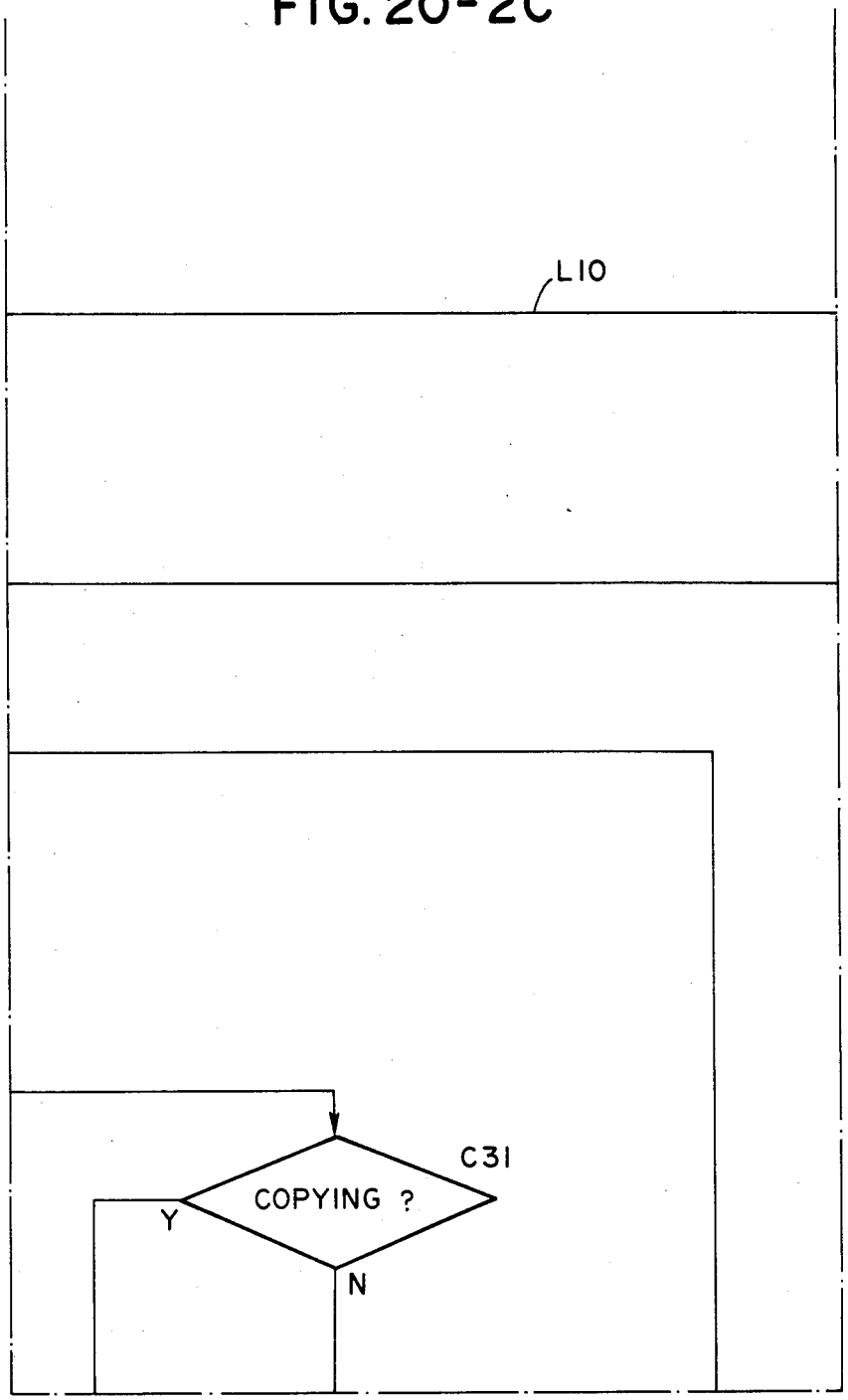
Figures 2D, 20:
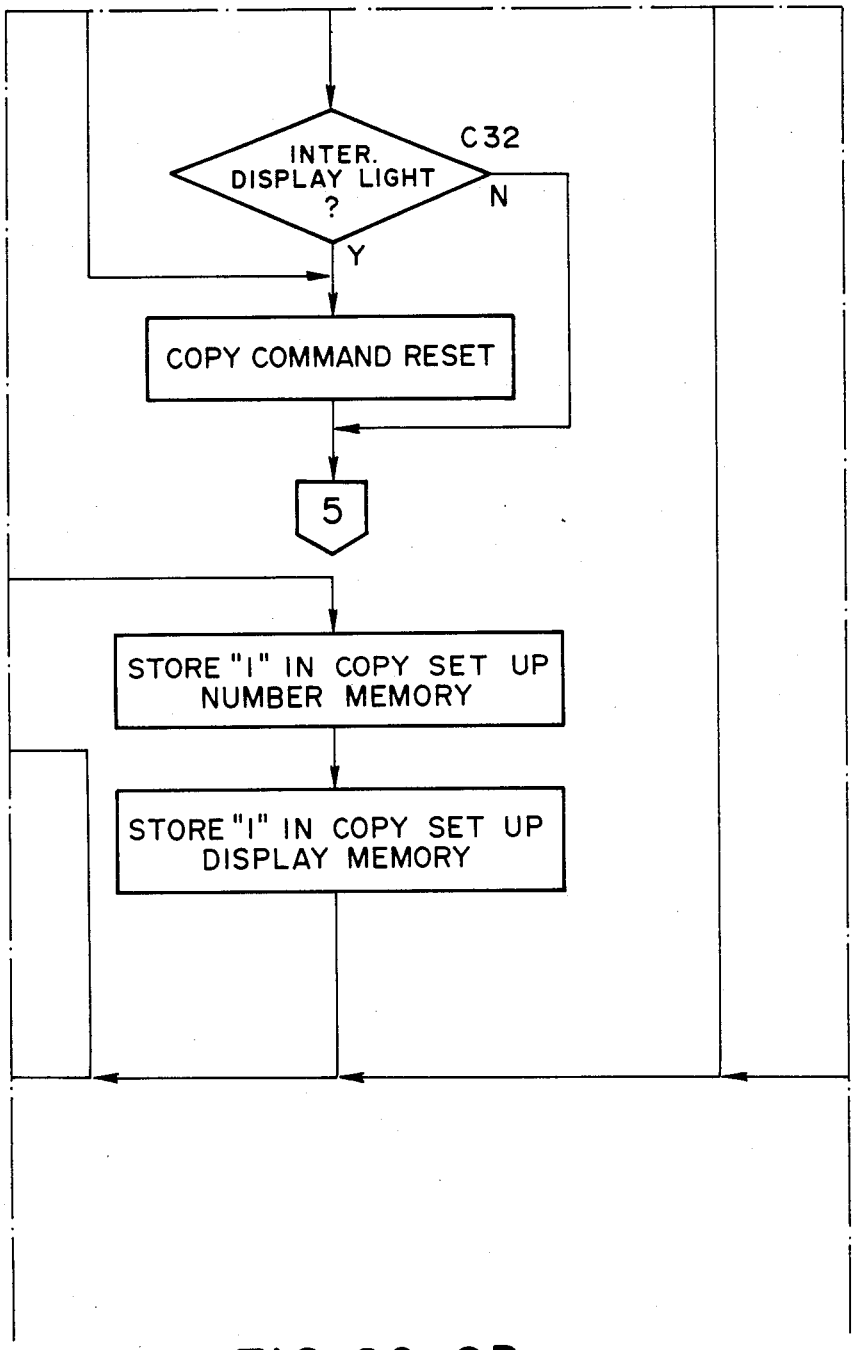
Figures 2E, 20:
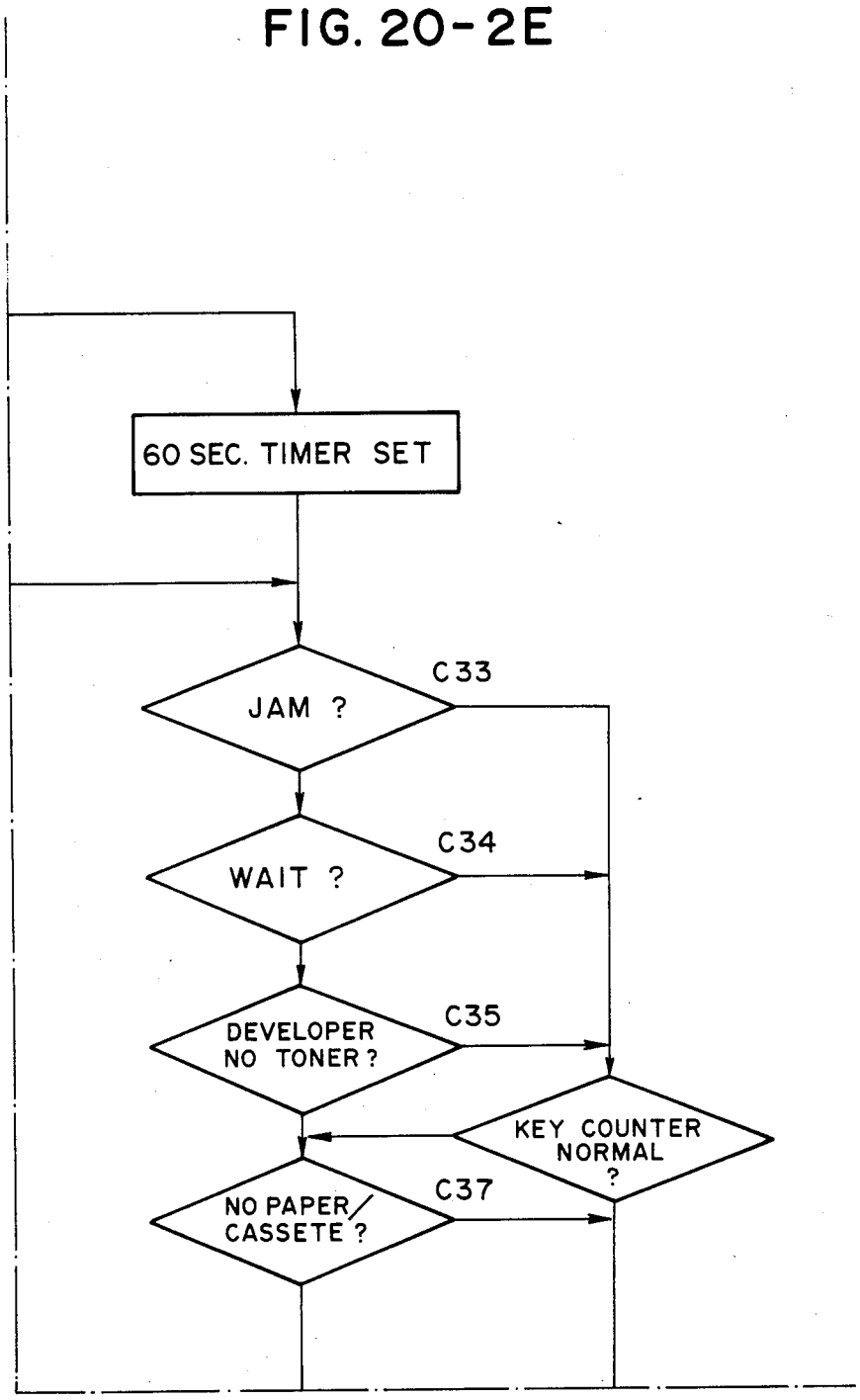
Figures 2F, 20:
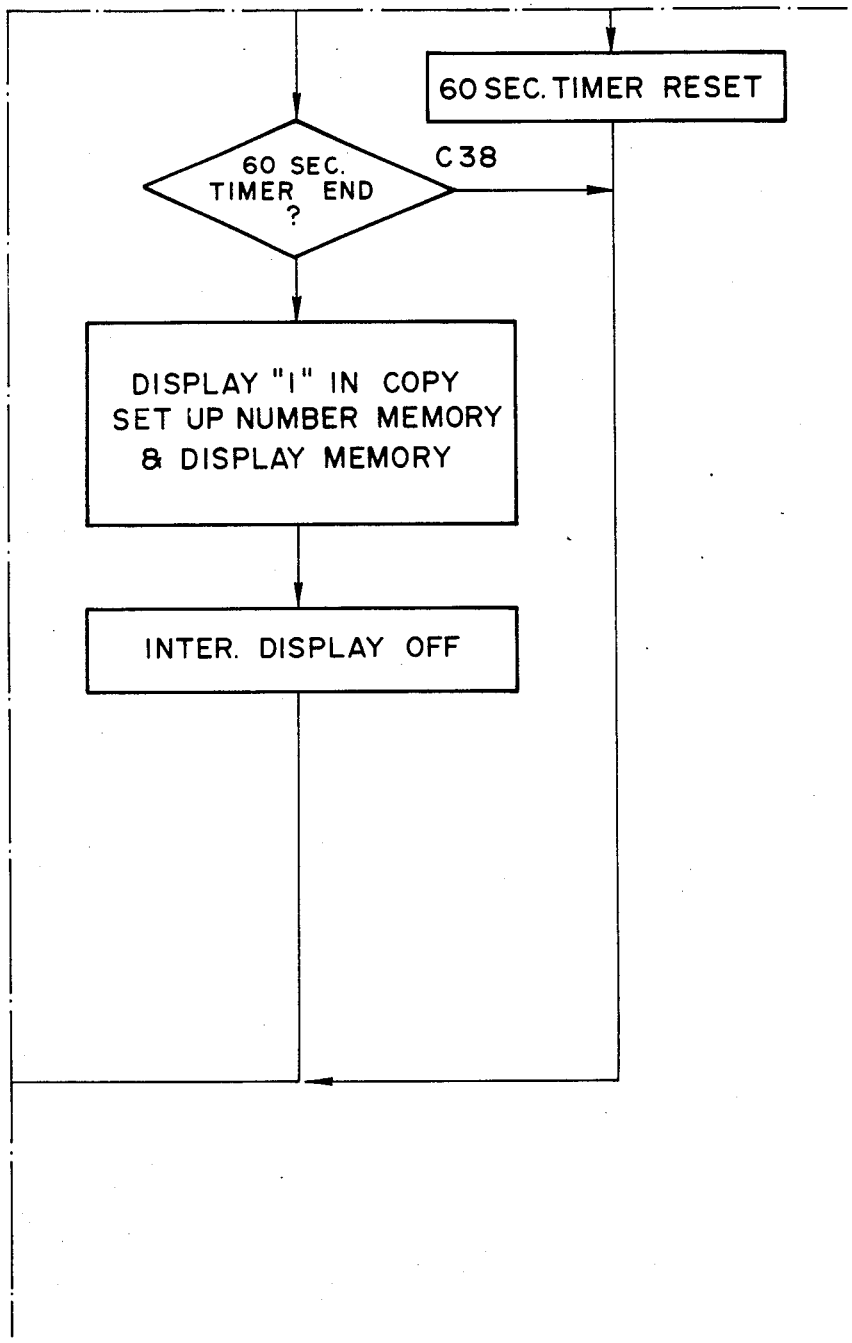
Figures 3A, 20:
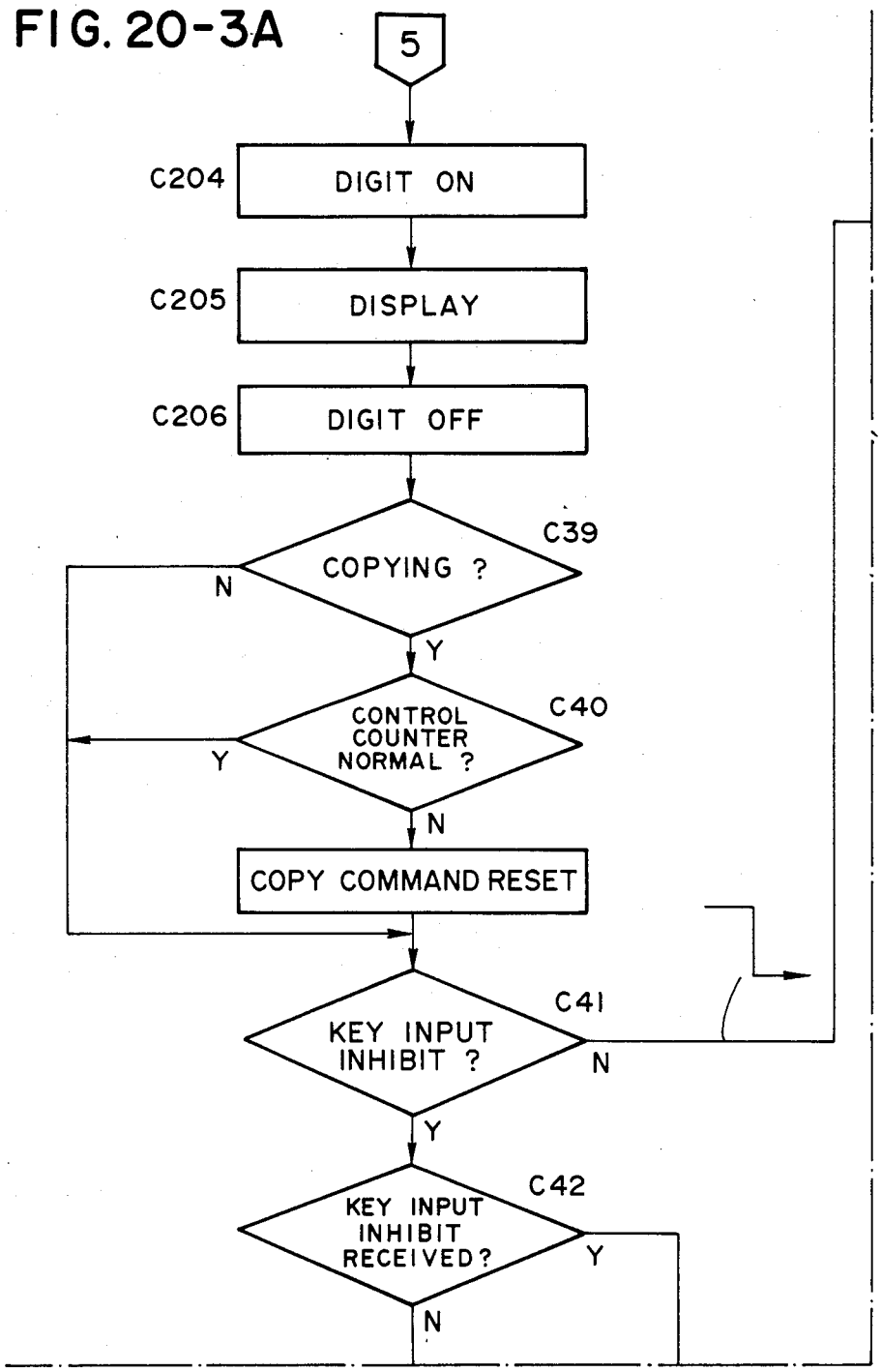
Figures 3B, 20:
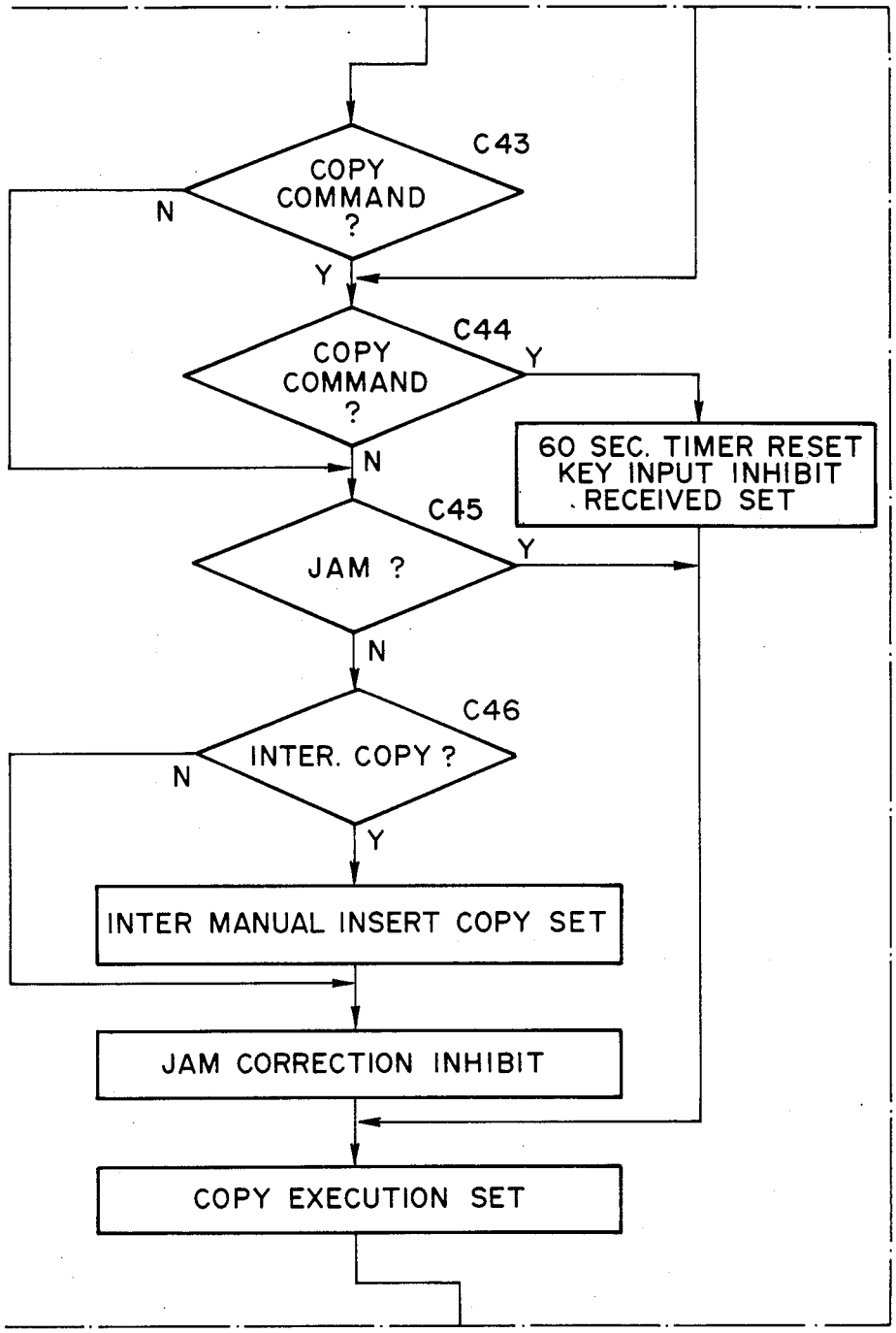
Figures 3C, 20:
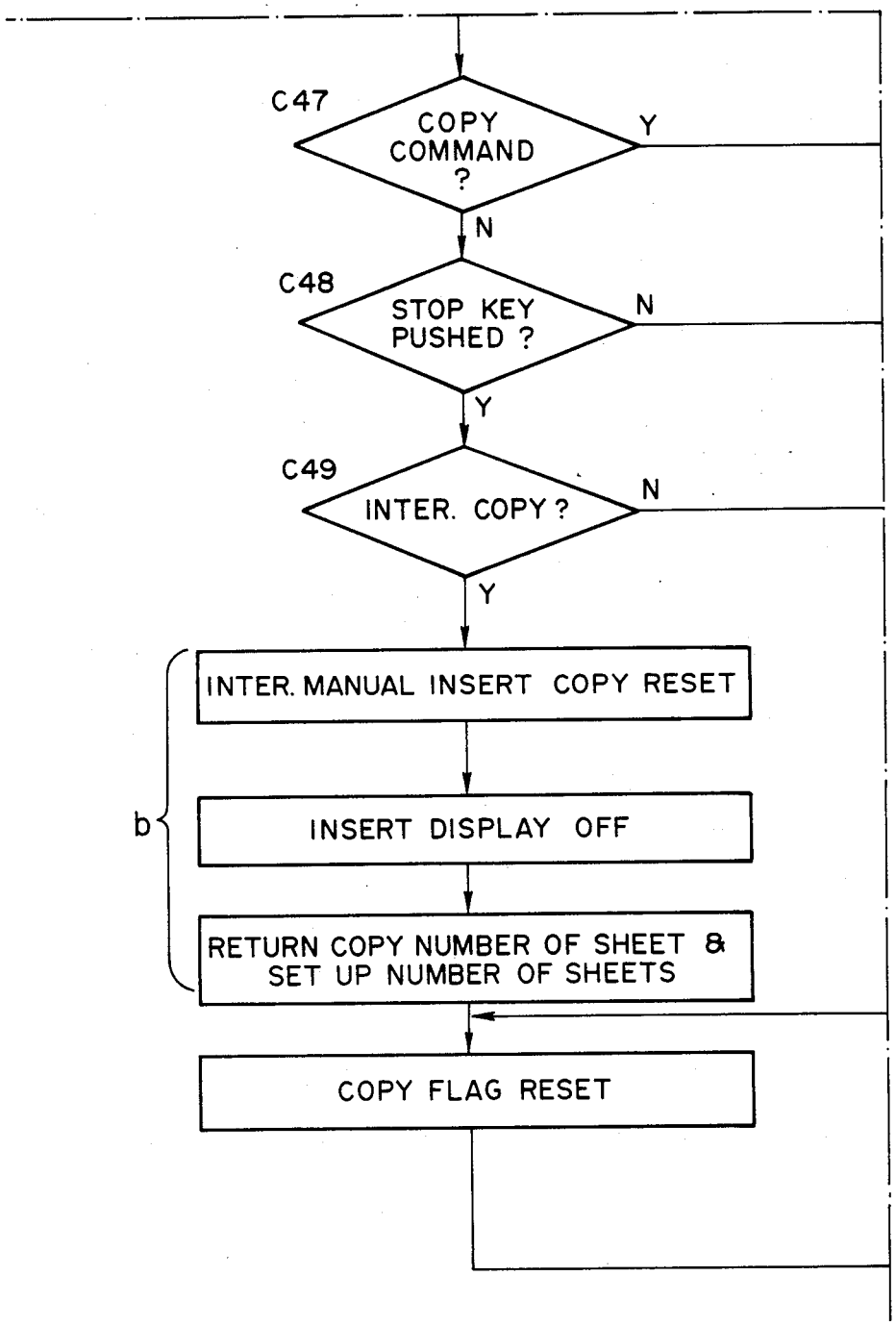
Figures 3D, 20:
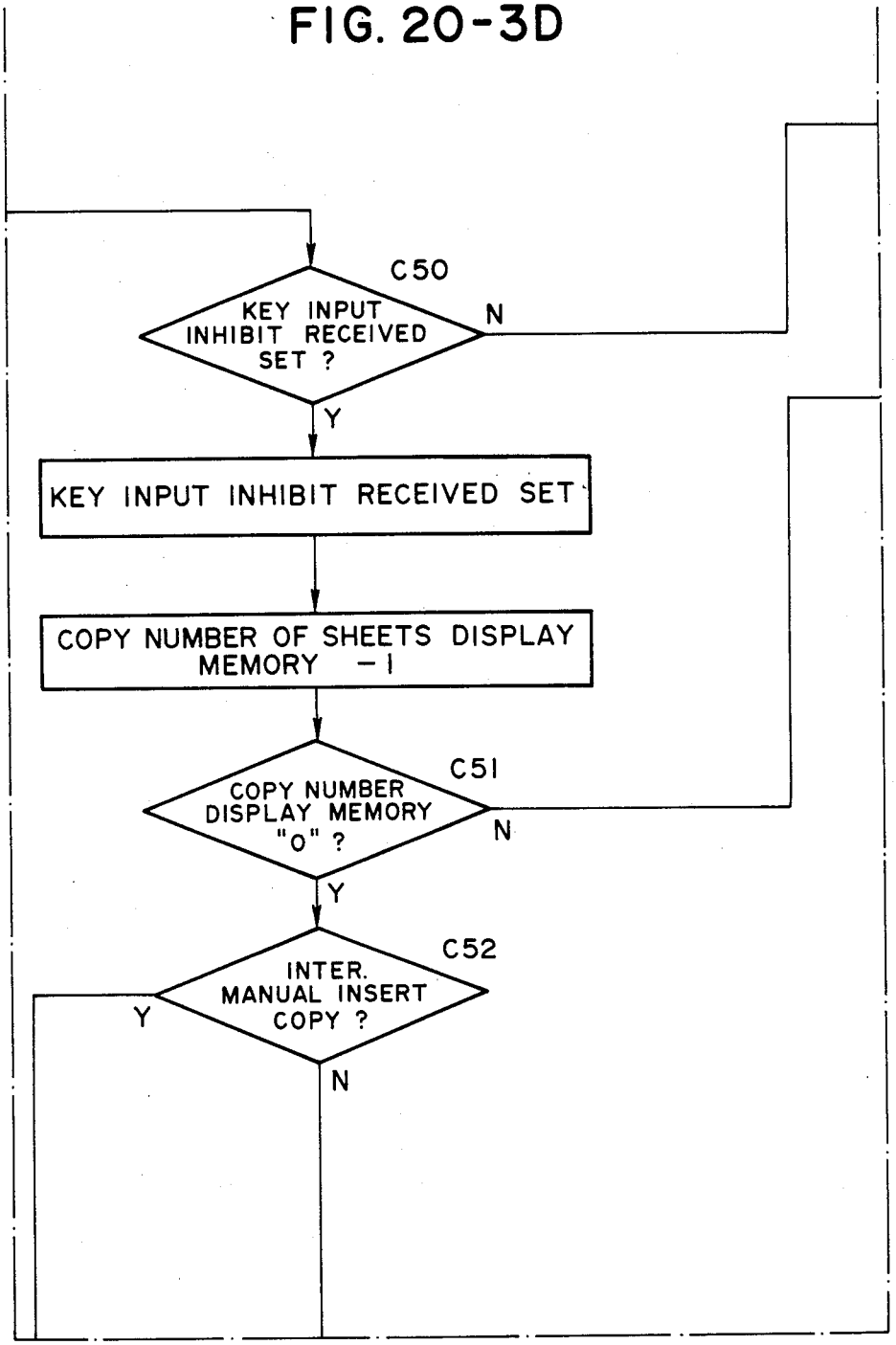
Figures 3E, 20:
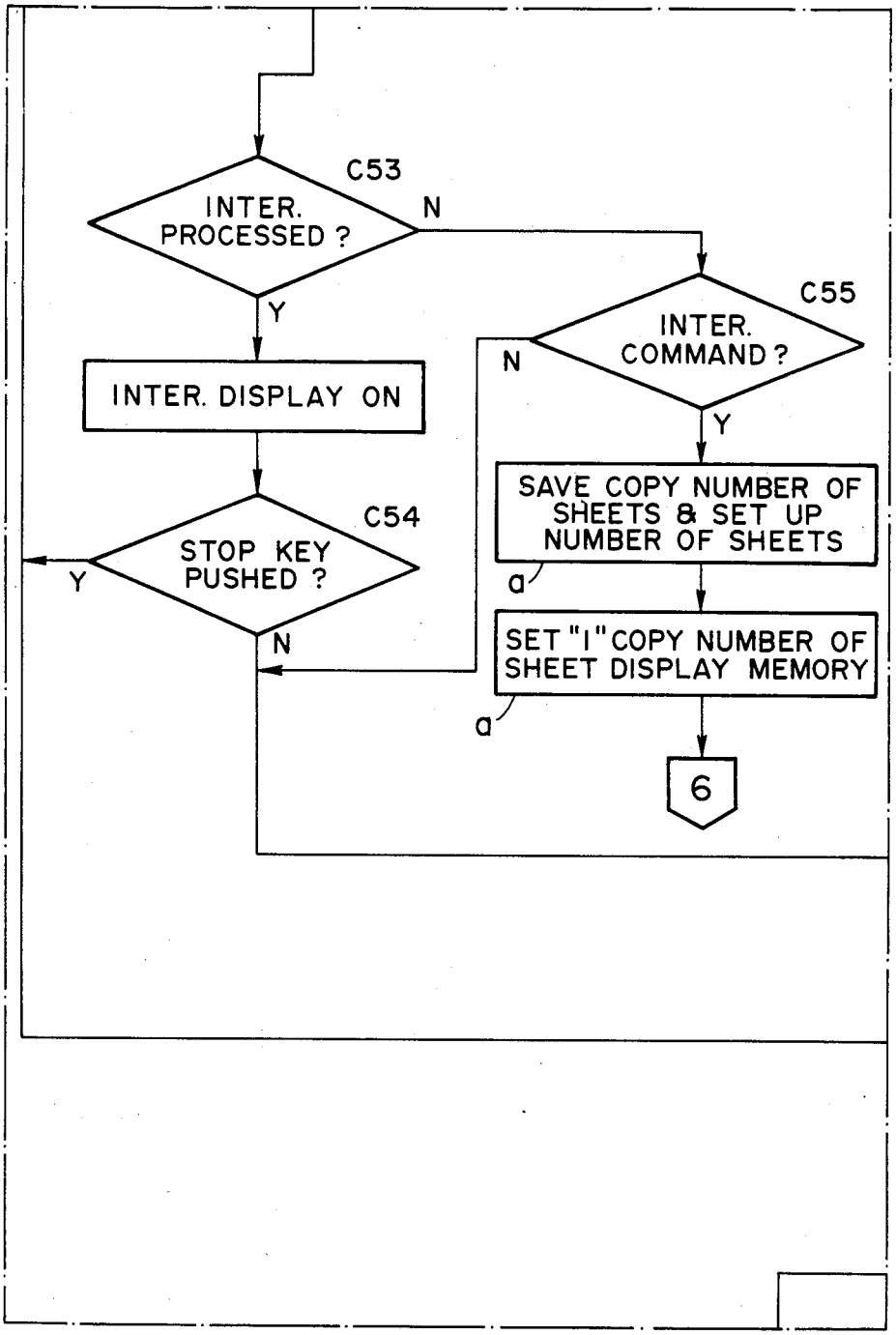
Figures 3F, 20:
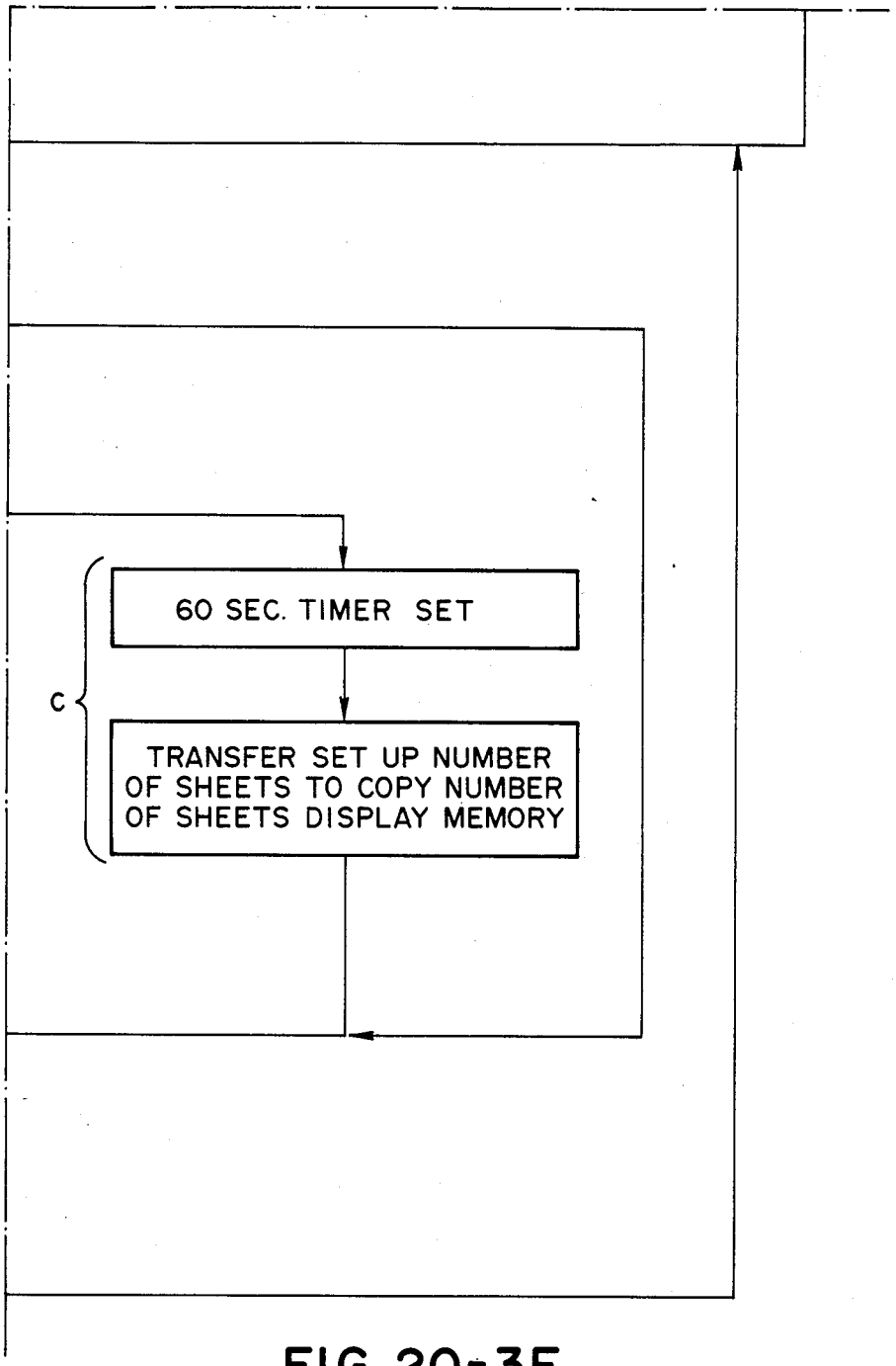
Figures 3G, 20:
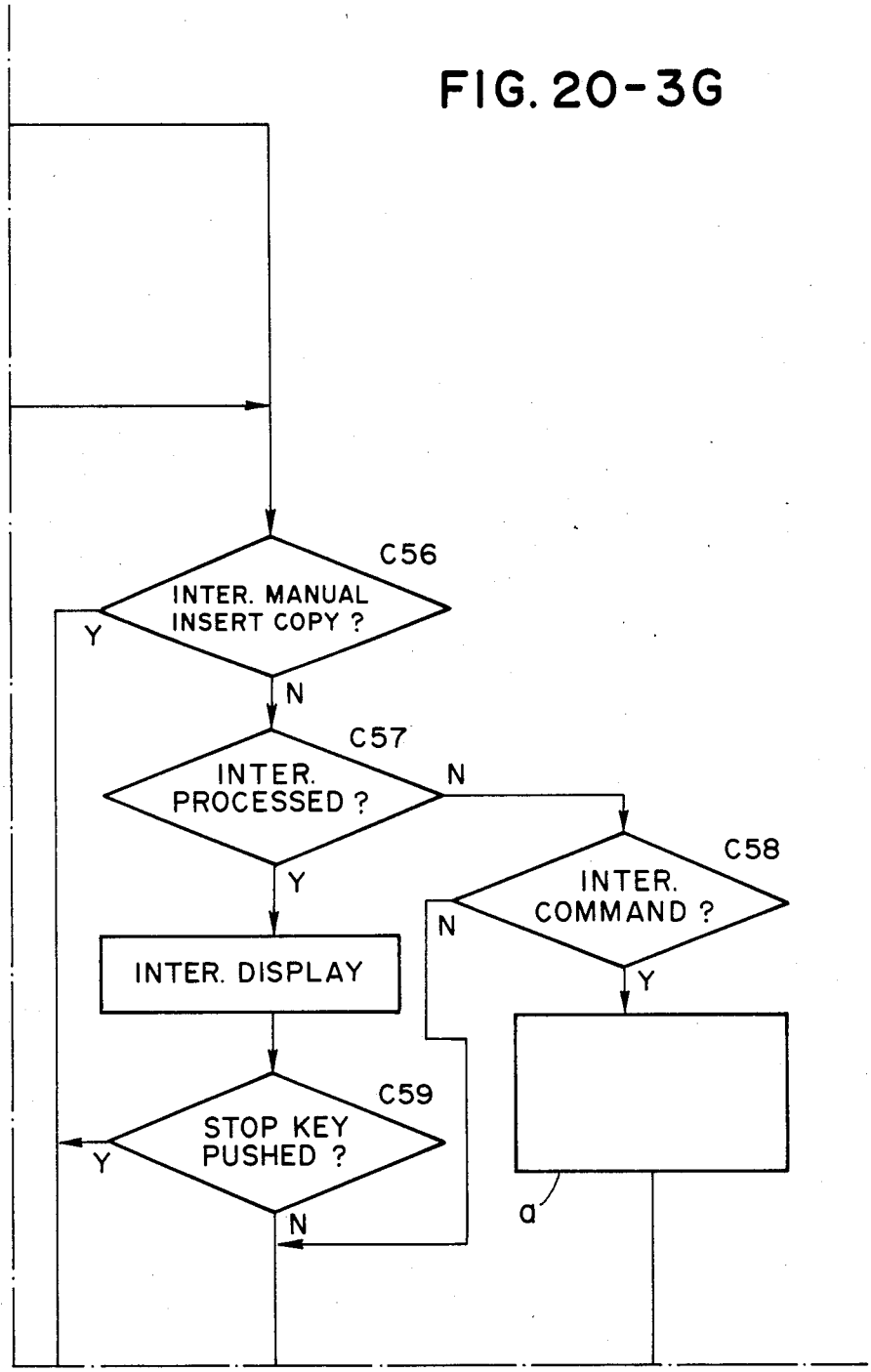
Figures 3H, 20:
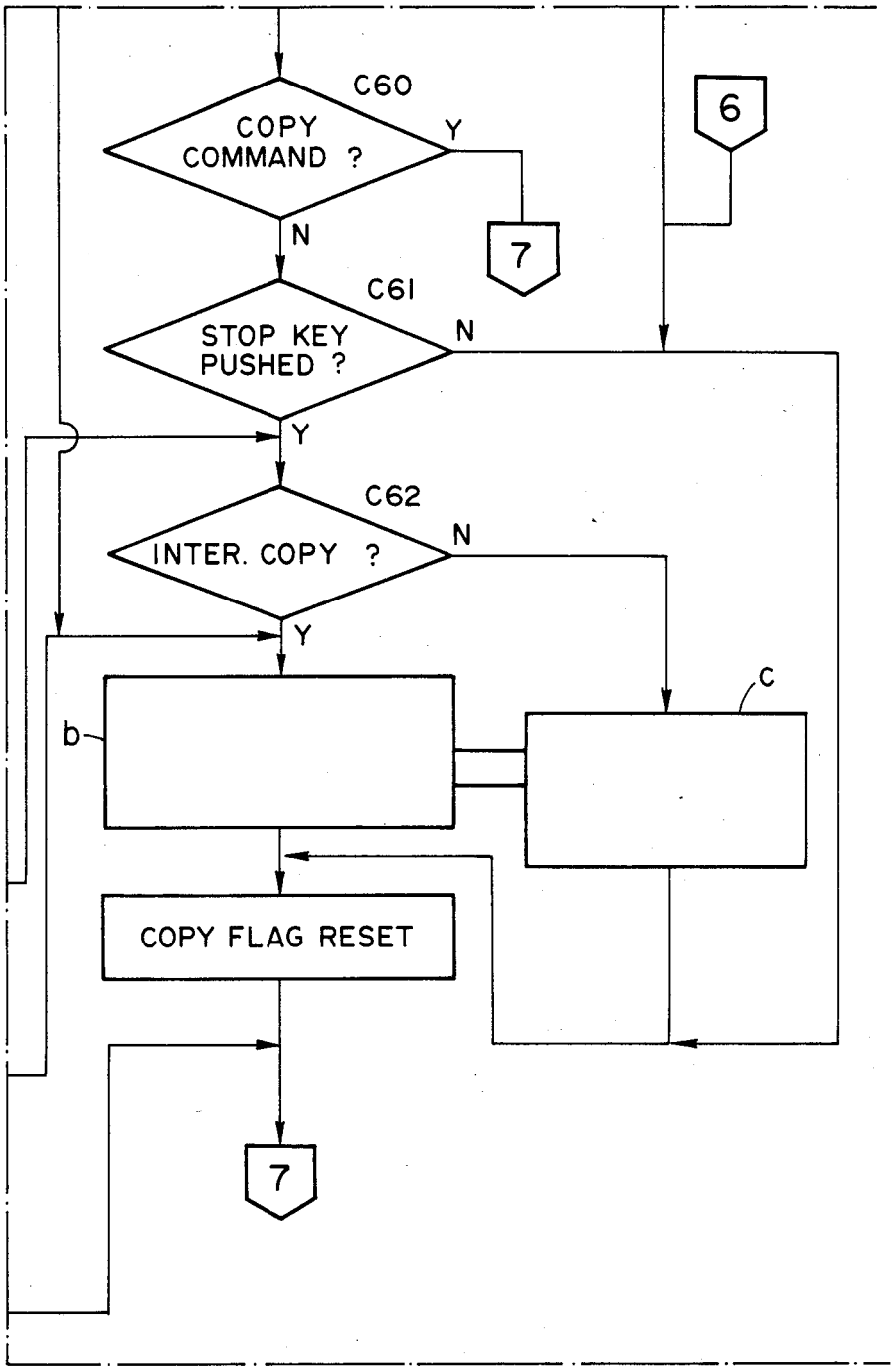
Figures 4A, 20:
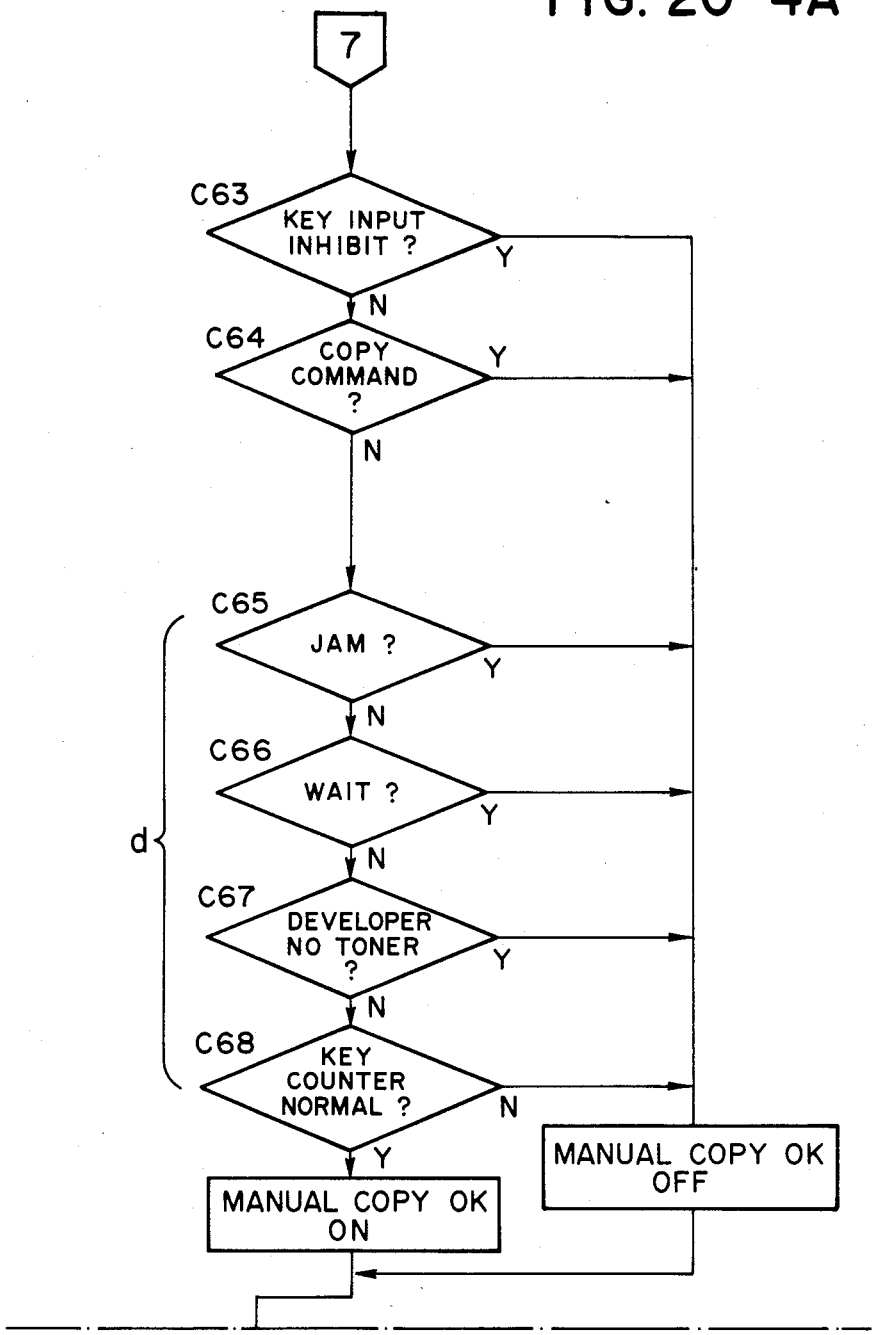
Figures 4B, 20:
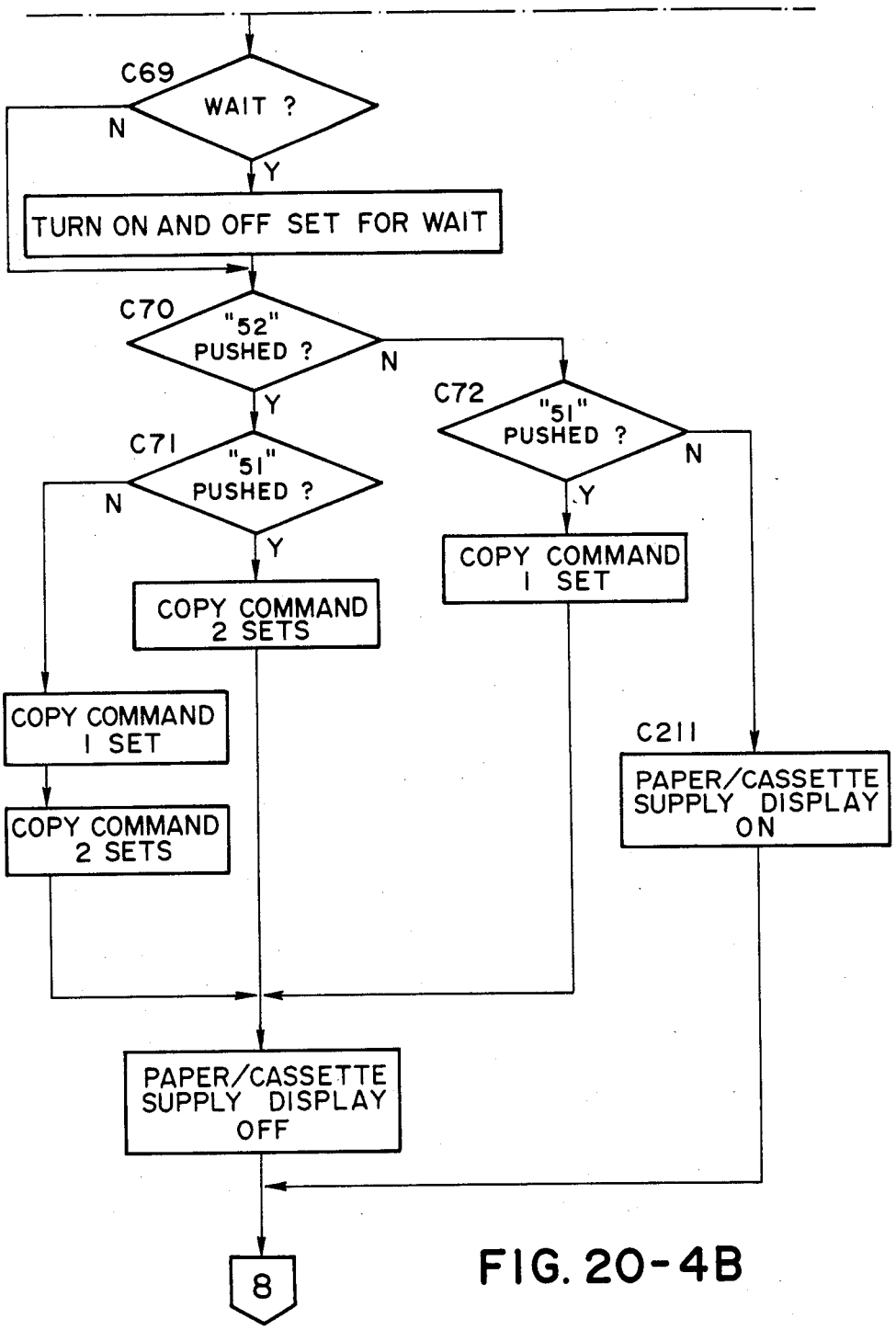
Figures 4C, 20:
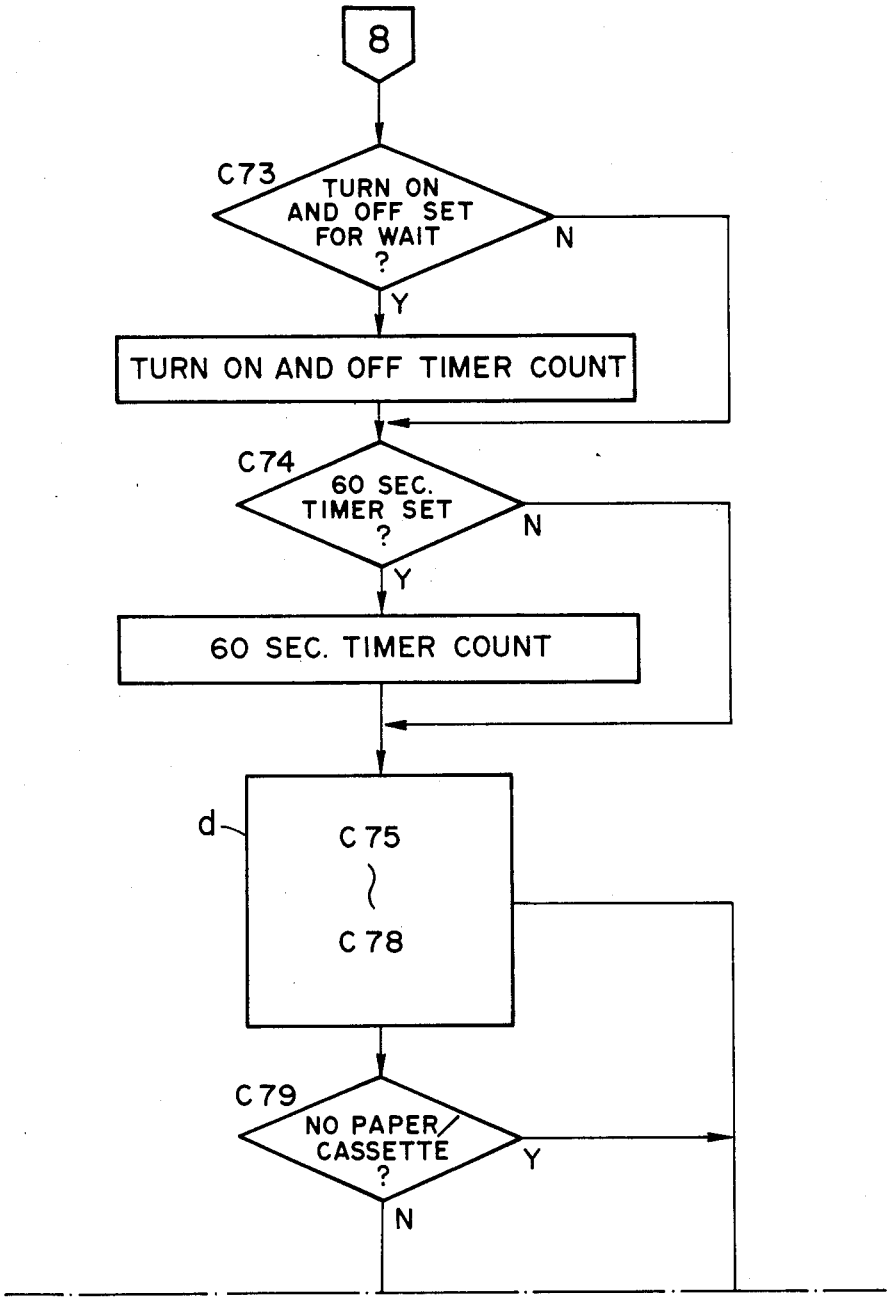
Figures 4D, 20:
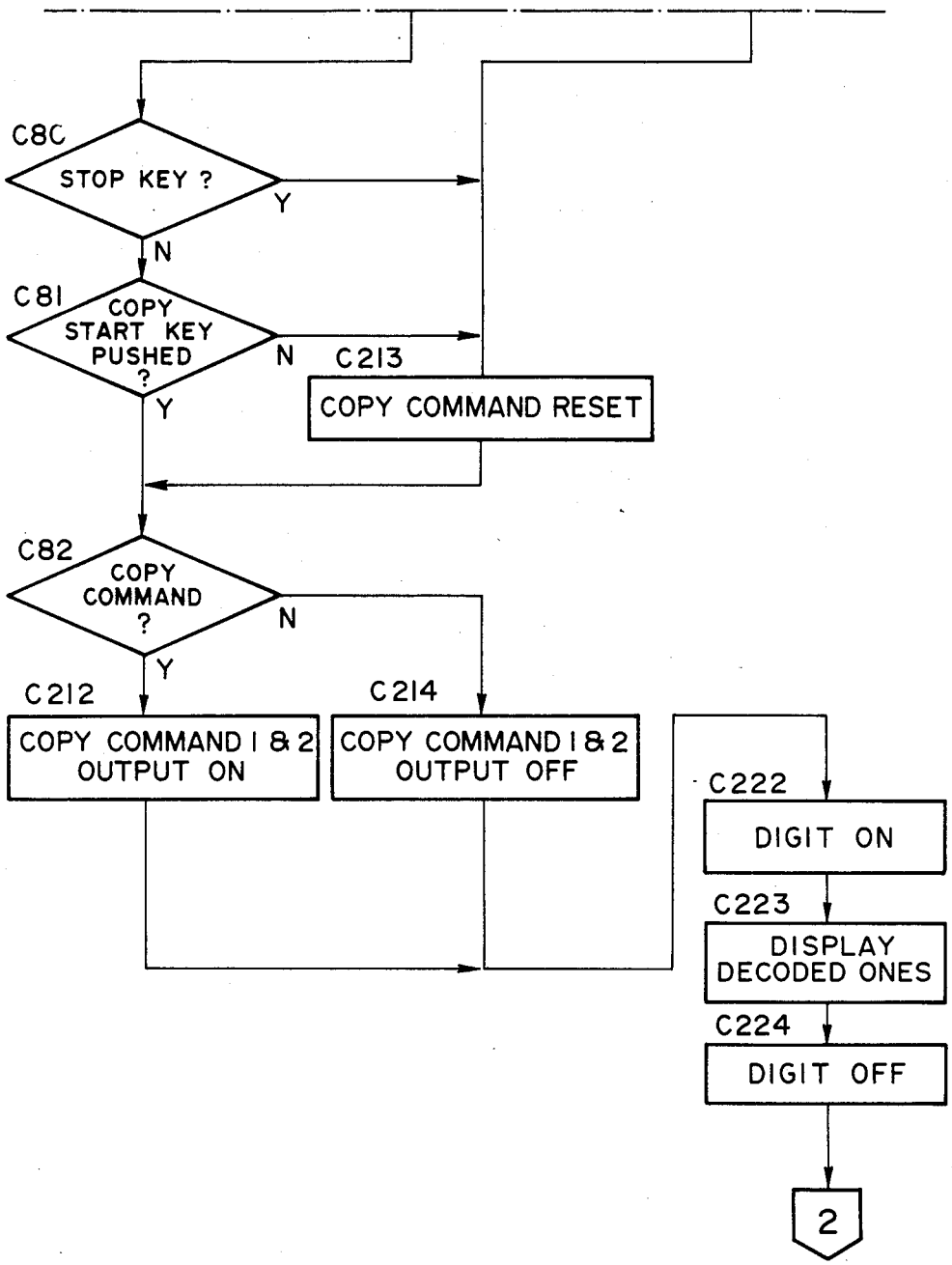
Figures 5C, 21:
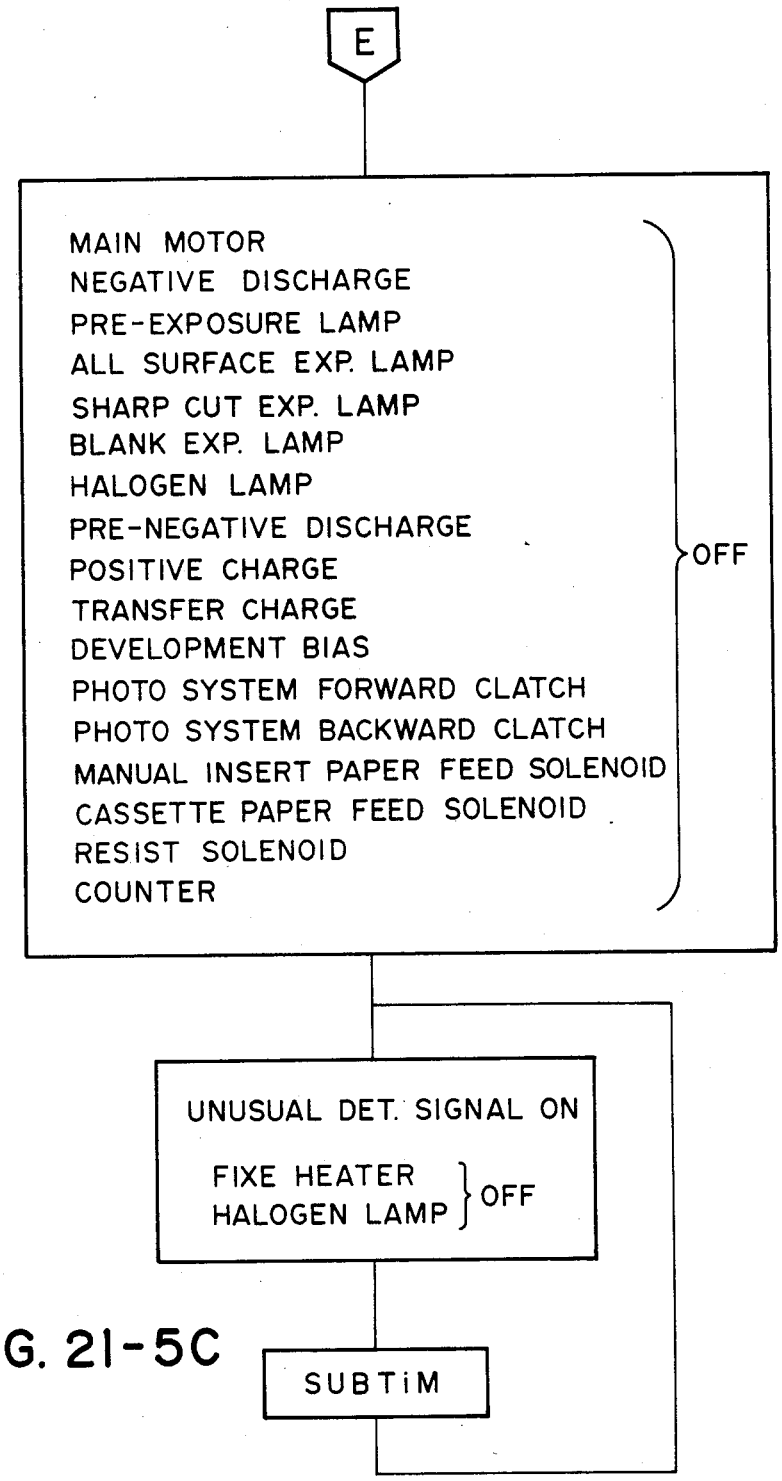
Figures 5D, 21:
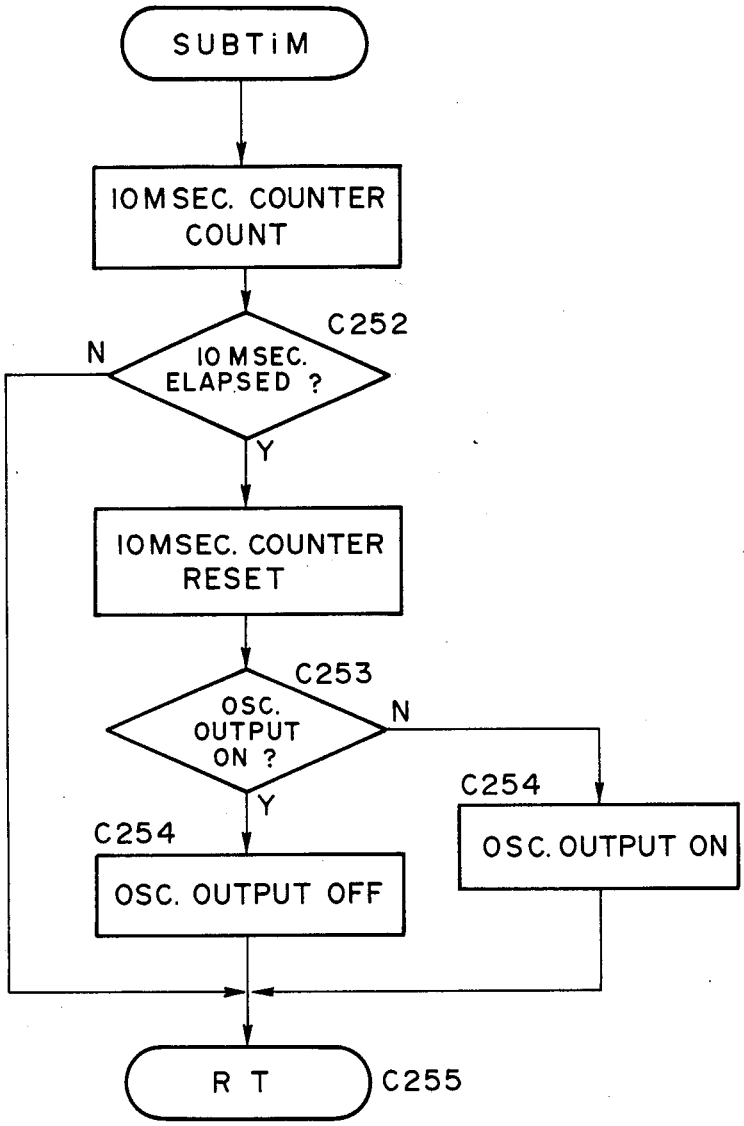

Sheet 4, Figure 4A, "SENSER" should read --SENSOR-- (both occurrences).
Sheet 19, Figure 16, "RELEY (Q6)" should read --RELAY (Q6)--.
Sheet 27, Figure 20-1D, "CONTOROLLER" shoud read --CONTROLLER--.
Sheet 32, Figure 20-2E, "CASSETE" should read --CASSETTE--.
Sheet 49, Figure 21-1B, "RECOVE" should read --RECOVER--.
Sheet 50, Figure 21-1C, "THERMISTER" should read --THERMISTOR--.
Sheet 54, Figure 21-2A, "CLATCH" should read --CLUTCH--.
Sheet 56, Figure 21-2C, "CLATCH" should read --CLUTCH--.
Sheet 60, Figure 21-3C, "CLATCH" should read --CLUTCH--.
Sheet 61, Figure 21-3D, "CLATCH" should read --CLUTCH--.
Sheet 65, Figure 21-4A, "CLATCH" should read --CLUTCH--.
Sheet 65, Figure 21-4A, "THERMISTER" should read --THERMISTOR--.
Sheet 69, Figure 21-B5, "CLATCH" should read --CLUTCH-- (both occurrences).
Sheet 70, Figure 21-5C, "CLATCH" should read --CLUTCH-- (both occurrences).
Sheet 75, Figure 25, "RESIST" should read --REGISTER-- (both occurrences).
Sheet 75, Figure 25, "CLATCH" should read --CLUTCH-- (all occurrences).

UNITED STATES PATENT AND TRADEMARK OFFICE

CERTIFICATE OF CORRECTION

PATENT NO. : 4,758,860

DATED : July 19, 1988

INVENTOR(S) : YOSHIAKI TAKAYANAGI, ET AL.

It is certified that error appears in the above-identified patent and that said Letters Patent is hereby corrected as shown below:

IN THE DRAWINGS (continued)

Figure 30A:
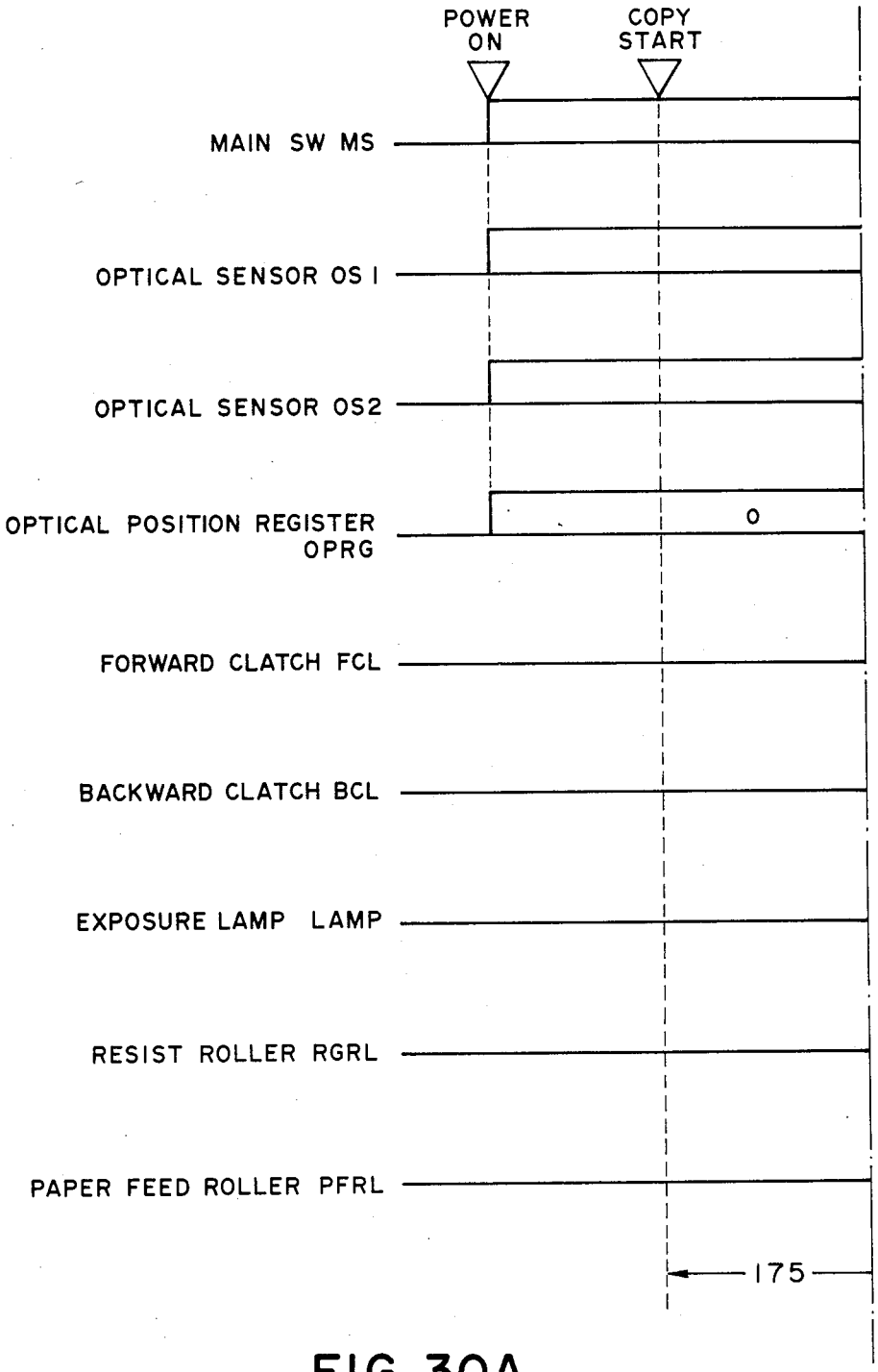
FIGS. 30A, 30B and 30C show a timing chart showing the function of various units according to the flow chart shown in FIG. 29.
Figure 30B:
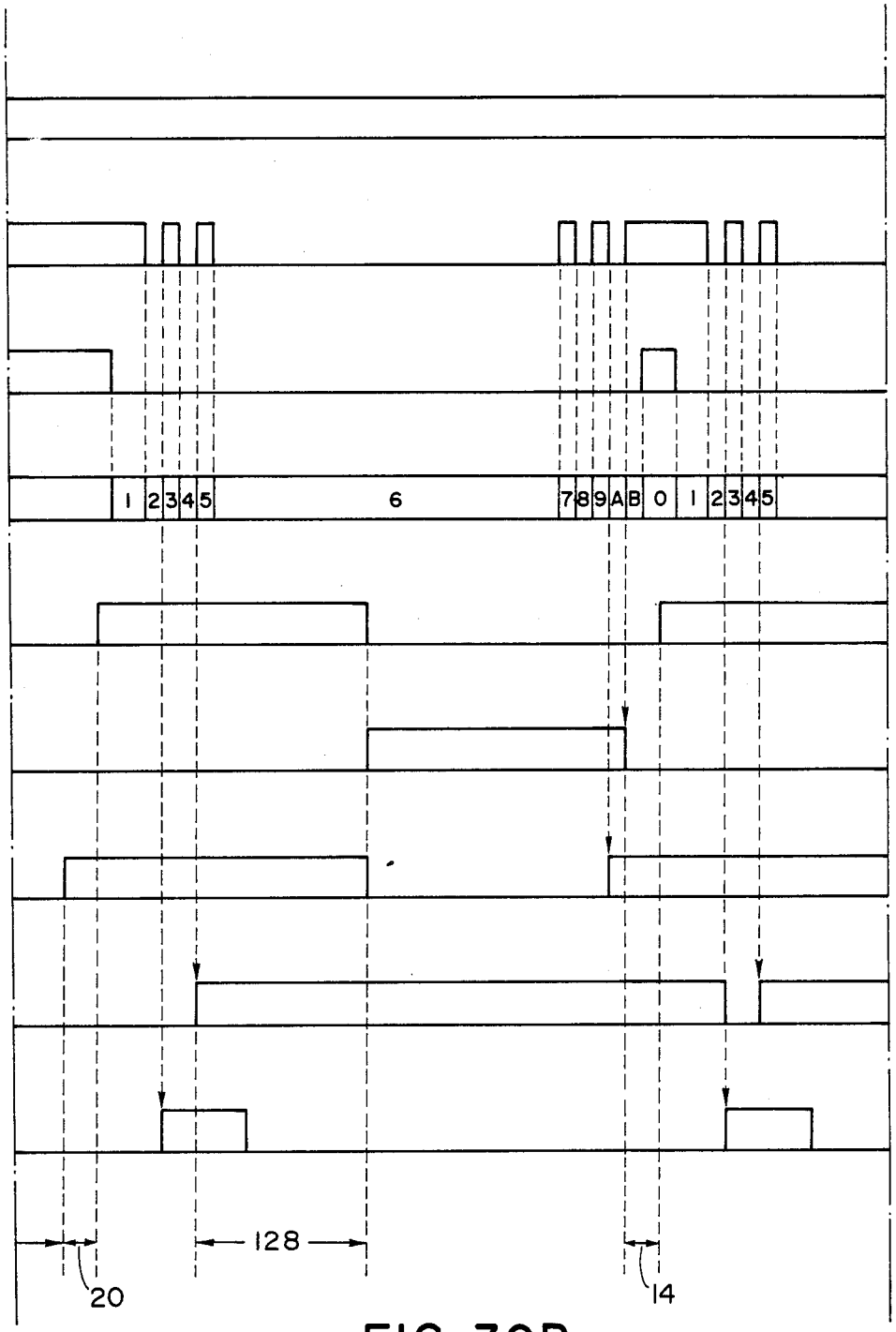
Figure 30C:
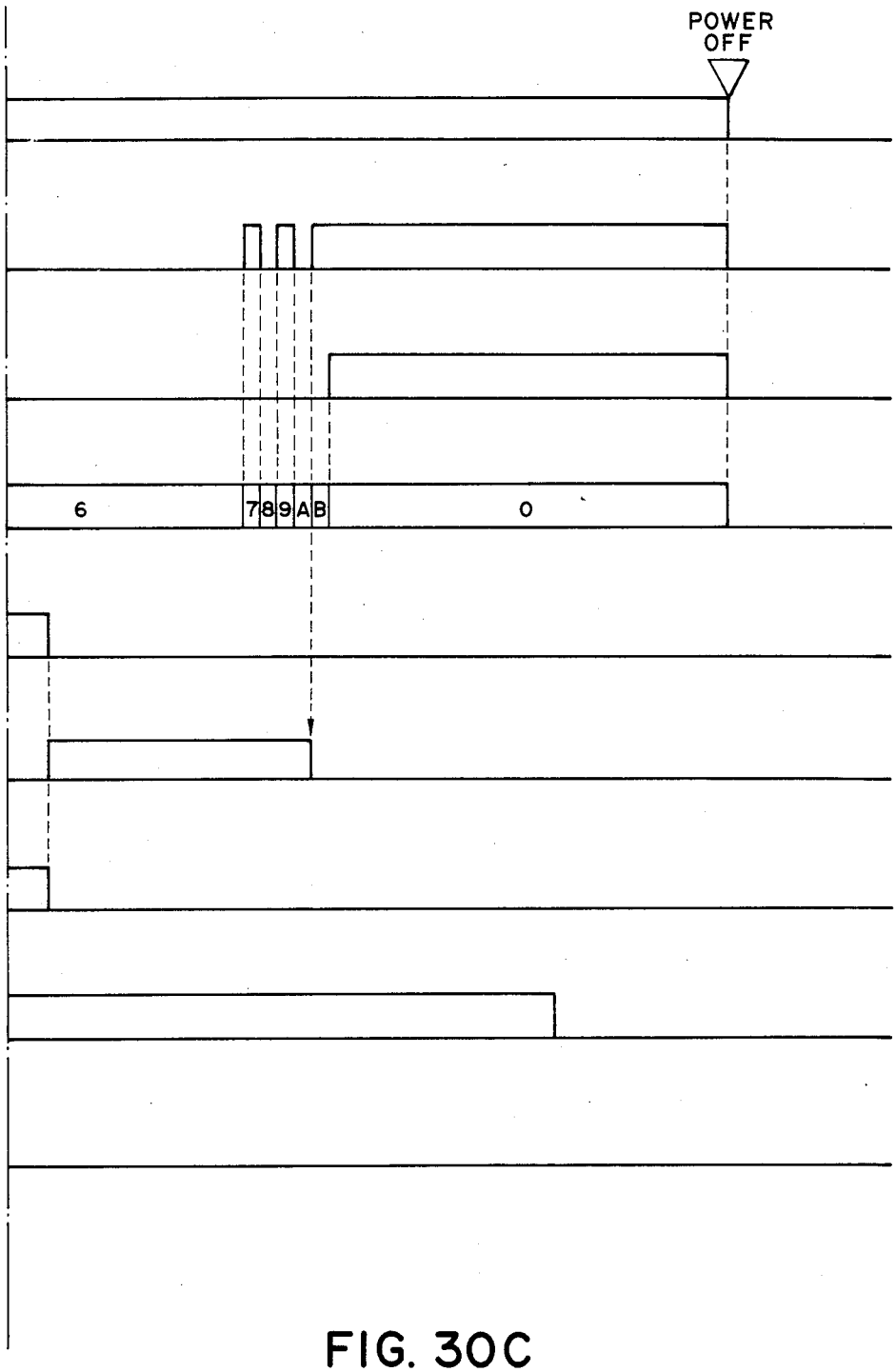

Sheet 83, Figure 30A, "CLATCH" should read --CLUTCH-- (both occurrences).
Sheet 83, Figure 30A, "RESIST" should read --REGISTER--.

COLUMN 1

Line 19, "computer" should read --computers--.

COLUMN 2

Line 57,, "or" should read --of--.

COLUMN 4

Line 52, "FIG. 28 a" should read --FIG. 28 shows a--.
Line 58, "combination" should read --a combination--.

COLUMN 5

Line 48, "heat" should read --heater--.

COLUMN 6

Line 18, "oprical" should read --optical--.

COLUMN 9

Line 3, "preexposure" should read --pre-exposure--.

UNITED STATES PATENT AND TRADEMARK OFFICE

CERTIFICATE OF CORRECTION

PATENT NO. : 4,758,860

DATED : July 19, 1988

INVENTOR(S) : YOSHIAKI TAKAYANAGI, ET AL.

It is certified that error appears in the above-identified patent and that said Letters Patent is hereby corrected as shown below:

COLUMN 12

Line 28, "a" should read --of--.

COLUMN 15

Line 33, "sheet" should read --sheets--.
Line 34, "control" should read --control,--.

COLUMN 16

Line 39, "start" should read --starts--.
Line 43, "respective" should read --respectively--.

COLUMN 19

Line 16, "subroutiner" should read --subroutine,--.
Line 28, "repeated" should read --repeatedly--.

COLUMN 20

Line 15, "shiled 1-C" should read --shield 1-C--.

COLUMN 22

Line 42, "expalined" should read --explained--.

COLUMN 23

Line 61, "turns of" should read --turns on--.

UNITED STATES PATENT AND TRADEMARK OFFICE

CERTIFICATE OF CORRECTION

PATENT NO. : 4,758,860

DATED : July 19, 1988

INVENTOR(S) : YOSHIAKI TAKAYANAGI, ET AL.

It is certified that error appears in the above-identified patent and that said Letters Patent is hereby corrected as shown below:

COLUMN 26

Line 15, "returened" should read --returned--.
Line 17, "form" should read --from--.
Line 25, "the" should read --said--.

Signed and Sealed this

Sixth Day of June, 1989

*Attest:*

DONALD J. QUIGG

*Attesting Officer*

*Commissioner of Patents and Trademarks*